US008510018B2

(12) United States Patent
Kato

(10) Patent No.: US 8,510,018 B2
(45) Date of Patent: Aug. 13, 2013

(54) CONTROL VALVE APPARATUS

(75) Inventor: Hiroyuki Kato, Koza-gun (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 352 days.

(21) Appl. No.: 12/973,429

(22) Filed: Dec. 20, 2010

(65) Prior Publication Data

US 2011/0146602 A1 Jun. 23, 2011

(30) Foreign Application Priority Data

Dec. 22, 2009 (JP) ..... 2009-290236

(51) Int. Cl.
*B60T 7/12* (2006.01)
*F01M 1/02* (2006.01)

(52) U.S. Cl.
USPC ..... 701/103; 123/196 R

(58) Field of Classification Search
USPC ..... 123/385–387, 501, 502, 196 R, 196 S, 123/196 CP; 701/103, 104, 107, 112, 113; 251/30.01; 137/625.65
See application file for complete search history.

(56) References Cited

U.S. PATENT DOCUMENTS

| | | | | |
|---|---|---|---|---|
| 4,452,188 | A | 6/1984 | Kosuda et al. | |
| 6,739,305 | B2 * | 5/2004 | Takahara et al. | 123/196 R |
| 7,481,053 | B2 * | 1/2009 | Kitano et al. | 60/428 |
| 7,779,958 | B2 * | 8/2010 | Kitano et al. | 180/339 |
| 8,297,240 | B2 * | 10/2012 | Inoue et al. | 123/90.1 |
| 2001/0048090 | A1 * | 12/2001 | Kobayashi et al. | 251/129.15 |
| 2002/0020375 | A1 * | 2/2002 | Sluka et al. | 123/90.15 |
| 2002/0088416 | A1 * | 7/2002 | Nakamura et al. | 123/90.16 |
| 2002/0100445 | A1 * | 8/2002 | Takenaka et al. | 123/90.17 |
| 2002/0139332 | A1 * | 10/2002 | Takenaka | 123/90.17 |
| 2002/0166532 | A1 * | 11/2002 | Mori et al. | 123/179.31 |
| 2003/0070638 | A1 * | 4/2003 | Hase | 123/90.17 |
| 2006/0042580 | A1 * | 3/2006 | Suga et al. | 123/90.17 |
| 2006/0070600 | A1 * | 4/2006 | Hara | 123/196 R |
| 2008/0105231 | A1 * | 5/2008 | Ono et al. | 123/196 R |
| 2009/0228187 | A1 * | 9/2009 | Nakamura | 701/103 |
| 2009/0229561 | A1 * | 9/2009 | Yamashita et al. | 123/196 R |
| 2009/0293834 | A1 * | 12/2009 | Ono et al. | 123/196 R |
| 2009/0311115 | A1 * | 12/2009 | Ono et al. | 417/279 |

FOREIGN PATENT DOCUMENTS

JP 57-173513 A 10/1982

* cited by examiner

*Primary Examiner* — John Kwon
*Assistant Examiner* — Johnny Hoang
(74) *Attorney, Agent, or Firm* — Crowell & Moring LLP

(57) ABSTRACT

In a hydraulic system equipped with a main flow passage for feeding oil to each of lubricated engine parts and a branch passage branched from the main flow passage, a control valve apparatus is provided for adjusting a flow rate of the oil flowing through a portion of the main flow passage downstream of the branched point. The control valve apparatus is configured to control the flow rate to a large flow-rate side of a variable flow-rate range, until a hydraulic pressure of the oil flowing through the main flow passage becomes greater than or equal to a predetermined pressure value after the engine has been started from its stopped state. The control valve apparatus is further configured to control the flow rate to a small flow-rate side of the variable flow-rate range, when the predetermined pressure value has been reached.

16 Claims, 9 Drawing Sheets

CONTROL VALVE APPARATUS

TECHNICAL FIELD

The present invention relates to a control valve apparatus configured to control fluid flow (lubricating and/or working oil flow).

BACKGROUND ART

It is generally known that, in a hydraulic system with a main fluid-flow passage for feeding oil (lubricating oil) to moving parts of an internal combustion engine requiring lubrication and a branch passage branched from the main flow passage for feeding oil (working oil) to a hydraulic actuator, a control valve apparatus is disposed in the main flow passage downstream of a branched point of the branch passage from the main flow passage, for controlling a flow rate of oil flowing through the main flow passage downstream of the branched point. One such control valve apparatus has been disclosed in Japanese Patent Provisional Publication No. 57-173513 (hereinafter is referred to as "JP57-173513"), corresponding to U.S. Pat. No. 4,452,188, issued on Jun. 5, 1984. In the control valve apparatus (the oil-feed control apparatus) disclosed in JP57-173513, when the flow rate of oil fed into the main flow passage is limited during operation of an internal combustion engine at low speeds, the flow rate of oil flowing through the main flow passage downstream of the branched point is controlled to a small amount by means of the control valve apparatus. As a result of this, oil can be preferentially fed into the branch passage, thereby enhancing the responsiveness of a hydraulic actuator, to which oil (working oil) is delivered by way of the branch passage.

SUMMARY OF THE INVENTION

However, in the case of the apparatus as disclosed in JP57-173513, there might be a lack of oil to be supplied to moving engine parts of the internal combustion engine.

It is, therefore, in view of the previously-described disadvantages of the prior art, an object of the invention to provide a control valve apparatus capable of suppressing a lack of oil to be supplied to moving parts of an internal combustion engine requiring lubrication.

In order to accomplish the aforementioned and other objects of the present invention, in a hydraulic system equipped with a main flow passage for feeding oil, discharged from an oil pump driven by an internal combustion engine, to each of lubricated engine parts, a branch passage branched from the main flow passage at a branched point, and a hydraulically-operated variable valve timing control device operated by a hydraulic pressure in the branch passage and having a lock mechanism configured to hold engine valve timing until the hydraulic pressure in the branch passage becomes greater than or equal to a specified pressure value, the combination of:

a control valve apparatus for adjusting a flow rate of the oil flowing through a portion of the main flow passage downstream of the branched point, the control valve apparatus configured to control the flow rate of the oil flowing through the portion of the main flow passage downstream of the branched point to a large flow-rate side of a variable flow-rate range, until a hydraulic pressure of the oil flowing through the main flow passage becomes greater than or equal to a predetermined pressure value after the engine has been started from its stopped state, and the control valve apparatus further configured to control the flow rate of the oil flowing through the portion of the main flow passage downstream of the branched point to a small flow-rate side of the variable flow-rate range, when the hydraulic pressure of the oil flowing through the main flow passage becomes greater than or equal to the predetermined pressure value after the engine has been started from its stopped state.

According to another aspect of the invention, in a hydraulic system equipped with a main flow passage for feeding oil to each of lubricated engine parts of an internal combustion engine and a branch passage branched from the main flow passage at a branched point for feeding the oil to a hydraulic actuator, the combination of:

a control valve apparatus for adjusting a flow rate of the oil flowing through a portion of the main flow passage downstream of the branched point, the control valve apparatus configured to control the flow rate of the oil flowing through the portion of the main flow passage downstream of the branched point to a large flow-rate side of a variable flow-rate range for a predetermined time delay after the engine has been started from its stopped state, and the control valve apparatus further configured to control the flow rate of the oil flowing through the portion of the main flow passage downstream of the branched point to a small flow-rate side of the variable flow-rate range, immediately when the predetermined time delay has expired.

According to a further aspect of the invention, in a hydraulic system equipped with a main flow passage for feeding oil to each of lubricated engine parts of an internal combustion engine and a branch passage branched from the main flow passage at a branched point for feeding the oil to a hydraulic actuator, the combination of:

a control valve apparatus for adjusting a flow rate of the oil flowing through a portion of the main flow passage downstream of the branched point, the control valve apparatus configured to control the flow rate of the oil flowing through the portion of the main flow passage downstream of the branched point to a large flow-rate side of a variable flow-rate range at least until the oil has been delivered around the entire length of the main flow passage after the engine has been started from its stopped state, and the control valve apparatus further configured to control the flow rate of the oil flowing through the portion of the main flow passage downstream of the branched point to a small flow-rate side of the variable flow-rate range, immediately after the oil has been delivered around the entire length of the main flow passage.

The other objects and features of this invention will become understood from the following description with reference to the accompanying drawings.

DESCRIPTION OF THE PREFERRED EMBODIMENTS

First Embodiment

Figure 1:
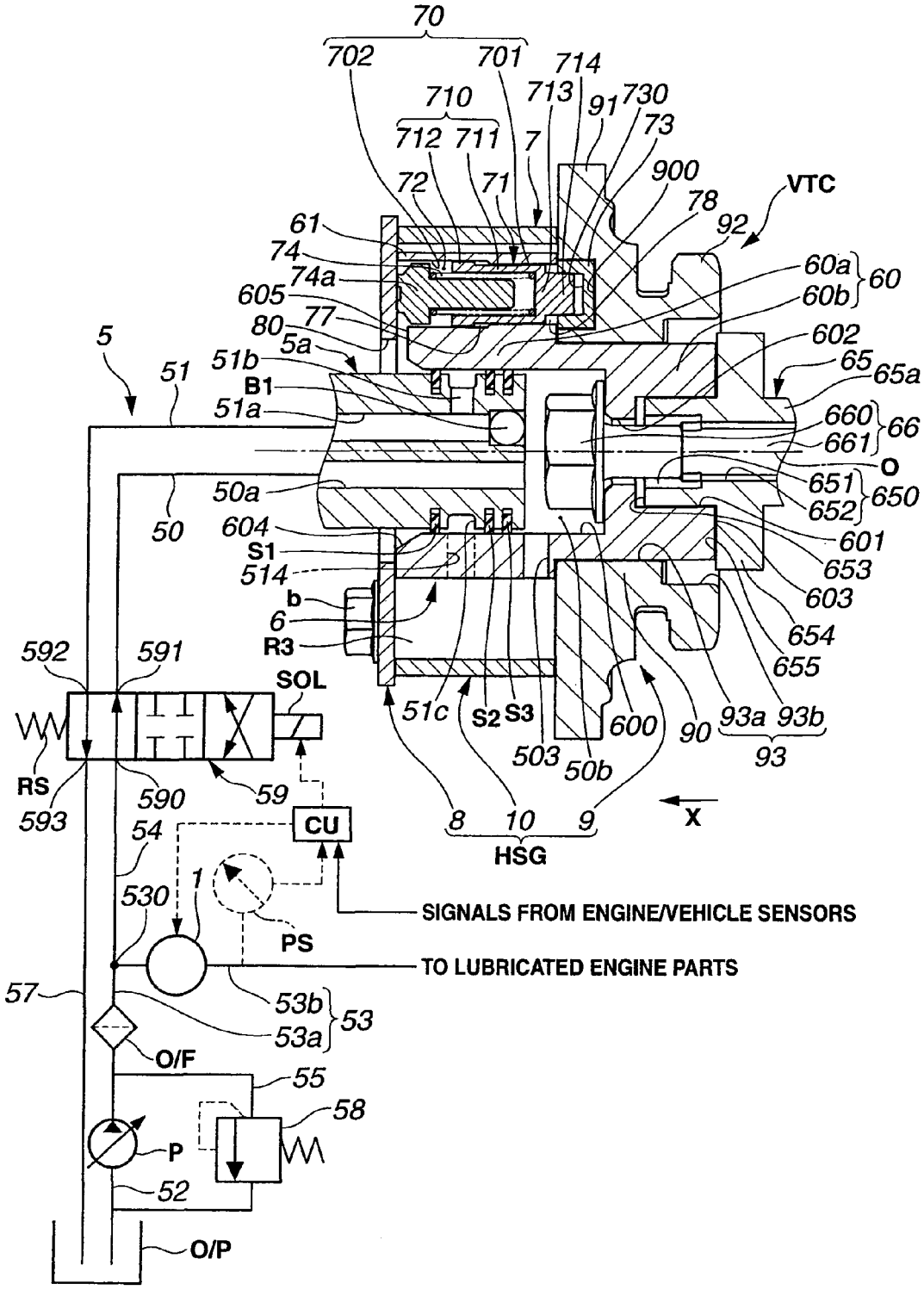
FIG. 1 is a schematic system diagram illustrating a hydraulic system configuration of the first embodiment, including a main fluid-flow passage, a branch passage, a hydraulic actuator such as a variable valve timing control (VTC) device (cross-sectioned along the line I-I of FIG. 2), and a control valve apparatus, and also illustrating a hydraulic system configuration of the second embodiment, in which an oil pressure sensor PS is further added.

Referring now to the drawings, particularly to FIG. 1, a control valve apparatus 1 of the first embodiment can be applied to a hydraulic system of an internal combustion engine of an automotive vehicle.

As can be seen from the hydraulic system configuration of FIG. 1, the hydraulic system is comprised of a hydraulically-operated variable valve timing control (VTC) device for variably controlling engine valve timing (valve open timing and/or valve closure timing), moving engine parts requiring lubrication (hereinafter is referred to as "lubricated engine parts"), and an oil supply-and-exhaust mechanism 5 for supplying and exhausting pressure oil (lubricating/working oil) to and from each of lubricated engine parts and the VTC device. The upper-right cross-section of FIG. 1 shows the partial cross-section taken along the line I-I of FIG. 2, passing through the rotation axis "O" of the VTC device of the intake valve side.

The VTC device is a hydraulically-operated phase-converter that continuously varies a relative angular phase of a camshaft 65 to a crankshaft of the engine, by hydraulic pressure of working oil fed to the VTC device. The VTC device includes a sprocket 91 driven by the crankshaft via a timing chain and configured to be relatively rotatable with respect to the camshaft 65, and a phase-change mechanism installed between sprocket 91 and camshaft 65 to change a relative angular phase of camshaft 65 to sprocket 91 (the crankshaft). The VTC device is a hydraulic actuator, which is hydraulically operated by supplying and exhausting working oil to and from the phase-change mechanism via the oil supply-and-exhaust mechanism 5.

The phase-change mechanism includes a phase-converter housing HSG (a housing member) and a vane member 6 accommodated in the housing HSG. That is, the VTC device is a rotary vane type phase converter configured to change a relative phase between camshaft 65 and sprocket 91 (the crankshaft) by a change in working oil pressure acting on each of vanes 61-64. A plurality of working oil chambers (exactly, phase-advance chambers A1-A4, which are collectively referred to as "phase-advance chamber A", and phase-retard chambers R1-R4, which are collectively referred to as "phase-retard chamber R",) are defined by vanes 61-64 and housing HSG. A change in working oil pressure, acting on each of the vanes, takes place by the oil supply or oil exhaust to or from the working oil chambers. As a result, vane member 6 (the camshaft side) is relatively rotated with respect to housing HSG (the crankshaft side) by a given angle. Under this condition, torque transmission between them is made. In this manner, a phase of rotation of camshaft 65 to a phase of rotation of the crankshaft can be changed.

Oil supply-and-exhaust mechanism 5 is configured to hydraulically operate the VTC device by adjusting the working oil supply-and-exhaust to and from the phase-change mechanism. That is, a volume change in each of the plurality of working oil chambers occurs by selectively supplying working oil to either phase-advance chambers A1-A4 or phase-retard chambers R1-R4 or by selectively exhausting working oil from either phase-advance chambers A1-A4 or phase-retard chambers R1-R4 by means of oil supply-and-exhaust mechanism 5, with the result that vane member 6 can be relatively rotated with respect to housing HSG by a predetermined angle in a normal-directional direction or in a reverse-rotational direction. The working oil supply and exhaust, achieved through the oil supply-and-exhaust mechanism 5, is controlled by control means (concretely, a central processing unit) incorporated in an electronic control unit CU (hereinafter referred to as "controller").

Oil supply-and-exhaust mechanism 5 includes an oil pump P (serving as a hydraulic pressure source), fluid-flow passages (oil passages) and various valves.

Oil pump P (hereinafter referred to as "pump") is driven by the engine crankshaft, for discharging engine oil (hereinafter referred to as "oil"). For instance, a variable displacement single-direction vane pump that allows for only one direction of pump rotation, can be used as the pump P.

As the oil passages, oil supply-and-exhaust mechanism 5 includes an inlet passage 52, a supply passage 53 for feeding oil to each of lubricated engine parts, a supply passage 54 for feeding oil to the VTC device, and an exhaust passage 57 for exhausting (draining) oil from the VTC device.

As the various valves, oil supply-and-exhaust mechanism 5 includes the control valve apparatus 1, a pressure relief valve 58, and a directional control valve 59. Inlet passage 52 is configured to interconnect an inlet of pump P and an oil pan O/P detachably installed as a lower part of an engine block EB. Supply passage 53 is configured to interconnect an outlet of pump P and each of lubricated engine parts.

Pump P draws oil from the oil pan O/P via the inlet passage 52 during operation (during rotation), and then discharges (feeds) a pressurized high-pressure oil to the supply passage 53. That is, pump P is provided to force-feed oil in the oil pan O/P to the supply passage 53.

Assume that, regarding an oil flow line, the side of pump P, which supplies oil, is called "upstream side", and the opposite side, to which oil is supplied, is called "downstream side".

Supply line 53 is a main fluid-flow passage to which oil discharged from pump P is introduced and which is configured to feed the oil to each of lubricated engine parts.

An oil filter O/F is disposed in the supply passage 53 to remove any impurities from the oil discharged from pump P.

One end of a bypass passage 55 is connected to a midpoint of the portion of supply passage 53 between oil filter O/F and pump P, whereas the other end of bypass passage 55 is connected to the inlet passage 52. Relief valve 58 is disposed in the bypass passage 55. Relief valve 58 is a normally-closed valve, which is automatically opened when a pressure of the oil, discharged from pump P into supply passage 53, exceeds a specified limit (a set pressure of relief valve 58), to relieve the oil from the supply passage 53 back to the oil pan O/P, thereby preventing the pressure in supply passage 53 (the internal pressure of the hydraulic system) from increasing beyond the specified value.

Supply passage 54 for oil supply to the VTC device is branched from a branched point 530 of supply passage 53 at the downstream side of oil filter O/F. In other words, supply passage 53, extending from pump P, is branched into an oil supply line for lubricating-oil supply to each of lubricated engine parts and an oil supply line (i.e., supply passage 54) for working/lubricating oil supply to the VTC device.

Control valve apparatus 1 is disposed in the supply passage 53 downstream of the branched point 530. The portion of supply passage 53, extending from control valve apparatus 1 toward the upstream side, is hereinafter represented as "supply passage 53*a*", whereas the portion of supply passage 53, extending from control valve apparatus 1 toward the downstream side, is hereinafter represented as "supply passage 53*b*".

The upstream supply passage 53*a* communicates the outlet of pump P. That is, the upstream supply passage 53*a* serves as a pump-flow introductory portion.

The downstream supply passage 53*b* is connected to the upstream supply passage 53*a* and also connected to a main oil gallery formed in the engine. That is, the downstream supply passage 53*b* serves as a lubricating oil passage for feeding the oil in the upstream supply passage 53*a* to each of lubricated engine parts.

Control valve apparatus 1 is provided to adjust or control a flow rate of oil flowing through the supply passage 53 downstream of the branched point 530, in other words, a flow rate of oil flowing through the downstream supply passage 53*b*.

Supply passage 54 is a branch passage, which is branched from the supply passage 53*a* for feeding the oil in supply passage 53*a* to the VTC device.

The downstream end of supply passage 54 for oil supply to the VTC device is connected to the directional control valve 59. Directional control valve 59 is connected to the VTC device through a dual hydraulic-circuit system, namely, a phase-retard passage 50 provided for working/lubricating oil supply-and-exhaust to and from each of phase-retard chambers R1-R4, and a phase-advance passage 51 provided for working/lubricating oil supply-and-exhaust to and from each of phase-advance chambers A1-A4. Additionally, an oil-exhaust passage (simply, a drain passage) 57 is connected to the directional control valve 59. The downstream end of drain passage 57 communicates the oil pan O/P.

Directional control valve 59 is a direct-operated electromagnetic solenoid valve (a four-port three-position spring-offset directional control valve) that is configured to control switching between fluid-communication of supply passage 54 and phase-retard passage 50 and fluid-communication of supply passage 54 and phase-advance passage 51, and simultaneously to control switching between fluid-communication of exhaust passage 57 and phase-advance passage 51 and fluid-communication of exhaust passage 57 and phase-retard passage 50.

Directional control valve 59 is comprised of a valve body fixedly connected to a cylinder head of the engine, a solenoid SOL fixedly installed on the valve body, and a spool (a valve element) slidably accommodated in the valve body. The valve body has four ports formed therein, that is, a supply port 590 communicating the supply passage 54, a first port 591 communicating the phase-retard passage 50, a second port 592 communicating the phase-advance passage 51, and an exhaust port 593 communicating the exhaust passage 57.

Solenoid SOL functions to shift (move) the spool, when the electromagnetic coil of solenoid SOL is energized. The electromagnetic coil of solenoid SOL is connected to controller CU via a harness. Depending on the axial position of the spool of directional control valve 59, each of first and second ports 591 and 592 is opened or closed.

Under a de-energized state of solenoid SOL, by the spring force of a return spring RS, the spool is forced (biased) to its original position (a spring offset position) at which fluid-communication between supply port 590 (supply passage 54) and first port 591 (phase-retard passage 50) is established and fluid-communication between second port 592 (phase-advance passage 51) and exhaust port 593 (exhaust passage 57) is established. Conversely under an energized state of solenoid SOL, responsively to a control current from controller CU, the spool can be moved against the spring force of return spring RS apart from the spring-offset position, and then held at its fully-energized position at which fluid-communication between supply port 590 (supply passage 54) and second port 592 (phase-advance passage 51) is established and fluid-communication between first port 591 (phase-retard passage 50) and exhaust port 593 (exhaust passage 57) is established, or held at a given intermediate position within its entire stroke range. With the spool held at the given intermediate position, first and second ports 591 and 592 are both closed.

Controller CU (the electronic control unit) generally comprises a microcomputer. Controller CU includes an input/output interface (I/O), memories (RAM, ROM), and a microprocessor or a central processing unit (CPU). The input/output interface (I/O) of controller CU receives input information from various engine/vehicle sensors, namely, a crank angle sensor (a crankshaft position sensor), an airflow meter (an airflow sensor), a throttle opening sensor (a throttle position sensor), and an engine temperature sensor (such as an engine coolant temperature sensor). The crank angle sensor is provided for detecting engine speed, and the airflow meter is provided for detecting a quantity of intake air. Within controller CU, the central processing unit (CPU) allows the access by the I/O interface of input informational data signals from the previously-discussed engine/vehicle sensors. For instance, on the basis of sensor signals from the engine/vehicle sensors, the more recent engine operating condition can be detected.

Controller CU is also configured to output a pulse control current, which is determined depending on the detected engine operating condition, to the solenoid SOL of directional control valve 59, to change the path of flow through the directional control valve (in other words, to carry out flow-path switching control among fluid-flow passages 50, 51, 54, and 57), thus enabling oil to be selectively supplied to either phase-advance chambers A1-A4 or phase-retard chambers R1-R4 or enabling oil to be selectively exhausted from either phase-advance chambers A1-A4 or phase-retard chambers R1-R4. In this manner, a working pressure for the VTC device can be controlled.

Controller CU is further configured to output a control current, which is determined depending on the detected engine operating condition, to a solenoid 34 of a pilot valve 3 (described later) of control valve apparatus 1, to carry out switching control (fluid-flow restricting control) between fluid-flow passages 53 and 54, thus enabling more improved fine control of flow for a flow rate of oil, which is fed to each of lubricated engine parts and/or the VTC device.

The construction of the VTC device incorporated in the hydraulic system of the first embodiment is hereinafter described in reference to FIGS. 1-3. In the shown embodiment, the VTC device is installed on the intake valve side.

Assuming that the direction of the rotation axis "O" of the VTC device, that is, the direction of the rotation axis of the intake-port camshaft (camshaft 65) is taken as an "X-axis", a direction of the "X-axis", directed from the camshaft to the side of installation of the VTC device on the camshaft end, is a positive X-axis direction, whereas the opposite direction of "X-axis" is a negative X-axis direction.

In the shown embodiment, control valve apparatus 1 can be used for oil-flow control for working oil to be fed to the intake-valve side VTC device. Control valve apparatus 1 may be used for oil-flow control for working oil to be fed to the exhaust-valve side VTC device.

Also, in the shown embodiment, although control valve apparatus 1 is applied to the variable valve timing control (VTC) device serving as a hydraulic actuator, it will be appreciated that control valve apparatus 1 may be applied to a hydraulic system with a hydraulic actuator of another type that requires a working pressure above a predetermined pressure level even in an engine-startup- and very-low-speed range. For instance, control valve apparatus 1 may be applied to a hydraulic system with another type of hydraulically-operated variable valve operating device, such as a variable valve lift (VVL) system or a continuously variable valve event and lift control (VEL) system, or to a hydraulic system with a floating-bearing lubrication system (e.g., a turbine-bearing lubrication system of a turbocharger).

Figure 2:
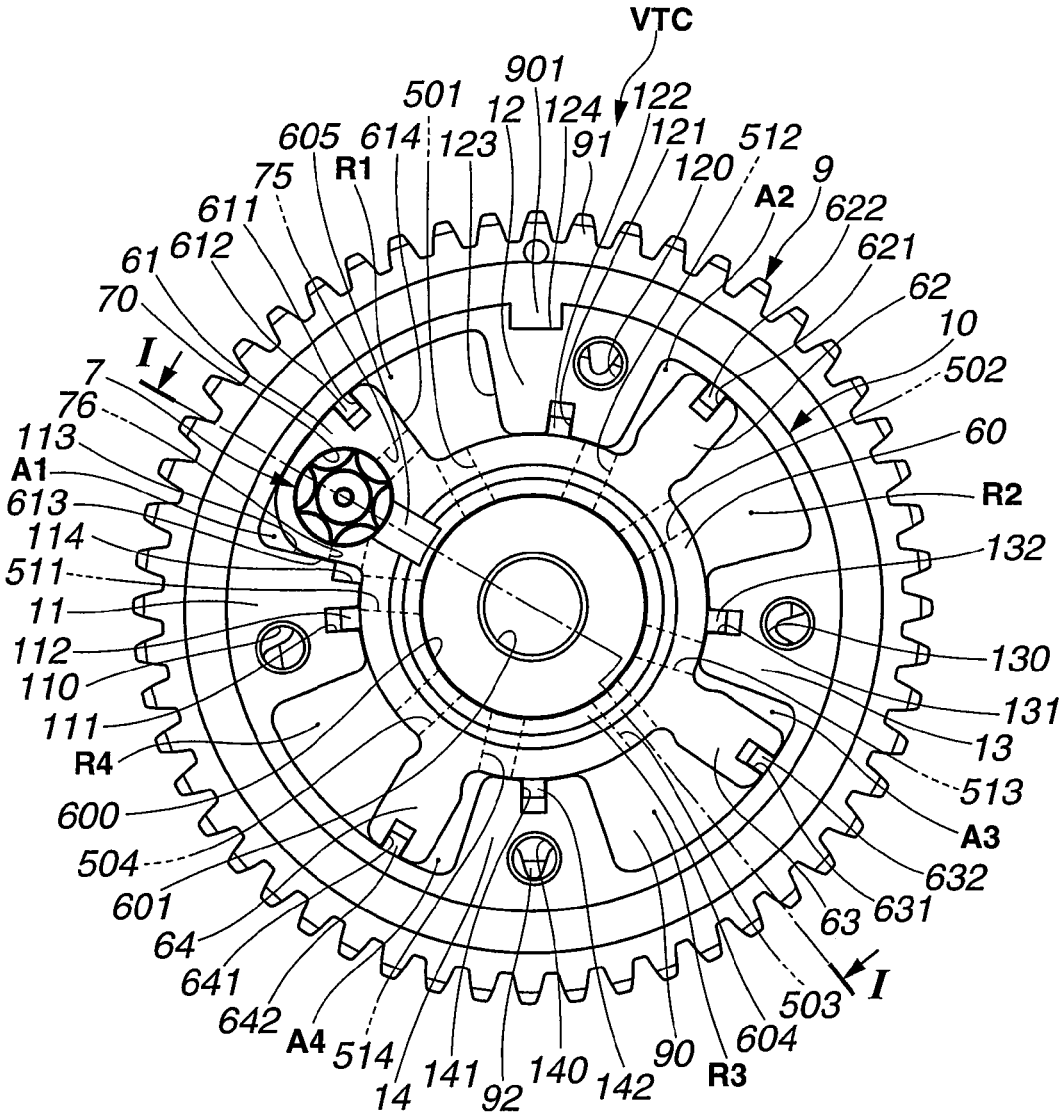
FIG. 2 is a front elevation view illustrating the VTC device incorporated in the hydraulic system of the first embodiment and kept at its maximum phase-retard position.
Figure 3:
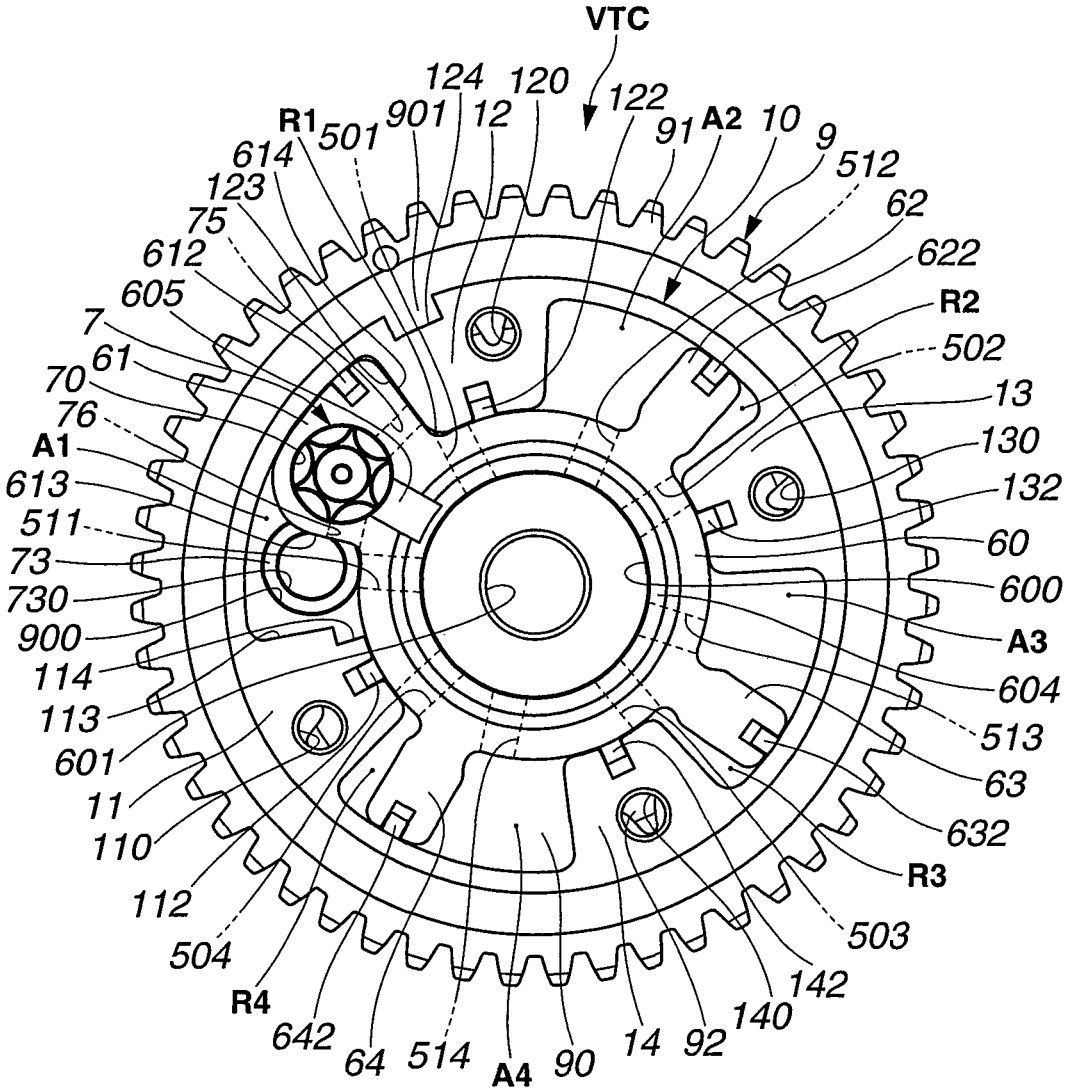
FIG. 3 is a front elevation view illustrating the VTC device incorporated in the hydraulic system of the first embodiment and kept at its maximum phase-advance position.

FIGS. 2-3 are front elevation views (as viewed from the positive X-axis direction) illustrating the internal construction of the VTC device incorporated in the hydraulic system of the first embodiment, but with a front plate 8 removed. In other words, each of FIGS. 2-3 is a partially-assembled view that a housing body 10 of housing HSG and vane member 6 are assembled and installed on a rear plate 9 of housing HSG. In FIGS. 1 to 3, oil passages formed in the vane member 6, are indicated by the broken line.

Camshaft 65 is rotatably supported or installed on the upper portion of the cylinder head by means of camshaft bearings. Camshaft 65 has a series of drive cams (inlet cams), which cams are configured to be conformable to respective positions of intake valves. By rotary motion of camshaft 65, a valve lifter (or a rocker arm) is moved up and down by cam action of the associated inlet cam so that the intake valve is opened and closed. The VTC device is installed on the axial end 65*a* of camshaft 65, facing in the positive X-axis direction, by means of one cam bolt 66. Cam bolt 66 is a hexagon head bolt comprised of a head 660 and a shank 661 consisting of an unthreaded shank portion and a male-screw-threaded portion.

Camshaft end 65*a* is formed therein with a bolt hole 650 into which the male-screw-threaded portion of shank 661 of cam bolt 66 is screwed. Bolt hole 650 is formed to axially extend from the end face 653 of camshaft end 65*a*, facing in the positive X-axis direction, to a predetermined depth in the negative X-axis direction. Bolt hole 650 is constructed by a large-diameter cylindrical bore portion 651 and a small-diameter cylindrical bore portion 652, both bored in the camshaft end 65*a* in that order from the end face 653. The inner periphery of small-diameter cylindrical bore portion 652 is formed with a female-screw-threaded portion into which the male-screw-threaded portion of shank 661 of cam bolt 66 is screwed.

Camshaft end 65*a* has a disk-shaped flanged portion 654 formed at a specified position corresponding to an axial distance measured from the end face 653 in the negative X-axis direction.

The VTC device (the VTC unit) includes the housing HSG, vane member 6, and an oil-passage structural member 5*a*.

Housing HSG is laid out at the camshaft end 65*a*. Housing HSG has a timing sprocket 91 (a first sprocket described later) formed integral therewith. Sprocket 91 has a driven connection with the crankshaft so that torque is transmitted from the crankshaft to the timing sprocket.

Vane member 6 is fixedly connected to the camshaft end 65*a* by means of cam bolt 66 from the positive X-axis direction. Vane member 6 is accommodated in the housing HSG, so that relative rotation of vane member 6 to housing HSG is permitted.

Oil-passage structural member 5*a* is a substantially cylindrical block in which a portion of phase-retard passage 50 and a portion of phase-advance passage 51 are formed.

Housing HSG includes front plate 8, rear plate 9, and housing body 10.

Housing body 10 is formed as a cylindrical hollow housing member, opened at both ends in the opposite X-axis directions. Housing body 10 is made of sintered alloy materials, such as iron-based sintered alloy materials. The housing member (e.g., housing body 10 and the like) may be made of another metal materials such as aluminum alloy materials, and also shaped and formed by another shaping methods, such as machining rather than sintering. In the shown embodiment, although housing body 10 is formed into a cylindrical hollow shape, opened at both ends in the opposite X-axis directions, it will be understood that housing body 10 may be formed as a cylindrical housing member having a cylindrical bore closed at one axial end.

Housing body 10 is integrally formed on its inner periphery with a plurality of radially-inward protruded shoes 11, 12, 13, and 14. Concretely, the four shoes 11-14 are spaced from each other by approximately 90 degrees in the direction around the rotation axis "O" (that is, in the circumferential direction). As seen in FIG. 2, each of shoes 11-14 is formed as a radially-inward protruded partition wall portion extending in the X-axis direction of housing HSG. The first shoe 11, the second shoe 12, the third shoe 13, and the fourth shoe 14 are located in that order in the clockwise direction in FIG. 2. Each of shoes 11-14 has a substantially trapezoidal shape in lateral cross section, taken in the direction perpendicular to the X-axis direction, and tapered radially inwards.

As viewed in the X-axis direction, both side faces of each of shoes 11-14, facing in the circumferential direction, are formed as substantially flat surfaces configured to be conformable to straight lines extending radially (i.e., in the radial direction of housing body 10) outwards from the rotation axis "O". As viewed from the positive X-axis direction, each of the innermost ends of the radially-inward protruded shoes 11-14, opposing to the rotation axis "O", are formed as somewhat concave circular-arc end faces, which are configured to be substantially conformable to the shape of the outer periphery of a vane rotor 60 (described later) of vane member 6.

As seen in FIG. 2, shoes 11-14 are formed substantially at their centers in trapezoidal lateral cross section with respective bolt insertion holes 110, 120, 130, and 140 (through holes extending in the X-axis direction) into which bolts b are inserted.

Front plate 8 is fixedly installed on the left-hand axial end faces (viewing FIG. 1) of shoes 11-14, facing in the positive X-axis direction, whereas rear plate 9 is fixedly installed on the right-hand axial end faces of shoes 11-14, facing in the negative X-axis direction.

An internal space, which is defined between the two adjacent first and second shoes 11-12 and in which a maximum-circumferential-width vane blade (described later) is accommodated, is dimensioned to be somewhat wider than the other vane-blade accommodation space.

The circumferential width of the second shoe 12 is dimensioned to be slightly greater than that of each of first, third, and fourth shoes 11, 13, and 14.

As seen in FIG. 2, the innermost ends of shoes 11-14 have respective axially-elongated seal retaining grooves 111, 121, 131, and 141, formed substantially in their centers in the circumferential direction and extending in the X-axis direction. Four seal retaining grooves 111, 121, 131, and 141 are formed into a substantially rectangle, as viewed in the X-axis direction. Each of seal retaining grooves 111, 121, 131, and 141 is formed over the entire axial length of the associated shoe.

Four oil seal members 112, 122, 132, and 142, each having a substantially square lateral cross section, are fitted into respective seal retaining grooves 111, 121, 131, and 141. Additionally, four seal springs, concretely, four leaf springs (not shown), are retained in respective seal retaining grooves 111, 121, 131, and 141, in a manner so as to force four seal members 112, 122, 132, and 142 into abutment (sliding-contact) with the outer peripheral surface of vane rotor 60 over the entire axial length in the X-axis direction. During relative rotation of vane rotor 60 to housing HSG, four seal members 112, 122, 132, and 142 are kept in sliding-contact with the outer peripheral surface of vane rotor 60 by the spring forces of the seal springs.

As viewed from the positive X-axis direction, a substantially rectangular cut-out portion 114 is formed in the innermost end of the side face 113 of the first shoe 11, facing in the clockwise direction, in such a manner as to extend over the entire axial length of the first shoe 11.

Front plate 8 is a housing member that hermetically closes the opening end of housing body 10, facing in the positive X-axis direction, in other words, the leftmost ends (viewing FIG. 1) of phase-advance chamber A and phase-retard chamber R, facing in the positive X-axis direction. Front plate 8 is formed into a substantially disk shape by press-working steel materials. The outside diameter of front plate 8 is dimensioned to be slightly greater than that of the housing body 10. Front plate 8 has a centrally-bored, large-diameter bolt insertion hole (an axial through hole) 80 into which cam bolt 66 and oil-passage structural member 5*a* are both inserted during assembling of the VTC device. The inside diameter of bolt insertion hole 80 is dimensioned to be greater than the outside diameter of oil-passage structural member 5*a*. Additionally, front plate 8 is formed with circumferentially equidistant-spaced, four bolt holes (through holes extending in the X-axis direction), which are configured to be opposed to respective bolt insertion holes 110, 120, 130, and 140 of housing body 10 in the X-axis direction.

Rear plate 9 is a housing member that hermetically closes the opening end of housing body 10, facing in the negative X-axis direction, in other words, the rightmost ends (viewing FIG. 1) of phase-advance chamber A and phase-retard chamber R, facing in the negative X-axis direction, while permitting a rotor shaft portion 60*b* (described later) of vane rotor 60 to be inserted through the central bore of rear plate 9.

Rear plate 9 is made of sintered alloy materials, such as iron-based sintered alloy materials. Rear plate 9 includes a plate body 90, and first and second sprockets 91 and 92.

Plate body 90 includes a disk-shaped portion (on the side of the positive X-axis direction) and a cylindrical portion (on the side of the negative X-axis direction). Plate body 90 is formed at its center with a central stepped bore 93 arranged coaxially with the rotation axis "O". Stepped bore 93 serves as a rotor supporting bore into which the rotor shaft 60*b* of vane rotor 60 (vane member 6) is inserted so that rotor shaft 60*b* is rotatably supported. Concretely, stepped bore 93 is comprised of a main supporting portion (a bearing bore portion) 93*a* and a rightmost opening end portion 93*b* (the rightmost end of the negative X-axis direction of stepped bore 93, viewing FIG. 1) whose inside diameter is dimensioned to be greater than that of the main supporting portion 93*a*.

The main supporting portion 93*a* is formed as a cylindrical portion, which opens from the leftmost end face (viewing FIG. 1) of rear plate 9. The inside diameter of main supporting portion 93*a* is dimensioned to be slightly greater than the outside diameter of rotor shaft 60*b*.

The rightmost opening end portion 93*b* opens from the rightmost end face of rear plate 9. The rightmost opening end portion 93*b* is formed as a somewhat large-diameter cylindrical portion, as compared to the main supporting portion 93*a*. The inside diameter of rightmost opening end portion 93*b* is dimensioned to be greater than the outside diameter of the flanged portion 654 of camshaft 65, such that a portion of the flanged portion 654 can be inserted into the rightmost opening end portion 93*b* in the X-axis direction.

The outside diameter of the disk-shaped portion of plate body 90 (on the side of the positive X-axis direction) is dimensioned to be slightly greater than that of housing body 10. The disk-shaped portion of plate body 90 is integrally formed on its outer periphery with the first sprocket 91. Plate body 90 of rear plate 9 is formed with circumferentially equidistant-spaced, four bolt holes (female screw-threaded portions formed in the X-axis direction), which are configured to be opposed to respective bolt insertion holes 110, 120, 130, and 140 of housing body 10 in the X-axis direction.

Front plate 8, housing body 10, and rear plate 9 are integrally connected to each other by tightening four bolts b from the X-axis direction. In more detail, each of four bolts b is inserted into the associated bolt hole of front plate 8 and also inserted into the associated bolt insertion hole of housing body 10 from the positive X-axis direction, and then screwed into the associated female-screw-threaded portion of rear plate 9. In this manner, front plate 8 and rear plate 9 are fixedly connected to housing body 10. The inside diameter of each of the bolt holes of front plate 8 and the inside diameter of each of the bolt insertion holes of housing body 10 are dimensioned to be slightly greater than the outside diameter of the unthreaded shank of each of bolts b.

The outside diameter of the cylindrical portion of plate body 90 (on the side of the negative X-axis direction) is dimensioned to be less than that of the disk-shaped portion of plate body 90 (on the side of the positive X-axis direction). The cylindrical portion of plate body 90 is integrally formed on its outer periphery with the second sprocket 92.

The outer periphery of first sprocket 91 is formed integral with a toothed portion in meshed-engagement with a first timing chain. In a similar manner, the outer periphery of second sprocket 92 is formed integral with a toothed portion in meshed-engagement with a second timing chain. The outside diameter (in other words, the number of teeth) of first sprocket 91 is dimensioned to be greater than that of second sprocket 92.

First sprocket 91 is driven clockwise (viewing FIG. 2) by the crankshaft via the first chain, so that rear plate 9 (housing HSG), integrally formed with first sprocket 91, is rotated in the same rotation direction (i.e., clockwise). Second sprocket 92, together with rear plate 9, is rotated clockwise, so that an exhaust-valve side VTC device is driven via the second chain.

In the shown embodiment, each of sprockets 91-92 is integrally formed with the rear plate 9. In lieu thereof, each of sprockets 91-92 may be integrally connected to the rear plate 9. Instead of using the sprocket-and-chain mechanism, a timing-pulley-and-belt mechanism may be used for power transmission (torque transmission).

In the shown embodiment, in order to drive a housing of the exhaust-valve side VTC device, torque is transmitted from the crankshaft via the second chain as well as the housing (the second sprocket) of the intake-valve side VTC device to the housing of the exhaust-valve side VTC device. Instead of using the second sprocket-and-chain mechanism, torque may be transmitted from the crankshaft to both housings of the intake-valve side VTC device and the exhaust-valve side VTC device via a single chain common to these VTC devices.

As viewed from the positive X-axis direction, in particular, as best seen in FIG. 3, a cylindrical bore 900, which is closed at one axial end and has a predetermined depth in the X-axis direction, is formed at a position of plate body 90 adjacent to the side face of the first shoe 11, facing clockwise. An engaging-hole (a lock-hole) structural member (described later) is fitted into cylindrical bore 900.

Vane member 6 serves as a driven rotational member that is rotatable relative to the first sprocket 91 (housing HSG). That is, vane member 6, together with camshaft 65, rotates clockwise (viewing FIG. 2). Vane member 6 is comprised of four radially-extending vane blades 61-64 that receive working oil pressure, and vane rotor 60. Vane rotor 60 has an axially-extending central bore 602 (described later) into which cam bolt (vane mounting bolt) 66 is inserted for bolting vane rotor 60 to the camshaft end 65*a* by axially tightening the cam bolt. The axis of vane rotor 60 is coaxially aligned with the axis of camshaft 65.

Rotor 60 is formed into a substantially cylindrical shape, and comprised of a rotor body 60*a* and a rotor shaft 60*b* both coaxially aligned with each other. Rotor body 60*a* and four vane blades 61-64 are integrally formed with each other. Rotor shaft 60*b* is integrally formed with the rotor body 60*a* in such a manner as to extend from the rotor body 60*a* in the negative X-axis direction.

The outside diameter of rotor body 60*a* is dimensioned to be slightly greater than the inside diameter of main supporting portion 93*a* of stepped bore 93 of rear plate 9 and the inside diameter of bolt insertion hole 80 of front plate 8. The outside diameter of rotor shaft 60*b* is dimensioned to be slightly less than the inside diameter of main supporting portion 93*a* of stepped bore 93 of rear plate 9.

Rotor 60 has a substantially cylindrical bore 600, extending coaxially with the rotation axis "O", and opening in the positive X-axis direction and closed at the opposite side. The entire axial length of cylindrical bore 600 is dimensioned to reach a predetermined depth of rotor shaft 60*b* in the negative X-axis direction. Cylindrical bore 600 is an oil-path configuration bore into which oil-passage structural member 5*a* of the VTC device is inserted and installed. The inside diameter of cylindrical bore 600 is dimensioned to be slightly greater than the outside diameter of oil-passage structural member 5*a*. The left-hand side opening end (viewing FIG. 1) of cylindrical bore 600 is machined as a tapered portion (a beveled or chamfered portion) 604, such that the inside diameter of the opening end of cylindrical bore 600 gradually increases in the positive X-axis direction.

Also, rotor 60 has a substantially cylindrical bore 601, extending coaxially with the rotation axis "O", and opening in the negative X-axis direction and closed at the opposite side. The entire axial length of cylindrical bore 601 is dimensioned to reach a predetermined depth of rotor shaft 60*b* in the positive X-axis direction. Cylindrical bore 601 is a camshaft insertion bore into which camshaft end 65*a* is inserted and installed. The inside diameter of cylindrical bore 601 is dimensioned to be slightly greater than the outside diameter of camshaft end 65*a*. The axial length of cylindrical bore 601 is dimensioned to be slightly greater than the distance from the end face 655 of camshaft flanged portion 654, facing in the positive X-axis direction, to the end face 653 of camshaft end 65*a*, facing in the positive X-axis direction. Central bore 602 (a through hole through the rotation axis "O") is formed in the partition wall through which cylindrical bores 600-601 are divided. Central bore 602 serves as a cam-bolt insertion hole into which cam bolt 66 is inserted.

The head 660 of cam bolt 66 is positioned in cylindrical bore 600, whereas the shank 661 of cam bolt 66 is inserted through central bore 602 into the bolt hole 650 of camshaft 65. Then, the male-screw-threaded portion of shank 661 of cam bolt 66 is screwed into the female-screw-threaded portion of cylindrical bore portion 652 of bolt hole 650. In this manner, rotor 60 is integrally connected to the camshaft end 65*a* by tightening the cam bolt 66. At this time, the end face 603 of rotor 60, facing in the negative X-axis direction, is brought into abutted-engagement with the end face 655 of camshaft flanged portion 654, facing in the positive X-axis direction.

Rotor 60 is rotatably supported on the housing HSG, while being kept in sliding-contact with each of oil seal members 112, 122, 132, and 142, which are fitted into respective seal retaining grooves 111, 121, 131, and 141 of the innermost ends of four shoes 11-14.

Rotor 60 has radially-outward protruded, circumferentially-equidistant spaced four vane blades 61-64 formed on its outer periphery. The first vane blade 61, the second vane blade 62, the third vane blade 63, and the fourth vane blade 64 are located in that order in the clockwise direction in FIG. 2.

With vane member 6 installed in the housing HSG, the first blade 61 is located in the space defined between first and second shoes 11-12, the second blade 62 is located in the space defined between second and third shoes 12-13, the third blade 63 is located in the space defined between third and fourth shoes 13-14, and the fourth blade 64 is located in the space defined between fourth and first shoes 14 and 11.

Four blades 61-64 are formed integral with rotor body 60*a*. The axial length of each of blades 61-64, measured in the X-axis direction, is dimensioned to be approximately equal to that of rotor body 60*a*. With vane member 6 installed in the housing HSG, the axial end face of each of blades 61-64, facing in the positive X-axis direction, and the axial end face of front plate 8, facing in the negative X-axis direction, are opposed to each other by a very small clearance space. In a similar manner, the axial end face of each of blades 61-64, facing in the negative X-axis direction, and the axial end face of rear plate 9 (plate body 9*a*), facing in the positive X-axis direction, are opposed to each other by a very small clearance space.

As best seen in FIG. 2, in the hydraulically-operated four-blade vane member equipped VTC device, the areas of the outside circumferences of four blades 61-64 of the four-blade vane member 6, in other words, the circumferential widths of four blades 61-64 are dimensioned to be somewhat different from each other. Four blades 61-64 are classified into two sorts, namely a maximum-width blade (that is, the first blade 61) and the remaining narrow-width blades 62-64. The remaining narrow-width blades 62-64 have almost the same circumferential width and the same radial length. Three narrow-width blades 62-64 are configured to be substantially rectangular in lateral cross section. As viewed in the X-axis direction, rounded corners of both side faces of the root of each of narrow-width vane blades 62-64 are further recessed.

The first blade 61 is formed as a maximum-width blade whose circumferential width is dimensioned to be greater than that of each of three narrow-width blades 62-64, so as to be able to accommodate a lock mechanism (described later) in the first blade 61. The first blade 61 is configured to have an inverted trapezoidal shape in lateral cross section. As viewed in the X-axis direction, one side face 613 of the first blade 61, facing in the anticlockwise direction, and the other side face 614 of the first blade 61, facing in the clockwise direction, are formed as substantially flat surfaces configured to be conformable to straight lines extending radially outwards from the rotation axis "O".

Four blades 61-64 have respective axially-elongated seal retaining grooves 611, 621, 631, and 641, formed in their outermost ends (apexes) and extending in the X-axis direction. Each of four seal retaining grooves 611, 621, 631, and 641 is formed into a substantially rectangle, as viewed in the X-axis direction. Four oil seal members (four apex seals) 612, 622, 632, and 642, each having a substantially square lateral cross section, are fitted into respective seal retaining grooves 611, 621, 631, and 641. Additionally, four seal springs, concretely, four leaf springs (not shown), are retained in respective seal retaining grooves 611, 621, 631, and 641, in a manner so as to force four seal members 612, 622, 632, and 642 into abutment (sliding-contact) with the inner peripheral surface of housing body 10 over the entire axial length in the X-axis direction. During relative rotation of vane rotor 60 (vane member 6) to housing HSG, four seal members 612, 622, 632, and 642 are kept in sliding-contact with the inner peripheral surface of housing body 10 by the spring forces of the seal springs.

As seen in FIG. 2, the first blade 61 has a cylindrical bore 70 formed as a through hole extending in the X-axis direction. The bore 70 serves as a lock-piston sliding-motion permitting bore (simply, a lock-piston bore) in which a retractable lock piston (described later) of a lock mechanism 7 is slidably installed. Lock-piston bore 70 is comprised of a small-diameter chamber 701 formed on the side of the negative X-axis direction and a large-diameter chamber 702 formed on the side of the positive X-axis direction.

As viewed from the positive X-axis direction, lock-piston bore 70 is formed in the first blade 61 in such a manner as to be slightly offset anticlockwise from the center of the side faces of the first blade 61. The anticlockwise edge of the outermost end of the first blade 61 is formed as a rounded edge having a circular-arc curved surface, whose center is identical to the center of lock-piston bore 70, and which has a radius of curvature greater than the radius of lock-piston bore 70 and is configured to be curved along the circumference of lock-piston bore 70 over a specified angular range that the angle between the line segment interconnecting the beginning-of-arc and the center and the line segment interconnecting the end-of-arc and the center is 90 degrees or more. The circular-arc curved surface of the rounded edge is formed to be continuous with the side face 613 of the first blade 61. On the other hand, the clockwise edge of the outermost end of the first blade 61 is formed with the seal retaining groove 611 between the lock-piston bore 70 and the side face 614 of the first blade 61.

A radial groove 605 is formed in the axial end face of the first blade 61, facing in the positive X-axis direction. Radial groove 605 has a predetermined depth in the X-axis direction. Radial groove 605 is a radially-extending rectangular cut-out groove interconnecting the opening end of the positive X-axis direction of lock-piston bore 70 and the opening end of the positive X-axis direction of cylindrical bore 600 of rotor 60.

Vane member 6 cooperates with housing HSG to define phase-advance chambers A1-A4 and phase-retard chambers R1-R4. As viewed in the X-axis direction, four oil chambers are defined by four pairs of two adjacent shoes (11, 12; 12, 13; 13, 14; 14, 11). Each of the four oil chambers is divided into phase-advance chamber A and phase-retard chamber R by the blade disposed between the two adjacent shoes. Phase-advance chamber A and phase-retard chamber R are partitioned from each other in a fluid-tight fashion with a less oil leakage by means of oil seal members 112, 122, 132, and 142. In other words, blades 61-64 cooperate with shoes 11-14 to define the working oil chambers (phase-advance chambers A1-A4 and phase-retard chambers R1-R4). Working oil is supplied from the pump P selectively to either phase-advance chambers A1-A4 or phase-retard chambers R1-R4.

More concretely, four groups of working oil chambers (that is, four phase-advance chambers A1-A4 and four phase-retard chambers R1-R4) are defined by the inside face of front plate 8, facing in the negative X-axis direction, the inside face of rear plate 9, facing in the positive X-axis direction, both side faces of each of blades 61-64, facing in the circumferential direction, and both side faces of each of shoes 11-14. For instance, the first phase-advance chamber A1 is defined between the side face 113 of the first shoe 11, facing in the clockwise direction, and the side face 613 of the first blade 61, facing in the anticlockwise direction, whereas the first phase-retard chamber R1 is defined between the side face 614 of the first blade 61, facing in the clockwise direction, and the side face 123 of the second shoe 12, facing in the anticlockwise direction.

As previously discussed, in the shown embodiment, both phase-advance chamber A and phase-retard chamber R function as working oil chambers of the hydraulic actuator (the VTC device). In lieu thereof, the hydraulic actuator (the VTC device) may be configured so that either phase-advance chamber A or phase-retard chamber R functions as a working oil chamber.

In the shown embodiment, the number of phase-advance chambers A1-A4 is "4" and the number of phase-retard chambers R1-R4 is "4". It will be understood that the number of phase-advance chambers (the number of phase-retard chambers), in other words, the number of shoes (the number of blades) are not limited to "4".

As viewed from the positive X-axis direction, when vane member 6 rotates anticlockwise relative to housing HSG by a predetermined angle or more, the side face 113 of the first shoe 11, facing in the clockwise direction, and the side face 613 of the first blade 61, facing in the anticlockwise direction, are brought into wall-contact with each other (see FIG. 2). With the first-shoe side face 113 and the first-blade side face 613 kept in wall-contact with each other, there is a slight aperture between two opposed side walls of shoe 12 and blade 62, there is a slight aperture between two opposed side walls of shoe 13 and blade 63, and there is a slight aperture between two opposed side walls of shoe 14 and blade 64. The maximum rotary motion of vane member 6 relative to housing HSG in the anticlockwise direction (i.e., in the phase-retard direction), can be restricted by abutment between the side face 113 of the first shoe 11 and the side face 613 of the first blade 61. That is, the side face 113 of the first shoe 11 and the side face 613 of the first blade 61 cooperate with each other to provide a first stopper (an anticlockwise rotary-motion stopper for vane member 6).

Conversely when vane member 6 rotates clockwise relative to housing HSG from the maximum phase-retard position of vane member 6 shown in FIG. 2, the side face 123 of the second shoe 12, facing in the anticlockwise direction, and the side face 614 of the first blade 61, facing in the clockwise direction, are brought into wall-contact with each other (see FIG. 3). With the second-shoe side face 123 and the first-blade side face 614 kept in wall-contact with each other, there is a slight aperture between two opposed side walls of shoe 13 and blade 62, there is a slight aperture between two opposed side walls of shoe 14 and blade 63, and there is a slight aperture between two opposed side walls of shoe 11 and blade 64. The maximum rotary motion of vane member 6 relative to housing HSG in the clockwise direction (i.e., in the phase-advance direction), can be restricted by abutment between the side face 123 of the second shoe 12 and the side face 614 of the first blade 61. That is, the side face 123 of the second shoe 12 and the side face 614 of the first blade 61 cooperate with each other to provide a second stopper (a clockwise rotary-motion stopper for vane member 6).

As discussed above, the maximum anticlockwise rotary motion of vane member 6 relative to housing HSG and the maximum clockwise rotary motion of vane member 6 relative to housing HSG are restricted by means of the first stopper (113, 613) and the second stopper (123, 614).

As can be seen in FIGS. 2-3, shoes 11-14 of housing body 10 and blades 61-64 of vane member 6 are configured so that, over the entire range of relative rotation of vane member 6 to housing HSG, the volume of phase-retard chamber R and the volume of phase-advance chamber A can be both kept at a value greater than "0", and thus the opening area of a phase-retard oil passage (e.g., a phase-retard oil passage 501 described later), opening into phase-retard chamber R, and the opening area of a phase-advance oil passage (e.g., a phase-advance oil passage 511 described later), opening into phase-advance chamber A, can be ensured. For instance, as seen in FIG. 2, the volume of the first phase-advance chamber A1 and the opening area of the phase-advance oil passage 511 are ensured by a space, defined by the cut-out portion 114 of the first shoe 11. For instance, as seen in FIG. 3, the volume of the first phase-retard chamber R1 and the opening area of the phase-retard oil passage 501 are ensured by an aperture, formed by the difference of radius of curvature between the anticlockwise rounded edge of the innermost end of the second shoe 12 and the clockwise rounded corner of the root of the first blade 61.

A portion of phase-retard passage 50 and a portion of phase-advance passage 51 are formed in each of oil-passage structural member 5*a* and vane member 6.

Axial passages 50*a* and 51*a*, a radial passage 51*b*, and a groove 51*c* are formed in oil-passage structural member 5*a*.

Axial passages 50*a* and 51*a*, extending in the X-axis direction, are opened at the end face of the negative X-axis direction of oil-passage structural member 5*a*. The opening end (the rightmost axial end, viewing FIG. 1) of axial passage 51*a* is hermetically closed by a press-fit ball B1.

An internal space 50*b* is defined between the end face of the negative X-axis direction of oil-passage structural member 5*a* and the inner peripheral surface of cylindrical bore 600.

Groove 51*c* is an annular circumferential groove formed in the outer peripheral surface of oil-passage structural member 5*a* at a predetermined axial position somewhat spaced apart from the end face of the negative X-axis direction of oil-passage structural member 5*a*.

Radial passage 51*b* is formed in oil-passage structural member 5*a* in a manner so as to intercommunicate axial passage 51*a* and groove 51*c*.

Axial passage 50*a* and space 50*b* construct a portion of phase-retard passage 50, whereas axial passage 51*a*, radial passage 51*b*, and groove 51*c* construct a portion of phase-advance passage 51.

Oil-passage structural member 5*a* has three circumferential grooves formed in its outer peripheral surface. Oil seals S1-S3 are fitted into the respective circumferential grooves. Oil-passage structural member 5*a* is installed in cylindrical bore 600 of rotor 60, so that relative rotation of oil-passage structural member 5*a* to vane member 6 is permitted. The outer peripheral surface of each of oil seals S1-S3 is kept in sliding-contact with the inner peripheral surface of cylindrical bore 600. Oil seal S1 is laid out on the side of the positive X-axis direction of oil seal S2, and oil seal S2 is laid out on the side of the positive X-axis direction of oil seal S3. Oil seals S1-S2 are laid out in a manner so as to sandwich the groove 51*c* between them, thus ensuring a high fluid-tightness of phase-advance passage 51 at the fitted portion between oil-passage structural member 5*a* and vane member 6. Oil seal S3 is laid out near the end face of the negative X-axis direction of oil-passage structural member 5*a* to ensure a high fluid-tightness of phase-retard passage 50 (in particular, space 50*b*) at the fitted portion between oil-passage structural member 5*a* and vane member 6.

Rotor 60 has radial oil holes 501-504 and radial oil holes 511-514 formed therein. Oil holes 501-504 and 511-514 are radially-extending through holes formed in rotor body 60*a*. These oil holes intercommunicate the inner peripheral surface of cylindrical bore 600 and the outer peripheral surface of rotor body 60*a*. Oil holes 501-504 construct a portion of phase-retard passage 50, whereas oil holes 511-514 construct a portion of phase-advance passage 51.

As viewed from the positive X-axis direction, oil holes 501-504 are laid out adjacent to the respective clockwise sides of the roots of the first, second, third, and fourth blades 61-64 (see FIG. 2). The axial positions of oil holes 501-504 are placed near the axial end of the negative X-axis direction of rotor body 60*a* (see FIG. 1).

As viewed from the positive X-axis direction, oil holes 511-514 are laid out adjacent to the respective anticlockwise sides of the roots of the first, second, third, and fourth blades 61-64 (see FIG. 2). The axial positions of oil holes 511-514 are placed to be slightly offset from the midpoint of rotor body 60*a* toward the positive X-axis direction (see FIG. 1).

In a state where oil-passage structural member 5*a* is inserted and installed into cylindrical bore 600 of rotor 60, the inside opening ends of phase-retard side radial oil holes 501-504 are placed in the negative X-axis direction from the oil seal S3 and open into the space 50*b*. On the other hand, the outside opening ends of phase-retard side radial oil holes 501-504 open into respective phase-retard chambers R1-R4. The inside opening ends of phase-advance side radial oil holes 511-514 are sandwiched between oil seals S1-S2, and opposed to and open into the groove 51*c*. The outside opening ends of phase-advance side radial oil holes 511-514 open into respective phase-advance chambers A1-A4.

Phase-retard passage 50, extending from directional control valve 59, is communicated with each of phase-retard chambers R1-R4 through axial passage 50*a* of oil-passage structural member 5*a* (a non-rotary member), space 50*b*, and radial oil holes 501-504 of vane member 6 (a rotary member).

Phase-advance passage 51, extending from directional control valve 59, is communicated with each of phase-advance chambers A1-A4 through axial passage 51*a* of oil-passage structural member 5*a*, radial passage 51*b*, groove 51*c*, and radial oil holes 511-514 of vane member 6.

Lock mechanism 7 is disposed between vane member 6 (exactly, the first blade 61) and rear plate 9 of housing HSG, for disabling rotary motion of vane member 6 relative to rear plate 9 by locking and engaging vane member 6 with housing HSG, and for enabling rotary motion of vane member 6 relative to rear plate 9 by unlocking (or disengaging) vane member 6 from housing HSG. The VTC device is configured in a manner so as to be locked by the lock mechanism 7 at the maximum phase-retard position at which rotary motion of vane member 6 relative to housing HSG is restricted by the first stopper (113, 613).

Lock mechanism 7 is comprised of a retractable lock piston 71, a concavity 730 of rear plate 9, and an engaging-and-disengaging mechanism. The engaging-and-disengaging mechanism operates to engage the lock piston 71 with the concavity 730 via an extension stroke of lock piston 71, depending on an engine operating condition. The engaging-and-disengaging mechanism also operates to disengage the lock piston 71 from the concavity 730 via a retraction stroke of lock piston 71, depending on an engine operating condition.

Lock piston 71 is an iron taper-pin-shaped engaging member, which is formed into a substantially cylindrical hollow shape and closed at one axial end. Lock piston 71 is slidably installed in the lock-piston bore 70 of the first blade 61, so that lock piston 71 can reciprocate or slide in the X-axis direction, and that an extending motion of lock piston 71 toward rear plate 9 and a retracting motion of lock piston 71 into the first blade 61 are permitted.

Lock piston 71 is comprised of a cylindrical sliding portion 710 accommodated in the lock-piston bore 70 so that a sliding motion of sliding portion 710 relative to lock-piston bore 70 is permitted, and a tapered head portion 714 going in and out of the lock-piston bore 70.

Sliding portion 710 is comprised of a small-diameter portion 711 formed on the side of the negative X-axis direction and a large-diameter portion 712 formed on the side of the positive X-axis direction.

Small-diameter portion 711 is formed into a substantially cylindrical hollow shape and closed at one axial end, and opened in the positive X-axis direction. The outside diameter of small-diameter portion 711 is dimensioned to be slightly less than the inside diameter of small-diameter chamber 701 of lock-piston bore 70. Small-diameter portion 711 is slidably installed in small-diameter chamber 701 of lock-piston bore 70, so that a sliding motion of the outer periphery of small-diameter portion 711 relative to the inner periphery of small-diameter chamber 701 is permitted.

The substantially circular-truncated-cone-shaped (frusto-conical), tapered head portion 714 is integrally formed on the side of the negative X-axis direction of the bottom (the right-hand closed end, viewing FIG. 1) 713 of small-diameter portion 711. Head portion 714 has a trapezoidal longitudinal cross-section and has a curved surface that the diameter of the circle of the frustum decreases in the negative X-axis direction from the bottom (the root of head portion 714) to the top (the tip of head portion 714).

Large-diameter portion 712 is a basal portion of lock piston 71, that is, an annular flanged portion formed at the leftmost end of sliding portion 710 in the positive X-axis direction. The outside diameter of large-diameter portion 712 is dimensioned to be greater than that of small-diameter portion 711, and also dimensioned to be slightly less than the inside diameter of large-diameter chamber 702 of lock-piston bore 70. Large-diameter portion 712 is slidably installed in large-diameter chamber 702 of lock-piston bore 70, so that a sliding motion of the outer periphery of large-diameter portion 712 relative to the inner periphery of small-diameter chamber 702 is permitted.

In this manner, the small-diameter portion 711 of lock piston 71 is slidably installed in small-diameter chamber 701, while the large-diameter portion 712 of lock piston 71 is slidably installed in large-diameter chamber 702. Depending on an engine operating condition, the head portion 714 of lock piston 71 is extendable in the negative X-axis direction or retractable in the positive X-axis direction.

On the other hand, the previously-discussed concavity 730, which is closed at one axial end, is formed in the end face of rear plate 9, facing in the positive X-axis direction. Concavity 730 is a lock-piston engaging hole into which the head portion 714 of lock piston 71 can be inserted at the maximum phase-retard position of vane member 6 shown in FIG. 2.

Engaging concavity 730 is constructed by an inner periphery of a sleeve 73 (a cup-shaped engaging-concavity structural member) made of iron-based metal materials. Rear plate 9 is formed with an axially-bored retaining hole 900. That is, sleeve 73 (the cup-shaped engaging-concavity structural member) is press-fitted into the retaining hole 900 of rear plate 9, such that engaging concavity 730 is defined in the cup-shaped sleeve 73.

The axial depth of engaging concavity 730 is approximately identical to the axial length of the head portion 714 of lock piston 71. The slightly tapering diameter of the inner periphery of engaging concavity 730 is slightly greater than the slightly tapering diameter of the outer periphery of head portion 714 of lock piston 71. Engaging concavity 730 has a substantially trapezoidal axial cross section, cut along a plane through the axis of the cup-shaped sleeve 73. Engaging concavity 730 is formed as a tapered hole whose inside diameter gradually increases toward the opening end of the positive X-axis direction. In other words, engaging concavity 730 has a curved surface that the diameter of the circle of the frustum decreases in the negative X-axis direction from the opening end of engaging concavity 730 to the bottom face of cup-shaped sleeve 73. The cone angle of the inner peripheral surface of engaging concavity 730 is dimensioned to be approximately identical to that of the outer peripheral surface of head portion 714 of lock piston 71.

When rotary motion of vane member 6 relative to housing HSG in the phase-retard direction occurs and then the maximum rotary motion of vane member 6 in the phase-retard direction is restricted by the first stopper (113, 613), that is, when the volume of phase-advance chamber A1 becomes minimum, as viewed in the X-axis direction, the circumferential position of head portion 714 of lock piston 71 becomes identical to that of engaging concavity 730 of rear plate 9. In other words, the circumferential position of engaging concavity 730 is determined or designed so that, when the head portion 714 of lock piston 71 is brought into engagement with the engaging concavity 730 of rear plate 9, the angular position of vane member 6 relative to housing HSG is brought into an optimal angular position (i.e., the maximum phase-retard position) suited to an engine-startup period.

Fully taking account of the slight difference between the slightly tapering diameter of the inner periphery of engaging concavity 730 and the slightly tapering diameter of the outer periphery of lock-piston head portion 714, that is, in order to reliably keep the locking state of vane member 6 with rear plate 9 (housing HSG) at the maximum phase-retard position, the circumferential position of the axis of engaging concavity 730 of the rear plate side is designed to be slightly offset anticlockwise (viewing FIG. 2) from the axis of lock-piston head portion 714.

A back-pressure chamber 72 for lock piston 71 is also defined in the lock-piston bore 70. Back-pressure chamber 72 is a low-pressure chamber partitioned by lock piston 71 to face in the positive X-axis direction with respect to lock piston 71. Concretely, back-pressure chamber 72 is defined by the axial end face (the inside face) of front plate 8, facing in the negative X-axis direction, the inner peripheral surface of lock-piston bore 70, and the inner peripheral surface of cylindrical sliding portion 710 of lock piston 71.

The engaging-and-disengaging mechanism is comprised of a coiled compression spring 74, serving as an engaging (locking) biasing member, and a communication hole 75 and a communication groove 76, both serving as disengaging (unlocking) oil passages.

Coil spring 74 is a spring-bias member that permanently forces the lock piston 71 in the negative X-axis direction, that is, toward the engaging concavity 730 of rear plate 9.

A spring retainer 74*a* is disposed in the back-pressure chamber 72. The basal portion (the head portion) of the positive X-axis direction of spring retainer 74*a* is kept in sliding-contact with the inside face of front plate 8, whereas the axially-protruding portion of the negative X-axis direction of spring retainer 74*a* is loosely fitted into the inner periphery of coil spring 74.

Coil spring 74 is disposed in back-pressure chamber 72 under preload. The left-hand axial end of coil spring 74, facing in the positive X-axis direction, is kept in abutted-engagement with the left-hand annular end of the head portion of spring retainer 74*a*, facing in the negative X-axis direction. The right-hand axial end of coil spring 74, facing in the negative X-axis direction, is kept in abutted-engagement with the bottom (the right-hand closed end, viewing FIG. 1) 713 of small-diameter sliding portion 711 of lock piston 71. That is, coil spring 74 is located on the side of the positive X-axis direction with respect to lock piston 71, in a manner so as to permanently bias the lock piston 71 in the negative X-axis direction (i.e., toward the engaging concavity 730 of rear plate 9).

Also defined in the lock-spring bore 70 are two pressure-receiving chambers, each of which produces a hydraulic pressure acting on the lock piston 71. Concretely, the first pressure-receiving chamber 77 is defined in the large-diameter chamber 702 of lock-piston bore 70 by the annular end face of small-diameter chamber 701 of lock-piston bore 70, facing in the positive X-axis direction, the annular end face of large-diameter portion 712 of lock piston 71, facing in the negative X-axis direction, the outer peripheral surface of small-diameter sliding portion 711, and the inner peripheral surface of large-diameter chamber 702 of lock-piston bore 70. The second pressure-receiving chamber 78 is defined by the outer peripheral surface of the tapered head portion 714, facing in the negative X-axis direction, and the inner peripheral surface of cup-shaped sleeve 73, facing in the positive X-axis direction.

The first blade 61 is formed with oil passages therein, for introducing hydraulic pressure in the working oil chamber (phase-retard chamber R or phase-advance chamber A) into either the first pressure-receiving chamber 77 or the second pressure-receiving chamber 78. Concretely, the first blade 61 is formed with the circumferentially-extending communication hole 75 through which the first phase-retard chamber R1 and the first pressure-receiving chamber 77 are always intercommunicated to introduce hydraulic pressure in the first phase-retard chamber R1 into the first pressure-receiving chamber 77. In a similar manner, the first blade 61 is also formed with the circumferentially-extending communication groove 76 through which the first phase-advance chamber A1 and the second pressure-receiving chamber 78 are always intercommunicated to introduce hydraulic pressure in the first phase-advance chamber A1 into the second pressure-receiving chamber 78 (into the engaging concavity 730 in the locked state of vane member 6). By the way, even at the maximum phase-retard position, the opening area of the communication groove 76 opening into the first phase-advance chamber A1 is ensured by the space, defined by the cut-out portion 114 of the first shoe 11.

A part of working oil, supplied to the first phase-retard chamber R1, and then introduced through the communication hole 75 into the first pressure-receiving chamber 77, produces a hydraulic pressure that forces lock piston 71 in its retracting direction (i.e., in the positive X-axis direction). In the same manner, a part of working oil, supplied to the first phase-advance chamber A1, and then introduced through the communication groove 76 into the second pressure-receiving chamber 78, also produces a hydraulic pressure that forces lock piston 71 in its retracting direction (i.e., in the positive X-axis direction).

When rotary motion of vane member 6 relative to housing HSG in the phase-retard direction occurs and then the maximum rotary motion of vane member 6 in the phase-retard direction is restricted by the first stopper (113, 613), as viewed in the X-axis direction, the circumferential position of the head portion 714 of lock piston 71 becomes identical to that of the engaging concavity 730 of rear plate 9, thus enabling lock piston 71 to move in the negative X-axis direction. At this time, with an extending stroke of the head portion 714 of lock piston 71 out of the first blade 61 (the lock-piston bore 70) by the spring force of coil spring 74, the head portion 714 is inserted into and engaged with the engaging concavity 730. With lock piston 71 engaged with the engaging concavity 730, relative rotation between rear plate 9 and vane member 6, that is, relative rotation between housing HSG and camshaft 65 is restricted (disabled).

On the other hand, the large-diameter portion 712 of lock piston 71 is forced in the positive X-axis direction by hydraulic pressure of working oil fed from the first phase-retard chamber R1 through the communication hole 75 to the first pressure-receiving chamber 77. Additionally, the tapered head portion 714 of lock piston 71 is forced in the positive X-axis direction by hydraulic pressure of working oil fed from the first phase-advance chamber A1 through the communication groove 76 to the second pressure-receiving chamber 78. The above-mentioned two hydraulic pressures, both act to assist a lock-piston retracting stroke that lock piston 71 moves in the positive X-axis direction against the spring force of coil spring 74, and at the same time the tapered head portion 714 of lock piston 71 goes out of the engaging concavity 730, and then lock piston 71 retracts into the lock-piston bore 70 of the first blade 61. Thus, lock piston 71 becomes disengaged from the engaging cavity 730 of rear plate 9.

As discussed above, coil spring 74 functions as a locked-state holding mechanism. In contrast, communication hole 75 and communication groove 76 both function as unlocking (disengaging) oil passages.

Back-pressure chamber 72 communicates with the bolt insertion hole 80 of front plate 8 through the radial groove 605. Thus, back-pressure chamber 72 is opened to the exterior space of the VTC device (i.e., to the atmosphere), in other words, to a low-pressure space (see FIG. 1). In other words, radial groove 605 is an air-bleed groove formed at the end face of vane member 6, facing in the positive X-axis direction. This radial groove 605 functions as an air bleeder by which an internal pressure in back-pressure chamber 72 (i.e., a back-pressure of lock piston 71) can be relieved and kept low.

The operation of the VTC device including the VTC control system is hereunder described in detail.

During rotation of cam shaft 65, owing to reaction forces from the intake valve side to the cams of camshaft 65, a so-called alternating torque (in other words, positive and negative torque fluctuations) acts on camshaft 65 (vane member 6). Due to contact resistances of the sliding-contact surfaces of the cams, as a whole, the alternating torque tends to act in a direction that prevents rotary motion of camshaft 65, that is, in a phase-retard direction that rotary motion of camshaft 65 (vane member 6) relative to housing HSG in the anticlockwise direction (viewing FIG. 2) occurs.

In an engine stopped state, pump P is kept inoperative, and thus oil supply to the working oil chambers (phase-advance chamber A and phase-retard chamber R) is also stopped. Additionally, there is no application of control current (exciting current) from controller CU to the solenoid SOL of directional control valve 59, and thus fluid-communication of supply passage 54 and phase-retard passage 50 and fluid-communication of phase-advance passage 51 and exhaust passage 57 are established.

Just before the engine has been stopped, owing to the alternating torque acting on the camshaft 65, vane member 6 becomes held at its initial position, i.e., the maximum phase-retard position (see FIG. 2). Also, at this maximum phase-retard position, the lock piston 71 of lock mechanism 7 is kept in engagement with the engaging concavity 730 of rear plate 9, so that relative rotation of vane member 6 to housing HSG is restricted.

Thereafter, when the engine is cranked and started by turning the ignition key ON, the pump P begins to operate. Just after the engine has been started, oil supply to the VTC device (i.e., a working oil pressure) becomes still insufficient. At this time, by virtue of lock mechanism 7, vane member 6 is restricted or held at its initial position (the maximum phase-retard position suited to an engine startup, i.e., a smooth cranking operation). As a result of this, it is possible to enhance an engine startability, while avoiding undesirable collision-contact (noise) between vane member 6 (concretely, the side face 613 of the first blade 61) and housing HSG (concretely, the side face 113 of the first shoe 11 of housing body 10), which may occur owing to the alternating torque.

When the engine has been started but any control current has not yet been inputted from controller CU to the solenoid SOL of directional control valve 59, fluid-communication of supply passage 54 and phase-retard passage 50 and fluid-communication of phase-advance passage 51 and exhaust passage 57 remain established. Under these conditions, oil, fed from pump P to supply passage 54, is delivered to each of phase-retard chambers R1-R4. At this time, air, prevailing in each of phase-retard chambers R1-R4, is pushed by hydraulic pressure of the delivered working oil, and then exhausted through the sintered, porous structural member of housing body 10, and/or the unsealed portions among component parts, constructing housing HSG and vane member 6, to the exterior space of the VTC device. Also, a part of the air, together with the hydraulic pressure of working oil delivered to each of phase-retard chambers R1-R4, acts to push or force vane member 6 toward the maximum phase-retard position.

As previously described, a part of working oil in the first phase-retard chamber R1 is introduced through communication hole 75 of lock mechanism 7 into the first pressure-receiving chamber 77. The hydraulic pressure of working oil, introduced into the first pressure-receiving chamber 77, serves to force lock piston 71 in its retracting direction (i.e., in the positive X-axis direction). As soon as the hydraulic pressure in the first phase-retard chamber R1, in other words, the hydraulic pressure in supply passage 54, becomes greater than or equal to a specified pressure value P1, the head portion 714 of lock piston 71 becomes completely disengaged from the engaging concavity 730 of rear plate 9. As a result, the locked state of vane member 6 becomes released, so that relative rotation of vane member 6 to housing HSG becomes permitted and an arbitrary change in engine valve timing (valve open timing and/or valve closure timing) becomes enabled. After a transition of vane member 6 to its unlocked state has occurred, during operation of the engine at low speeds, vane member 6 is still maintained at its maximum phase-retard position by a comparatively low working oil pressure supplied to each of phase-retard chambers R1-R4.

Thereafter, suppose that the engine operating condition shifts to a middle speed range, and thus the spool of directional control valve 59 shifts to the fully-energized position, responsively to a pulse control current having a given duty ratio from controller CU. Fluid-communication between supply passage 54 and phase-advance passage 51 and fluid-communication between phase-retard passage 50 and exhaust passage 57 are established. As a result, oil in each of phase-retard chambers R1-R4 is exhausted and then returned to oil pan O/P, whereas oil, fed from pump P to supply passage 54, is delivered to each of phase-advance chambers A1-A4.

Owing to a rise in hydraulic pressure in each of phase advance chambers A1-A4, vane member 6 begins to rotate apart from the maximum phase-retard position, so that rotary motion of vane member 6 relative to housing HSG in the clockwise direction (i.e., in the phase-advance direction) occurs. Under these conditions, the hydraulic pressure in the first pressure-receiving chamber 77 of lock mechanism 7 tends to fall, but a part of working oil, supplied to the first phase-advance chamber A1, is introduced through the communication groove 76 into the second pressure-receiving chamber 78 of lock mechanism 7. The working oil, introduced into the second pressure-receiving chamber 78, produces a hydraulic pressure that forces lock piston 71 in its retracting direction (i.e., in the positive X-axis direction). Thus, the unlocked state, in which the head portion 714 of lock piston 71 is completely disengaged from the engaging concavity 730 of rear plate 9, can be maintained.

A relative angular phase of camshaft 65 to the crankshaft becomes changed to the phase-advance side, so that intake-valve open timing (IVO) and intake-valve closure timing (IVC) can be both phase-advanced. As a result, a valve overlap period, during which the open periods of intake and exhaust valves are overlapped, tends to increase, thus enhancing a combustion efficiency.

Thereafter, suppose that due to a further engine speed rise the engine operating condition shifts to a high speed range, and thus the spool of directional control valve 59 is continuously kept at the fully-energized position, responsively to a pulse control current having a given duty ratio from controller CU. High-pressure working oil can be continuously supplied to each of phase-advance chambers A1-A4. As a result, a further clockwise rotational motion of vane member 6 relative to housing HSG occurs, and thus a relative angular phase of camshaft 65 to the crankshaft is further phase-advanced. Finally, the relative angular phase of vane member 6 reaches its maximum phase-advance position at which the volume of each of phase-advance chambers A1-A4 becomes maximum (see FIG. 3). As a result, a valve overlap period, during which the open periods of intake and exhaust valves are overlapped, becomes maximum.

After this, suppose that, owing to an engine speed fall, the hydraulic pressure in each of phase-advance chambers A1-A4 tends to gradually fall and thus a relative angular phase of camshaft 65 to the crankshaft is returned back to the phase-retard side. Thus, the previously-discussed valve overlap period becomes small. At this time, the hydraulic pressure in supply passage 54, remains kept at a pressure level above the specified pressure value P1, and hence the unlocked state, in which the head portion 714 is completely disengaged from the engaging concavity 730, remains maintained.

Figure 4:
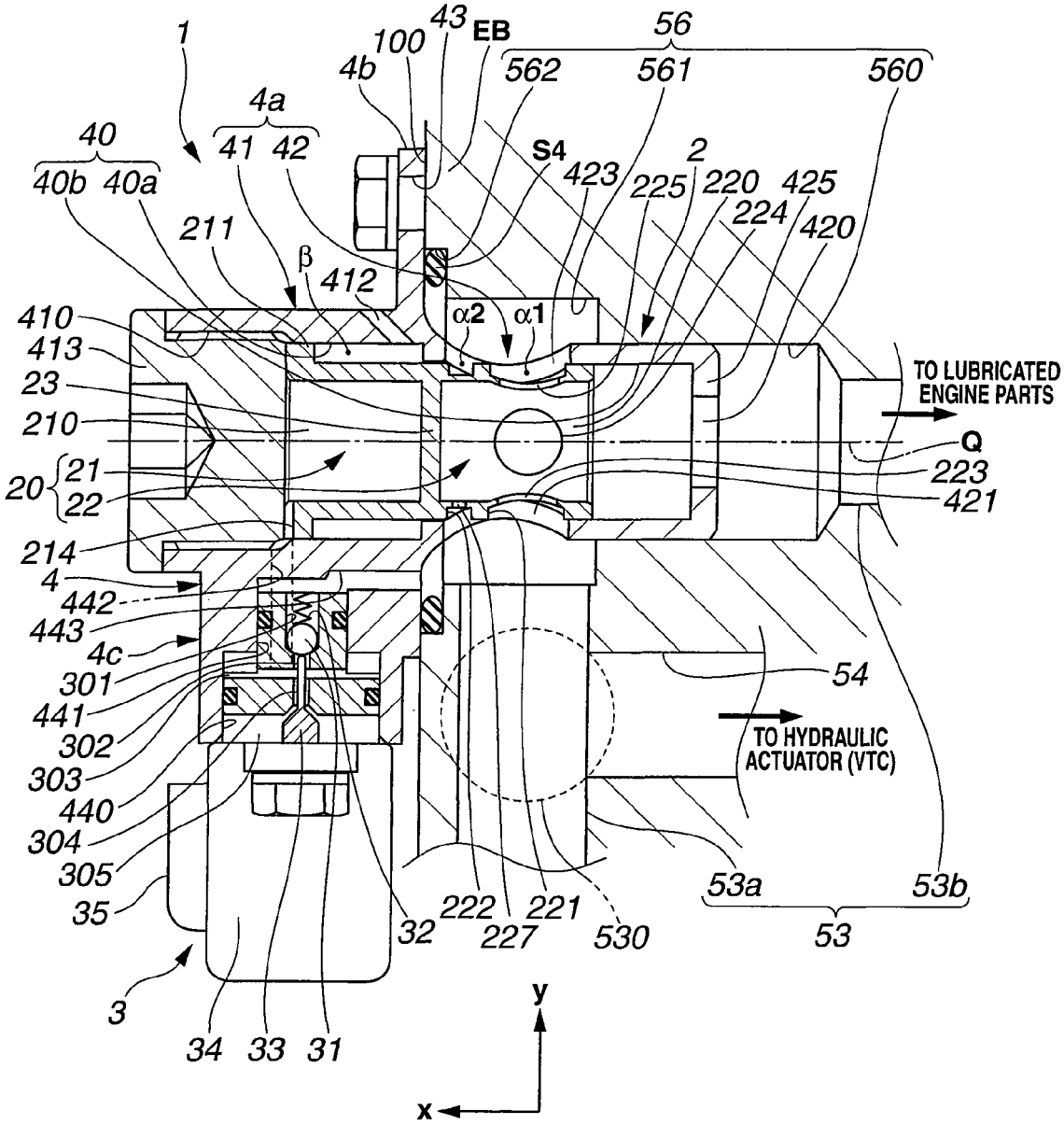
FIG. 4 is a partial cross-section of the control valve apparatus of the first embodiment, whose spool is controlled to a large flow-rate side.
Figure 5:
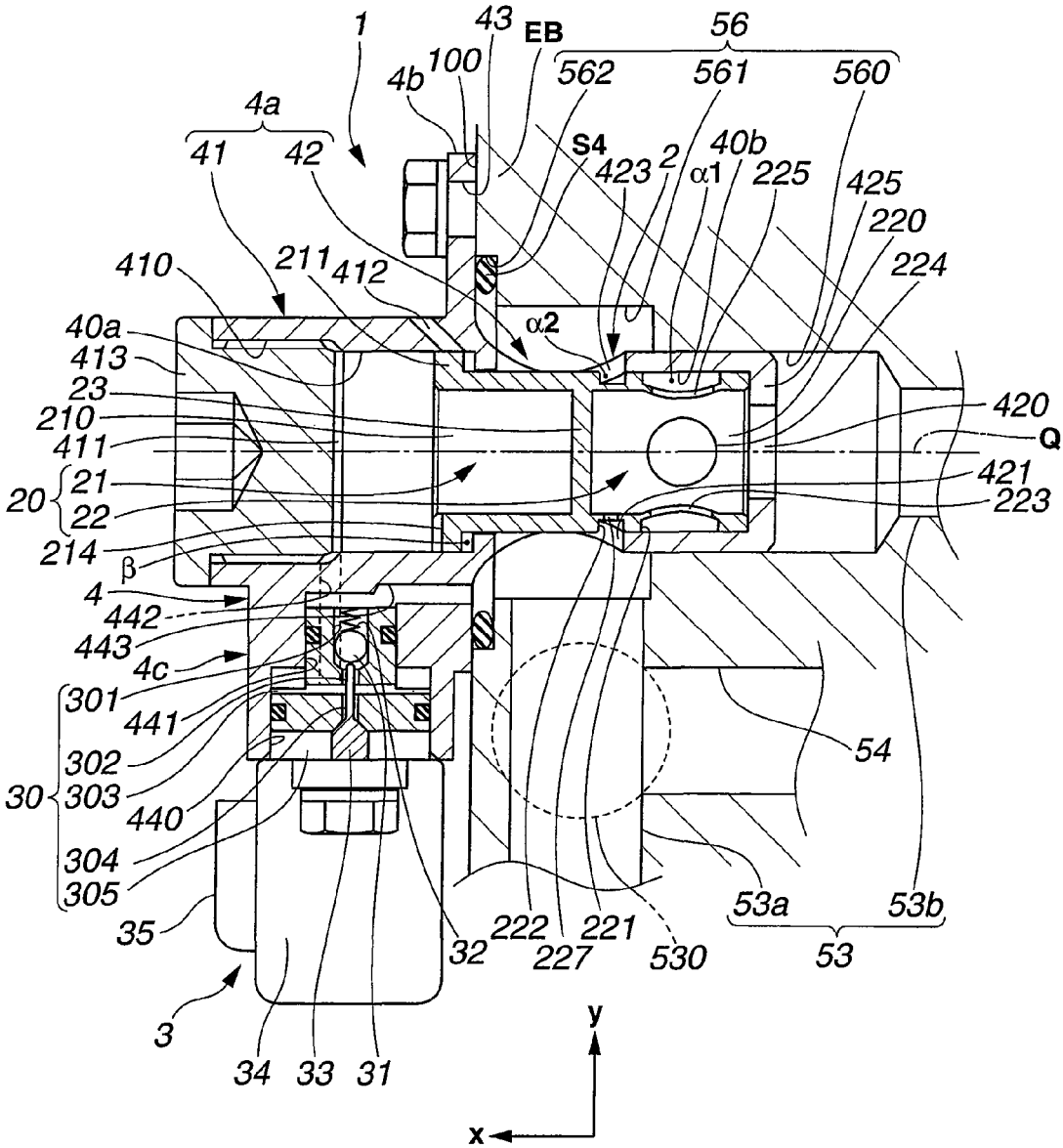
FIG. 5 is a partial cross-section of the control valve apparatus of the first embodiment, whose spool is controlled to a small flow-rate side.

The construction of control valve apparatus 1 is hereunder described in detail in reference to FIGS. 4-5. The cross-section of each of FIGS. 4-5 shows the partial cross-section passing through the centerline "Q" of control valve apparatus 1 of the first embodiment (that is, the axis of sliding motion of a spool 20 described later in detail and constructing a part of control valve apparatus 1). The centerline "Q" of control valve apparatus 1 is hereinafter referred to as "axis Q".

Assume that the direction, perpendicular to one side face 100 of engine block EB, is taken as an "x-axis", and the direction, parallel to the side face 100 of engine block EB, is taken as a "y-axis".

First of all, the oil-path configuration of the side of engine block EB, on which control valve apparatus 1 is installed, is described.

Supply passage 53 (that is, the upstream supply passage 53*a* and the downstream supply passage 53*b*) and supply passage 54 are formed in the engine block EB by drilling.

The upstream supply passage 53*a* is formed to extend approximately straight in the y-axis direction, while being spaced from the end face 100 of engine block EB by a predetermined distance. The end of the negative y-axis direction of supply passage 53*a* is connected to the outlet of pump P.

Supply passage 54 for working/lubricating oil supply to the VTC device is branched from the branched point 530 of the positive y-axis direction of supply passage 53*a*. The supply passage 54 is hereinafter referred to as "branch passage 54". Branch passage 54 is formed to extend approximately straight in the x-axis direction. The end of the negative x-axis direction of branch passage 54 is connected to directional control valve 59.

The downstream supply passage 53*b* is formed to extend approximately straight in the x-axis direction. The downstream supply passage 53*b* is connected, on the side of the negative x-axis direction, to each of lubricated engine parts.

The end of the positive y-axis direction of supply passage 53*a* and the end of the positive x-axis direction of supply passage 53*b* are connected to each other in a unit mounting portion 56 formed in the engine block EB.

Unit mounting portion 56 is a mounting hole drilled in the engine block EB for mounting a valve unit including the control valve apparatus 1. Unit mounting portion 56 is comprised of a housing retaining bore 560, an annular groove 561, and a seal retaining bore 562.

Seal retaining bore 562, annular groove 561, and housing retaining bore 560 are substantially cylindrical bores formed inside of the side face 100 of engine block EB, and aligned substantially coaxially with the downstream supply passage 53*b* with respect to the axis "Q". Seal retaining bore 562, annular groove 561, and housing retaining bore 560 are laid out in that order, in the negative x-axis direction.

Regarding the inside diameters of seal retaining bore 562, annular groove 561, and housing retaining bore 560, the inside diameter of seal retaining bore 562 is dimensioned to be greater than that of annular groove 561, and the inside diameter of annular groove 561 is dimensioned to be greater than that of housing retaining bore 560. That is, unit mounting portion 56 is formed as a two-stepped bore.

Regarding the dimensions of seal retaining bore 562, annular groove 561, and housing retaining bore 560, measured in the x-axis direction, the seal retaining bore 562 is dimensioned to be shorter than the annular groove 561, and the annular groove 561 is dimensioned to be shorter than the housing retaining bore 560.

Annular groove 561 is connected, on the side of the negative y-axis direction, to the supply passage 53*a*. The width of annular groove 561, measured in the x-axis direction, is dimensioned to be greater than the inside diameter of supply passage 53*a*. The end of the positive y-axis direction of supply passage 53*a* opens from the inner peripheral surface of annular groove 561 into the internal space.

Supply passage 53*b* is connected to the end of the negative x-axis direction of housing retaining bore 560. The inside diameter of housing retaining bore 560 is dimensioned to be greater than that of supply passage 53*b*. The end of the positive x-axis direction of supply passage 53*b* opens at the end of negative x-axis direction of housing retaining bore 560.

Seal retaining bore 562 opens from the side face 100 of engine block EB.

Component parts of control valve apparatus 1 are hereunder described in detail.

Control valve apparatus 1 is comprised of a spool valve 2 (serving as a flow-path selector) and a pilot valve 3 (provided for a pilot operation), both accommodated in a single housing (the same valve casing) 4 common to these two valves 2-3. As a valve unit with both the spool valve 2 and the pilot valve 3, control valve apparatus 1 is installed in the unit mounting portion 56 of engine block EB.

Control valve apparatus 1 is configured to produce a control hydraulic pressure by the electromagnetically-operated pilot valve 3. Spool valve 2 is operated (opened or closed) by the control hydraulic pressure. That is, as the control valve apparatus 1, a pilot-operated type is adopted.

Spool valve 2 has a spool (a main valve element) 20. Spool valve 2 is a directional control valve configured to change the path of flow through the valve element (i.e., with a sliding motion of spool 20). The spool valve 2 functions as a two-way valve that performs switching action of the path of flow by opening and closing action of the valve element (spool 20), and also functions as a flow control valve that controls a flow rate of oil through the valve element by a flow-constricting orifice action.

Pilot valve 3 is a control valve configured to operate the spool valve 2 (the main valve) by a pilot pressure.

Housing 4 is a support member serving to support or mount both spool valve 2 and pilot valve 3. Housing 4 is installed on the unit mounting portion 56. Housing 4 is made of aluminum alloy materials by die-casting. Housing 4 is comprised of a spool valve body (a spool valve housing) 4*a*, a flanged portion 4*b*, and a pilot valve body (a pilot valve housing) 4*c*, all formed integral with each other.

Spool valve body 4*a* of housing 4 has a back-pressure portion 41 formed on the side of the positive x-axis direction and a flow-passage portion 42 formed on the side of the negative x-axis direction. The inner periphery of spool valve body 4*a* is formed as a substantially cylindrical-hollow sliding-contact bore 40 that serves as a guide surface designed to ensure a smooth sliding motion of spool 20.

Back-pressure portion 41 is formed into a substantially cylindrical shape. The end of the positive x-axis direction of back-pressure portion 41 is formed as an opening end. The end of the negative x-axis direction of back-pressure portion 41 is formed to be continuous with the flow-passage portion 42. The inner peripheral surface of back-pressure portion 41 has a female-screw-threaded portion 410 formed on the side of positive x-axis direction. The inner peripheral surface of back-pressure portion 41 is formed as a large-diameter bore 40*a* (a large-diameter portion of sliding-contact bore 40 for spool 20). The end of the positive x-axis direction of large-diameter bore 40*a* has an annular groove 411 (see FIG. 5)

formed in the inner periphery of bore 40*a* in close proximity to the end of the negative x-axis direction of female-screw-threaded portion 410.

The end of the negative x-axis direction of back-pressure portion 41 is integrally formed with the flanged portion 4*b* radially-outward extending along the plane perpendicular to the axis "Q" and located in close proximity to the flow-passage portion 42.

Flanged portion 4*b* has a bolt hole 43 formed as a through hole extending in the x-axis direction. A mounting bolt is inserted into the bolt hole 43 from the side of the positive x-axis direction. By screwing and tightening the mounting bolt into a female-screw-threaded portion formed in the side face 100 of engine block EB, housing 4 is fixedly connected to and mounted on the engine block EB. An O ring (an oil seal member) S4 is fitted into the seal retaining bore 562 of engine block EB. Under a state where housing 4 has been bolted to the side face 100 of engine block EB, O ring S4 is sandwiched and compressed between the end face of the negative x-axis direction of flanged portion 4*b* of housing 4 and the end face of the positive x-axis direction of seal retaining bore 562, thus ensuring a high fluid-tightness of the interior space of unit mounting portion 56.

Back-pressure portion 41 has an oblique hole 412 formed on the side of the positive y-axis direction and the negative x-axis direction. Oblique hole 412 is formed as a substantially-straight through hole penetrating the inner and outer peripheries of back-pressure portion 41. Oblique hole 412 is opened to the exterior space of engine block EB through the outer peripheral surface of back-pressure portion 41 on the side of the positive x-axis direction of flanged portion 4*b*. Oblique hole 412 is also opened to the interior space of sliding-contact bore 40 through the inner peripheral surface of large-diameter bore 40*a* (a large-diameter portion of sliding-contact bore 40 for spool 20) at a given position, somewhat overlapping with the flanged portion 4*b* in close proximity to the end of the negative x-axis direction of back-pressure portion 41.

Oblique hole 412, intercommunicating the interior and exterior spaces of back-pressure portion 41 (spool valve body 4*a*), serves as an air breather that functions to facilitate a change in volume of the internal space defined between the outer periphery of spool 20 and the inner periphery of large-diameter bore 40*a* of sliding-contact bore 40.

A threaded plug 413 is screwed into the female-screw-threaded portion 410 of back-pressure portion 41, so as to hermetically close the opening end of back-pressure portion 41, facing in the positive x-axis direction. That is, the side of the backface of spool 20 is closed in a fluid-tight fashion by the threaded plug 413.

Flow-passage portion 42 of spool valve body 4*a* is formed into a substantially cylindrical bore closed at one end and having a diameter smaller than a diameter of back-pressure portion 41. Flow-passage portion 42 is formed with communication holes (for example, communication holes (through holes) 421 and 423).

The inner peripheral surface of flow-passage portion 42 is formed as a small-diameter bore 40*b* (a small-diameter portion of sliding-contact bore 40 for spool 20). The inside diameter of small-diameter bore 40*b* is dimensioned to be less than that of large-diameter bore 40*a*. The end of the positive x-axis direction of small-diameter bore 40*b* and the end face of the negative x-axis direction of flanged portion 4*b* are aligned with each other in the x-axis direction, in a manner so as to form a stepped annular portion in cooperation with large-diameter portion 40*a*. The outside diameter of the outer peripheral surface of flow-passage portion 42 is dimensioned to be approximately equal to that of large-diameter bore 40*a*. The outer peripheral surface of the left-hand half (viewing FIGS. 4-5) of flow-passage portion 42 is formed to be continuous with the end face of the negative x-axis direction of flanged portion 4*b*, while drawing a moderately curved surface.

The end of the negative x-axis direction of flow-passage portion 42 is inserted and fitted into the housing retaining bore 560. As a result, sliding-contact bore 40 (large-diameter bore 40*a* and small-diameter bore 40*b*) and annular groove 561 are accurately positioned and aligned coaxially with each other with respect to the axis "Q". By way of such an accurate positioning and fitting process, it is possible to suppress an undesirable fluid-communication between annular groove 561 and housing retaining bore 560 via the outer peripheral aide of flow-passage portion 42.

A plurality of circumferentially-equidistant spaced circular holes (four holes 421-424 in the shown embodiment) are formed in the basal end of the positive x-axis direction of flow-passage portion 42. Each of holes 421-424 is formed as a through hole radially penetrating the inner and outer peripheries of flow-passage portion 42. Each of through holes 421-424 is a communication hole that opens from the outer peripheral surface of flow-passage portion 42 and also opens from the inner peripheral surface of sliding-contact bore 40 (especially, small-diameter bore 40*b*). In the shown embodiment, although flow-passage portion 42 has four circular through holes 421-424, it will be appreciated that the number of through holes is not limited to "4". The shape and the number of through holes may be modified.

The diameters of through holes 421-424 are dimensioned to be approximately equal to each other, and also dimensioned to be less than the dimension of annular groove 561, measured in the x-axis direction. The axial position of the end of the positive x-axis direction of each of through holes 421-424 is approximately identical to that of the end of the positive x-axis direction of annular groove 561, and also located to be somewhat offset toward the positive x-axis direction from the end of the positive x-axis direction of supply passage 53*a*. The end of the negative x-axis direction of each of through holes 421-424 is located in annular groove 561 and also located to be somewhat offset toward the positive x-axis direction from the end of the negative x-axis direction of supply passage 53*a*. In other words, the openings (i.e., the first fluid-communication portion) of housing 4, installed in unit mounting portion 56, are located at the inner peripheral side of annular groove 561, such that annular groove 561 is located at the outer peripheral side of the first fluid-communication portion.

Of four through holes 421-424, the first through hole 421 is located to open in the negative y-axis direction, in a manner so as to be opposed to the supply passage 53*a* in the y-axis direction.

The end (a bottom 425) of the negative x-axis direction of flow-passage portion 42 is formed with a hole 420. Hole 420 is formed as a through hole penetrating the inner and outer peripheries of the bottom 425 and extending in the x-axis direction and aligned substantially coaxially with the axis "Q". Hole 420 is a communication hole that opens into the exterior space of flow-passage portion 42 (i.e., the inner peripheral side of housing retaining bore 560) on the side of the negative x-axis direction of bottom 425 in a manner so as to be opposed to the supply passage 53*b* in the x-axis direction, and also opens into the interior space of flow-passage portion 42 (i.e., the inner peripheral side of small-diameter bore 40*b* of sliding-contact bore 40) on the side of the positive x-axis direction of bottom 425.

The inside diameter of through hole 420 is dimensioned to be slightly greater than one-half of the inside diameter of small-diameter bore 40*b* of sliding-contact bore 40, and also dimensioned to be less than the inside diameter of supply passage 53*b*.

Pilot valve body 4*c* is formed as a substantially cylindrical portion that extends in the negative y-axis direction from the outer periphery of back-pressure portion 41 of spool valve body 4*a*. Pilot valve body 4*c* and spool valve body 4*a* are formed integral with each other.

Pilot valve body 4*c* is a pilot-valve mounting bore for pilot valve 3. Pilot valve body 4*c* has a large-diameter bore 440 that opens into the exterior space of housing 4 on the side of the negative y-axis direction, and a small-diameter bore 441 formed substantially coaxially with the large-diameter bore 440 in close proximity to the side of the positive y-axis direction of large-diameter bore 440. The inside diameter of small-diameter bore 441 is dimensioned to be less than that of large-diameter bore 440.

Additionally, pilot valve body 4*c* has an axial passage 442 and a radial passage 443 both formed therein, for supplying or exhausting oil (for a pilot operation) to or from back-pressure portion 41 of spool valve body 4*a*.

Axial passage 442 is formed to extend in the y-axis direction. The end of the positive y-axis direction of axial passage 442 opens into the sliding-contact bore 40 of back-pressure portion 41 (i.e., the annular groove 411 of large-diameter bore 40*a* shown in FIG. 5). The end of the negative y-axis direction of axial passage 442 is connected to a relay passage 303 of pilot valve 3.

Radial passage 443 is formed to extend in the x-axis direction. The end of the negative x-axis direction of radial passage 443 opens from the end face of the negative x-axis direction of flanged portion 4*b* in a manner so as to communicate the annular groove 561 and the seal retaining bore 562 of unit mounting portion 56. The end of the positive x-axis direction of radial passage 443 opens into the end of the positive y-axis direction of small-diameter bore 441 in a manner so as to be connected to the axial passage 442 through the relay passages 302-303.

Pilot valve 3 has an oil passage 30, a ball 31, a spring 32, an armature 33, and a solenoid 34.

Oil passage 30 is constructed by an axial passage 301, and relay passages 302-305.

Axial passage 301 is formed to extend in the y-axis direction. The end of the positive y-axis direction of axial passage 301 communicates the radial passage 443 of pilot valve body 4*c* of housing 4, whereas the end of the negative y-axis direction of axial passage 301 communicates the relay passage 302. Ball 31 is installed on the side of the negative y-axis direction of axial passage 301. Ball 31 is permanently biased in the negative y-axis direction by means of the spring 32 installed in the axial passage 301 in a manner so as to close the opening of relay passage 302.

Relay passage 302 is formed to extend in the y-axis direction. The end of the negative y-axis direction of relay passage 302 communicates the relay passage 303. Relay passage 303 is formed to extend in the direction perpendicular to the y-axis. The end of the positive y-axis direction of relay passage 303 communicates the axial passage 442 of pilot valve body 4*c* of housing 4, whereas the end of the negative y-axis direction of relay passage 303 communicates the relay passage 304. Relay passage 304 is formed to extend in the y-axis direction. The side of the negative y-axis direction of relay passage 304 communicates the relay passage 305. Relay passage 305 is connected through an exhaust passage (not shown) to the oil pan O/P, and thus opened to the atmosphere.

Armature 33 has a needle-shaped pointed portion that extends in the y-axis direction in a manner so as to penetrate all of relay passages 302-304. The end of the positive y-axis direction of the needle-shaped pointed portion of armature 33 is installed to be kept in abutment with the ball 31. A sealing surface is provided at the end of the negative y-axis direction of armature 33, that is, the root of the needle-shaped pointed portion of armature 33. By bringing the sealing surface of armature 33 into abutted-engagement with a sealing surface formed in the opening of the negative y-axis direction of relay passage 304, fluid-communication between two relay passages 304 and 305 can be blocked.

Solenoid 34 is connected via a connector 35 to an electric power source. When solenoid 34 is energized, the electric coil of solenoid 34 creates a magnetic force that forces armature 33 in the positive y-axis direction.

Spool 20 is a piston slidably accommodated in sliding-contact bore 40 of spool valve body 4*a*. Spool 20 is made of iron-based metal materials, and formed into a substantially cylindrical shape by cold forging. Spool 20 is partitioned into a back-pressure portion 21 defined on the side of the positive x-axis direction and a flow-passage portion 22 defined on the side of the negative x-axis direction by a partition wall portion 23.

Back-pressure portion 21 is formed into a substantially cylindrical hollow shape, but closed at one axial end. The end of the positive x-axis direction of back-pressure portion 21 is formed as an opening end. The end of the negative x-axis direction of back-pressure portion 21 is closed by the partition wall portion 23. In other words, the inner peripheral side of back-pressure portion 21 is formed as a recessed portion, concretely, a substantially cylindrical bore 210 whose bottom (closed end) is the partition wall portion 23 (see FIG. 4).

The end of the positive x-axis direction of back-pressure portion 21, that is, the perimeter of the left-hand side opening (viewing FIGS. 4-5) of back-pressure portion 21 is formed integral with a flanged portion 211. Flanged portion 211 is formed as a large-diameter annular ring-shaped flange radially-outward extending from the outer peripheral surface of spool 20 and having an outside diameter greater than the outside diameter of the other cylindrical portion of spool 20. The dimension (the axial length) of the x-axis direction of flanged portion 211 is dimensioned to be greater than that of annular groove 411 of housing 4.

The end face of the positive x-axis direction of flanged portion 211 is formed with a groove 214 having a predetermined depth in the x-axis direction. Groove 214 is a straight radial groove extending in the radial direction of spool 20 in a manner so as to intercommunicate the inner peripheral side (cylindrical bore 210) and the outer peripheral side of flanged portion 211.

The length of back-pressure portion 21 in the x-axis direction, that is, the distance between the end of the positive x-axis direction of back-pressure portion 21 and the end face of the positive x-axis direction of partition wall portion 23 is dimensioned to be approximately equal to the axial length of large-diameter bore 40*a* (a large-diameter portion of sliding-contact bore 40).

The outside diameter of the circumference of flanged portion 211 is dimensioned to be slightly less than the inside diameter of large-diameter bore 40*a* (a large-diameter portion of sliding-contact bore 40).

Flow-passage portion 22 is formed into a substantially cylindrical hollow shape, but closed at one axial end. The end of the negative x-axis direction of flow-passage portion 22 is formed as an opening end. The end of the positive x-axis direction of flow-passage portion 22 is closed by the partition wall portion 23. In other words, the inner peripheral side of flow-passage portion 22 is formed as a substantially cylindrical bore 220 whose bottom (closed end) is the partition wall portion 23 (see FIG. 4).

Flow-passage portion 22 has a first groove 221 and a second groove 222, both formed in the outer periphery of flow-passage portion 22.

The first groove 221 is an annular groove (of a constant width in the x-axis direction) located to be slightly offset from the midpoint of flow-passage portion 22 toward the negative x-axis direction and formed around the entire circumference of flow-passage portion 22.

The second groove 222 is an annular groove (of a constant width of approximately one-third the width of the first groove 221 in the x-axis direction) located at the position sandwiched between the first groove 221 and the partition wall portion 23 and formed around the entire circumference of flow-passage portion 22.

The depths of first and second grooves 221 and 222 in the radial direction of spool 20 are approximately equal to each other.

A range within which first and second grooves 221-222 are formed, that is, the distance between the end of the positive x-axis direction of the first groove 221 and the end of the negative x-axis direction of the second groove 222 is dimensioned to be slightly less than the diameter of each of through holes 421-424 of housing 4 (flow-passage portion 42).

A plurality of circumferentially-equidistant spaced circular holes (four holes 223, 224, 225, and 226 in the shown embodiment) are further formed in the grooved portion of flow-passage portion 22 that the first groove 221 is formed. Each of holes 223-226 is formed as a through hole radially penetrating the inner and outer peripheries of flow-passage portion 22. Each of holes 223-226 is a communication hole that opens from the bottom (the inside groove surface) of the first groove 221 and also opens from the inner peripheral surface of cylindrical bore 220. In the shown embodiment, although flow-passage portion 22 has four through holes 223-226, it will be appreciated that the number of through holes is not limited to "4". The shape and the number of through holes may be modified.

The diameters of through holes 223-226 are dimensioned to be approximately equal to each other, and also dimensioned to be slightly less than the dimension of the first groove 221, measured in the x-axis direction, and also dimensioned to be a diameter slightly greater than one-half of the inside diameter of each of through holes 421-424 of housing 4.

A hole 227 is further formed in the grooved portion of flow-passage portion 22 that the second groove 222 is formed. Hole 227 is formed as a through hole radially penetrating the inner and outer peripheries of flow-passage portion 22. Hole 227 is a communication hole that opens from the bottom (the inside groove surface) of the second groove 222 and also opens from the inner peripheral surface of cylindrical bore 220. Hole 227 serves as an orifice (exactly, a fixed orifice). That is, through hole 227 is a flow-constriction orifice that intercommunicates the inner and outer peripheries of flow-passage portion 22 with a flow-constricting action. In the shown embodiment, although flow-passage portion 22 has one through hole 227, it will be appreciated that the number of a through hole is not limited to "1". The shape and configuration and the number of a through hole may be modified. For instance, two or more through holes (i.e., two or more flow-constriction orifices) may be formed to adjust a fluid-flow passage area (i.e., an orifice area) through an orifice constriction.

The diameter of through hole 227 is dimensioned to be less than the dimension of the second groove 222, measured in the x-axis direction, and also dimensioned to be approximately equal to one-fourth of the inside diameter of each of through holes 223-226.

The length of flow-passage portion 22 in the x-axis direction, that is, the distance between the end of the negative x-axis direction of flow-passage portion 22 and the end face of the negative x-axis direction of partition wall portion 23 is dimensioned to be less than the length of flow-passage portion 42 of housing 4 in the x-axis direction, and also dimensioned to be approximately equal to the length of annular groove 561 in the x-axis direction.

The outside diameter of the outer peripheral surface of flow-passage portion 22 is dimensioned to be slightly less than the inside diameter of small-diameter bore 40*b* (a small-diameter portion of sliding-contact bore 40).

(Installation State of Spool Valve)

Flanged portion 211 of spool 20 is slidably installed in back-pressure portion 41 of housing 4 so that the outer peripheral surface of flanged portion 211 slides in the x-axis direction with respect to the inner peripheral surface of large-diameter bore 40*a* (a large-diameter portion of sliding-contact bore 40).

Back-pressure portion 21 and flow-passage portion 22 of spool 20 are slidably installed in housing 4, so that the outer peripheral surface of back-pressure chamber 21 and flow-passage portion 22, except for the flanged portion 211 of spool 20, slides in the x-axis direction with respect to the inner peripheral surface of small-diameter bore 40*b* (a small-diameter portion of sliding-contact bore 40).

The first pressure chamber is defined by the inner peripheral surface of small-diameter bore 40*b* (a small-diameter portion of sliding-contact bore 40) and all sidewall surfaces of flow-passage portion 22, facing in the negative x-axis direction, whereas the second pressure chamber (i.e., a back-pressure chamber of spool 20) is defined by the inner peripheral surface of large-diameter bore 40*a* (a large-diameter portion of sliding-contact bore 40), the end face of the negative x-axis direction of threaded plug 413, and all sidewall surfaces of back-pressure portion 21, facing in the positive x-axis direction.

The first group of sidewall surfaces of flow-passage portion 22, facing in the negative x-axis direction, constructs a first pressure-receiving surface for receiving a hydraulic pressure (in the first pressure chamber) acting on the spool 20 from the side of the negative x-axis direction so as to force the spool 20 in the positive x-axis direction.

The second group of sidewall surfaces of back-pressure portion 21, facing in the positive x-axis direction, constructs a second pressure-receiving surface for receiving a hydraulic pressure (in the second pressure chamber) acting on the spool 20 from the side of the positive x-axis direction so as to force the spool 20 in the negative x-axis direction.

An area D1 of the first pressure-receiving surface is set or formed to be less than an area D2 of the second pressure-receiving surface by an area of the sidewall surface of flanged portion 211, facing in the positive x-axis direction, that is, $D1<D2$.

An annular space $\alpha 1$ is defined by the first groove 221 between the outer peripheral surface of flow-passage portion 22 and the inner peripheral surface of small-diameter bore 40*b* (a small-diameter portion of sliding-contact bore 40). In a similar manner, an annular space $\alpha 2$ is defined by the second groove 222 between the outer peripheral surface of flow-passage portion 22 and the inner peripheral surface of small-diameter bore 40*b*. Through holes 223-226, opening at the bottom (the inside groove surface) of the first groove 221, communicate the annular space α1, whereas through hole 227, opening at the bottom (the inside groove surface) of the second groove 222, communicates the annular space α2.

Rotary motion of spool 20 about the axis "Q" with respect to the sliding-contact bore 40 is not restricted. Sliding motion of spool 20 in the positive x-axis direction is restricted by abutment between the end face of the positive x-axis direction of spool 20 (flanged portion 211) and the end face of the negative x-axis direction of threaded plug 413 (see FIG. 4). The restricted position of spool 20 is hereinafter referred to as "position A". That is, the end face of the positive x-axis direction of spool 20 (flanged portion 211) and the end face of the negative x-axis direction of threaded plug 413 cooperate with each other to provide a first stopper (a sliding-motion stopper for spool 20 in the positive x-axis direction).

Also, sliding motion of spool 20 in the negative x-axis direction is restricted by abutment between the end face of the negative x-axis direction of spool 20 (flow-passage portion 22) and the inside face of bottom 425 of flow-passage portion 42 of housing 4, facing in the positive x-axis direction (see FIG. 5). The restricted position of spool 20 is hereinafter referred to as "opposite position B". That is, the end face of the negative x-axis direction of spool 20 (flow-passage portion 22) and the inside face of bottom 425 of flow-passage portion 42 of housing 4, facing in the positive x-axis direction, cooperate with each other to provide a second stopper (a sliding-motion stopper for spool 20 in the negative x-axis direction).

At the position "A" (see FIG. 4), back-pressure portion 21 of spool 20 is positioned within the back-pressure portion 41 of housing 4, whereas flow-passage portion 22 is positioned within the flow-passage portion 42 of housing 4 in a manner so as to almost accord with the annular groove 561 of unit mounting portion 56. As viewed in the radial direction of housing 4, at the position "A", the entire range of the grooved area of flow-passage portion 22, in which first and second grooves 221 and 222 are formed, is positioned to almost accord with the area of flow-passage portion 42 of housing 4, in which through holes 421-424 are formed. The end of the positive x-axis direction of the second groove 222 and the end of the positive x-axis direction of each of through holes 421-424 are positioned to almost accord with each other. The end of the negative x-axis direction of the second groove 222 is positioned to be slightly offset from the end of the negative x-axis direction of each of through holes 421-424 toward the positive x-axis direction.

At the position "A" (see FIG. 4), the volume of an annular space β defined between the outer peripheral surface of back-pressure portion 21 (and the end face of the negative x-axis direction of flanged portion 211) and the inner peripheral surface of large-diameter bore 40*a* (a large-diameter portion of sliding-contact bore 40) becomes maximum.

At the opposite position "B" (see FIG. 5), most of back-pressure portion 21 and flow-passage portion 22 are positioned within the flow-passage portion 42 of housing 4. As viewed in the radial direction of housing 4, at the opposite position "B", the entire range of the grooved area of flow-passage portion 22, in which the first groove 221 is formed, is positioned within the remaining area of flow-passage portion 42 of housing 4, in which through holes 421-424 are not formed. On the other hand, the entire range of the grooved area of flow-passage portion 22, in which the second groove 222 is formed, is positioned within the area of flow-passage portion 42 of housing 4, in which through holes 421-424 are formed. The end of the negative x-axis direction of the second groove 222 and the end of the negative x-axis direction of each of through holes 421-424 are positioned to almost accord with each other.

At the opposite position "B" (see FIG. 5), the volume of annular space β becomes minimum. The end of the negative x-axis direction of flanged portion 211 is positioned to be slightly offset from the end of the negative x-axis direction of the inward opening of oblique hole 412, which opens into the interior space of sliding-contact bore 40 through the inner peripheral surface of large-diameter bore 40*a*, toward the positive x-axis direction.

Depending on a change in the axial position of spool 20, arising from a sliding motion of spool 20 in the x-axis direction, the volume of annular space β changes (increases or decreases). Movement of air in and out of the annular space β, occurring as a result of the sliding motion of spool 20, can be smoothly achieved through the oblique hole 412, thus ensuring a smooth operation (a smooth sliding motion) of spool 20.

(Opening and Closing Action of Spool Valve)

In the shown embodiment, a plurality of circumferentially-equidistant spaced through holes (four through holes 421-424) are formed in housing 4. Additionally, annular groove 561 of unit mounting portion 56 is formed in a manner so as to surround the entire circumference of a portion of flow-passage portion 42 having through holes 421-424. Therefore, it is possible to more efficiently supply a large amount of oil from the supply passage 53*a* through the plurality of through holes 421-424 to the spool 20.

As previously discussed, in the shown embodiment, annular groove 561 is provided and formed in the engine block EB and flow-passage portion 42 of housing 4 has four through holes 421-424. In lieu thereof, annular groove 561 may be eliminated and also only the first through hole 421, opposed to the supply passage 53*a* in the y-axis direction, may be formed (in other words, the other three through holes 422-424 may be eliminated).

Through holes 223-226 of spool 20 and through holes 421-424 of housing 4 are configured such that fluid-communication between the first group of through holes 223-226 and the second group of through holes 421-424 can be established or blocked depending on the axial position of spool 20, arising from a sliding motion of spool 20 in the x-axis direction.

As viewed in the radial direction of housing 4, at an axial position of spool 20 that the first groove 221 of spool 20 and the through holes 421-424 overlap each other, for instance, at the position "A" (see FIG. 4), annular space α1 is communicated with the through holes 421-424, and thus fluid-communication between the first group of through holes 223-226 and the second group of through holes 421-424 is established. Hence, even when the first group of through holes 223-226 of the spool side and the second group of through holes 421-424 of the housing side do not overlap each other in the circumferential direction owing to rotary motion of spool 20 (flow-passage portion 22) about the axis "Q" with respect to the sliding-contact bore 40 (in other words, with respect to the flow-passage portion 42 of spool valve body 4*a* of housing 4), by virtue of the first groove 221 (in other words, annular space α1), fluid-communication between the first group of through holes 223-226 and the second group of through holes 421-424 cannot be blocked. Therefore, at the overlapping position of the first groove 221 and through holes 421-424, it is possible to reliably intercommunicate the first group of through holes 223-226 and the second group of through holes 421-424, regardless of the presence or absence of rotary motion of spool 20 about the axis "Q" with respect to the sliding-contact bore 40. Additionally, by the formation of the plurality of through holes 223-226 and the plurality of through holes 421-424, is possible to increase the total opening area (i.e., the total flow passage area), thus enabling a large amount of oil to be more efficiently supplied from the second group of through holes 421-424 via the first group of through holes 223-226 to the inner peripheral side of spool 20.

Instead of forming the first groove 221 in the flow-passage portion 22 of spool 20, the number and shape of through holes 223-226 and/or the number of shape of through holes 421-424 may be properly modified, such that, at least at the position "A", fluid-communication between the first group of through holes 223-226 and the second group of through holes 421-424 can be established even if spool 20 is positioned in any rotation position with respect to sliding-contact bore 40.

By the way, the second group of through holes 421-424 always communicates the annular groove 561 of unit mounting portion 56. Hence, at the overlapping position of the first groove 221 and through holes 421-424, the first group of through holes 223-226 can be communicated with the supply passage 53*a*, which opens into the annular groove 561. That is, at the overlapping position, the first group of through holes 223-226 serves as a communication portion intercommunicating the supply passage 53*a* and the inner peripheral side of spool 20. The inner peripheral side (the first pressure chamber) of flow-passage portion 22, into which the through holes 223-226 open, always communicates the supply passage 53*b* via the through hole 420.

Thus, at the overlapping position at which the first groove 221 of spool 20 and the through holes 421-424 overlap each other, supply passage 53*a* can be communicated with supply passage 53*b* via the through holes 223-226.

In contrast, at a non-overlapping position at which the first groove 221 and the through holes 421-424 do not overlap each other, for instance, at the opposite position "B" (see FIG. 5), annular space α1 is not communicated with the through holes 421-424, and thus there is no fluid-communication between the first group of through holes 223-226 and the second group of through holes 421-424. As a result, fluid-communication between supply passages 53*a* and 53*b* via the through holes 223-226 is blocked.

As viewed in the radial direction of housing 4, an area of the first groove 221, which opens into the through holes 421-424, in other words, a flow-passage area that annular space α1 is communicated with the through holes 421-424 becomes maximum at the position "A". Roughly speaking, the flow-passage area tends to gradually reduce, as the spool 20 moves (slides) in the negative x-axis direction from the position "A", in other words, as the annular space α1 moves in the negative x-axis direction with respect to the through holes 421-424. More concretely, immediately after a first intermediate position "A1" of spool 20 has been reached with spool 20 sliding in the negative x-axis direction from the position "A", the flow-passage area becomes less than the total opening area of through holes 223-226, which open into the first groove 221, in other words, a flow-passage area that the annular space α1 always communicates the through holes 223-226. Thereafter, from a second intermediate position "B1" of spool 20 immediately before the opposite position "B", the flow-passage area becomes zero. Within a range of sliding motion of spool 20 between the second intermediate position "B1" and the opposite position "B", the flow-passage area remains kept at zero.

Hence, regarding the flow passage by way of the through holes 223-226, within a range of sliding motion of spool 20 between the position "A" and the second intermediate position "B1", fluid-communication between two supply passages 53*a*-53*b* can be established. Conversely, within a range of sliding motion of spool 20 between the second intermediate position "B1" and the opposite position "B" (because of zero-overlapping of the first group of through holes 223-226 and the second group of through holes 421-424), fluid-communication between two supply passages 53*a*-53*b* can be blocked. Within a range of sliding motion of spool 20 from the first intermediate position "A1" to the second intermediate position "B1", the flow-passage area by way of the through holes 223-226 tends to gradually reduce (because of gradual overlapping of the first group of through holes 223-226 and the second group of through holes 421-424), as the spool 20 moves in the negative x-axis direction from the first intermediate position "A1".

In this manner, by an axial displacement of spool 20, it is possible to perform switching between the established (enabled) state and the blocked (disabled) state of fluid-communication between two supply passages 53*a*-53*b* by way of through holes 223-226.

On the other hand, through hole (orifice) 227 of spool 20 is configured to always communicate the through holes 421-424 of housing 4, regardless of the axial position of spool 20.

That is, as viewed in the radial direction of housing 4, regardless of the axial position of spool 20, the grooved area of flow-passage portion 22, in which the second groove 222 is formed, is positioned within the area of flow-passage portion 42, in which through holes 421-424 are formed, in a manner so as to always communicate the annular space α2. Thus, regardless of the axial position of spool 20, the second group of through holes 421-424 and through hole 227 always communicate each other. Hence, even when the through hole 227 and the second group of through holes 421-424 do not overlap each other in the circumferential direction owing to rotary motion of spool 20 about the axis "Q" with respect to the sliding-contact bore 40, by virtue of the second groove 222 (in other words, annular space α2), fluid-communication between the through hole 227 and the second group of through holes 421-424 cannot be blocked. Therefore, regardless of the axial displacement of spool 20, the through hole 227 always opens into the annular groove 561 (supply passage 53*a*), and thus supply passages 53*a* and 53*b* are communicated with each other by way of the through hole 227.

By the way, a flow-passage area that the second group of through holes 421-424 is communicated with the annular space α2 varies depending on the axial displacement of spool 20 in the x-axis direction. The flow-passage area is configured to be greater than an area of the through hole 227, which opens into the second groove 222, (i.e., a flow-passage area that annular space α2 is communicated with the through hole 227). In other words, the flow-passage area of the oil flow path, directed from the supply passage 53*a* via the through hole 227 to the supply passage 53*b*, becomes minimum at the through hole (orifice) 227, regardless of the axial position of spool 20. That is, the oil flow is constricted by means of the through hole (orifice) 227.

Therefore, within a range of axial displacement (sliding motion) of spool 20 from the position "A" (see FIG. 4) to the opposite position "B" (see FIG. 5), the flow-passage area of the oil flow path, directed from the supply passage 53*a* through the annular groove 561, through holes 421-424 and through holes 223-227 to the inner peripheral side (the first pressure chamber) of flow-passage portion 22, becomes a maximum value (i.e., a summed value of the opening area of through holes 223-226, opening into the first groove 221, and the opening area of through hole 227, opening into the second groove 222) at the position "A". Within a range of axial displacement (sliding motion) of spool 20 from the position "A" to the first intermediate position "A1", the flow-passage area remains kept maximum. As the spool 20 shifts from the first intermediate position "A1" to the second intermediate position "B1", the flow-passage area gradually decreases with a change in opening area (orifice area) of through holes 223-226 (serving as a variable orifice configuration). Within a range of axial displacement (sliding motion) of spool 20 from the second intermediate position "B1" to the opposite position "B", the flow-passage area becomes a minimum value, corresponding to the opening area of the through hole 227, opening into the second groove 222, by a maximum flow-constricting orifice action of through hole 227 (serving as a fixed orifice configuration).

Owing to the throttled (constricted) flow-passage area, the flow rate of oil flowing to the downstream side (i.e., supply passage 53*b*) tends to decrease. Assuming that the flow rate of oil, fed into the upstream supply passage 53*a*, is constant, the flow rate of oil, fed into the branch passage 54, tends to increase by the decreased flow rate of oil flowing to the downstream supply passage 53*b*.

At the position "A", the flow rate of oil, fed from the supply passage 53*a* via the spool valve 2 to the supply passage 53*b*, becomes maximum.

In contrast, at the opposite position "B", oil, fed from the supply passage 53*a* via the spool valve 2 to the supply passage 53*b*, is limited to oil, flowing via only the through hole (orifice) 227. Thus, at the opposite position "B", the flow rate of oil, flowing through the downstream supply passage 53*b*, becomes minimum. That is, most of oil (except for oil flowing via the through hole 227 to the supply passage 53*b*), fed from pump P into supply passage 53*a*, is delivered into the branch passage 54.

(Control System Configuration)

Control valve apparatus 1 is configured to selectively switch one of the position "A" and the opposite position "B" to the other by an electrical signal output from controller CU to pilot valve (electromagnetic solenoid valve) 3. That is, an axial displacement of spool 20 occurs responsively to a control signal input into the pilot valve 3, and then switching between a full fluid-communication state of supply passages 53*a*-53*b* (i.e., the position "A" of FIG. 4) and a maximum flow-constriction state (i.e., the opposite position "B" of FIG. 5) is made. In this manner, the flow rate of oil, fed into the downstream supply passage 53*b*, can be adjusted or controlled responsively to a control signal from controller CU to pilot valve 3.

The hydraulic pressure in the first pressure chamber, acts on each surface of the sidewall surfaces of flow-passage portion 22 of spool 20, all facing in the negative x-axis direction, namely, on the first pressure-receiving surface. This hydraulic pressure, acting on the first pressure-receiving surface, creates a first force F1 that forces or biases spool 20 in the positive x-axis direction. Conversely, the hydraulic pressure in the second pressure chamber, acts on each surface of the sidewall surfaces of back-pressure portion 21 of spool 20, all facing in the positive x-axis direction, namely, on the second pressure-receiving surface. This hydraulic pressure, acting on the second pressure-receiving surface, creates a second force F2 that forces or biases spool 20 in the negative x-axis direction.

As previously discussed, the area D1 of the first pressure-receiving surface is set to be less than the area D2 of the second pressure-receiving surface, that is, D1<D2. For the same hydraulic pressure, acting on each of the first and second pressure-receiving surfaces, the first force F1 is less than the second force F2. Hence, the sliding force, produced as a result of the force difference (F2–F1) between the second force F2 acting in the negative x-axis direction and created by hydraulic pressure on the second pressure-receiving surface of the area D2 and the first force F1 acting in the positive x-axis direction and created by hydraulic pressure on the first pressure-receiving surface of the area D1, acts on spool 20 so as to force the spool 20 in the negative x-axis direction.

The hydraulic pressure in the first pressure chamber is approximately equal to the hydraulic pressure in supply passage 53*b*. At least at the position "A", the hydraulic pressure in a portion of supply passage 53*a* downstream of the branched point 530 and the hydraulic pressure in supply passage 53*b* can be regarded as to be approximately equal to each other. Thus, the hydraulic pressure in the first pressure chamber can also be regarded as to be approximately equal to the hydraulic pressure in a portion of supply passage 53*a* downstream of the branched point 530.

When a signal "A" is outputted from controller CU to pilot valve 3, the pilot valve 3 operates to connect the second pressure chamber to the oil pan O/P (that is, to the atmosphere), thus realizing a state where the hydraulic pressure in supply passage 53*b* acts on only the first pressure-receiving surface. Hence, by the first force F1, spool 20 is forced in the positive x-axis direction (i.e., in a direction that increases the flow-passage area of the flow path defined by flow passages 53*a*→561→421-424→223-227→22). In this manner, the position "A" can be realized.

Conversely when a signal "B" is outputted from controller CU to pilot valve 3, the pilot valve 3 operates to connect a portion of supply passage 53*a* downstream of the branched point 530 to the second pressure chamber, thus realizing a state where a hydraulic pressure approximately equal to the hydraulic pressure in supply passage 53*b* (or the hydraulic pressure in supply passage 53*a*) acts on both the first and second pressure-receiving surfaces. Hence, by a force corresponding to the difference (F2–F1) between the second force F2 and the first force F1, spool 20 is forced in the negative x-axis direction (i.e., in a direction that decreases or throttles the flow-passage area of the flow path defined by flow passages 53*a*→561→421-424→223-227→22). In this manner, the position "B" can be realized.

More concretely, when a signal "A" (i.e., an OFF signal) is outputted from controller CU to pilot valve 3, the solenoid 34 of pilot valve 3 becomes de-energized. Thus, ball 31, which is forced in the negative y-axis direction by the spring force of spring 32, acts to block fluid-communication between axial passage 301 and relay passage 302. Simultaneously, the sealing surface of armature 33 moves apart from the sealing surface formed in the opening of the negative y-axis direction of relay passage 304, and as a result fluid-communication between relay passages 304-305 is established. Hence, oil in a portion of supply passage 53*a* downstream of the branched point 530 is not fed into the second pressure chamber. Also, oil in the second pressure chamber is drained through the axial passage 442, relay passages 303-305, and the exhaust passage (not shown) to the oil pan O/P. Thus, the hydraulic pressure in the second pressure chamber drops to a pressure level substantially corresponding to atmospheric pressure. Owing to the hydraulic pressure acting on the second pressure-receiving surface, remarkably less than the hydraulic pressure acting on the first pressure-receiving surface, the first force F1 becomes greater than the second force F2. As a result of this, spool 20 is forced in the positive x-axis direction, thus realizing the position "A".

In contrast, when a signal "B" (i.e., an ON signal) is outputted from controller CU to pilot valve 3, the solenoid 34 of pilot valve 3 becomes energized. Thus, armature 33 moves in the positive y-axis direction against the spring force of spring 32 by a magnetic force. Hence, ball 31 moves apart from the opening of the positive y-axis direction of relay passage 302, and as a result fluid-communication between axial passage 301 and relay passage 302 is established. Simultaneously, the sealing surface of armature 33 is brought into abutted-engagement with the sealing surface formed in the opening of the negative y-axis direction of relay passage 304, and as a result fluid-communication between relay passages 304-305 is blocked. Hence, oil in a portion of supply passage 53*a* downstream of the branched point 530 is fed into the second pressure chamber through radial passage 443, axial passage 301, relay passage 303 and axial passage 442. Also, oil in the second pressure chamber is not drained through the relay passages (e.g., relay passage 304) to the oil pan O/P. Thus, the hydraulic pressure in the second pressure chamber becomes approximately equal to the hydraulic pressure in a portion of supply passage 53*a* downstream of the branched point 530. Owing to the hydraulic pressures acting on the first and second pressure-receiving surfaces, approximately equal to each other, the second force F2 becomes greater than the first force F1. As a result of this, spool 20 is forced in the negative x-axis direction, thus realizing the opposite position "B".

In the first embodiment, the signal "A" inputted to pilot valve 3 is an OFF (de-energization) signal, whereas the signal "B" inputted to pilot valve 3 is an ON (energization) signal. The control valve apparatus of the first embodiment is configured so that the axial position of spool 20 can be selectively shifted from one of two different positions (namely, the position "A" and the opposite position "B") to the other.

Controller CU is configured to output the signal "A" to the pilot valve 3 for a predetermined time delay T (a set time of a delay timer incorporated in controller CU) after the engine has been started from its stopped state. Hereby, the position "A" of spool valve 2 is realized, and thus a flow rate of oil flowing through a portion of supply passage 53 downstream of branched point 530, concretely, a flow rate of oil flowing through the supply passage 53*b* can be controlled to a large flow-rate side of a variable flow-rate range, more concretely, a maximum flow rate.

Controller CU is further configured to output the signal "B" to the pilot valve 3, immediately when the predetermined time delay T has expired. Hereby, the opposite position "B" of spool valve 2 is realized, and thus a flow rate of oil flowing through the supply passage 53*b* can be controlled to a small flow-rate side of the variable flow-rate range, more concretely, a minimum flow rate.

After the VTC device has been started, that is, after phase-control (valve timing control) for a relative phase of vane member 6 (the camshaft side) to housing HSG (the crankshaft side) has been started responsively to a control current generated from controller CU to the solenoid SOL of directional control valve 59, controller CU carries out switching action between the signal "A" (an OFF signal of solenoid 34) and the signal "B" (an ON signal of solenoid 34) appropriately depending on latest up-to-date information about the engine operating condition (e.g., the current engine load and the current valve-timing control state). Hereby, the throttled (constricted) state of the flow path, through which supply passages 53*a*-53*b* are communicated with each other, can be adjusted, and thus the flow rate of oil flowing through the supply passage 53*b* and the flow rate of oil flowing through the branch passage 54 can be controlled.

During a stopping period of the engine, controller CU outputs the signal "A" to the pilot valve 3 before rotation of the engine (in other words, rotation of pump P) stops such that the axial position of spool 20 can be shifted to the position "A" (that is, a large flow-rate side of the variable flow-rate range).

The previously-discussed predetermined time delay T is a parameter that is required to estimate or determine whether a hydraulic pressure in supply passage 53*b*, communicating each of lubricated engine parts, becomes higher than or equal to a predetermined pressure value P0 after the engine has been started. The predetermined pressure value P0 is a measure of a minimum required hydraulic pressure that oil has been delivered around the entire length of supply passage 53*b* and oil has been distributed to each of lubricated engine parts to such an extent that a minimum smooth operation (rotary motion and/or sliding motion) of each of the moving engine parts can be ensured. The predetermined pressure value P0 varies depending on the type and specification of internal combustion engine.

A time period before a hydraulic pressure in supply passage 53*b* actually reaches the predetermined pressure value P0 (for example, with the engine at an idle rpm) after an engine startup, is experimentally measured in advance. The experimentally measured time period may be used as the predetermined time delay T. Instead of using the experimentally measured time period, the predetermined time delay T may be calculated or derived from various design data.

In order to enhance the accuracy of estimation on whether the predetermined pressure value P0 has been reached after the engine has been started, it is preferable to compensate for the predetermined time delay T in accordance with a change in temperature of working/lubricating oil. Generally, the higher the oil temperature, the lower the viscosity. In the case of low oil temperatures, the viscosity is high, and thus oil supply to each of lubricated engine parts tends to become slow, and a hydraulic pressure rise in supply passage 53*b* tends to become slow. Conversely, in the case of high oil temperatures, the viscosity is low, and thus oil supply to each of lubricated engine parts tends to become quick, and a hydraulic pressure rise in supply passage 53*b* tends to become quick.

In the first embodiment, fully taking into account working/lubricating oil characteristics (especially a viscosity change arising from an oil temperature change), the predetermined time delay T is compensated based on the oil temperature. Concretely, in the case of low oil temperatures, the predetermined time delay T is lengthened, as compared to high oil temperatures. The oil temperature may be detected directly by an oil temperature sensor attached to the engine, or estimated based on information from the engine temperature sensor (i.e., the engine coolant temperature sensor, generally installed on the automotive vehicle). In this manner, by optimizing the predetermined time delay T, it is possible to more accurately estimate or determine whether the predetermined pressure value P0 has been reached after the engine has been started from its stopped state and then oil has been distributed to each of lubricated engine parts sufficiently.

[Operation of First Embodiment]

(Enhanced Lubrication Performance During Engine Startup)

The engine-startup period enhanced lubrication performance of control valve apparatus 1 of the first embodiment is hereunder described, while comparing with the apparatus as disclosed in JP57-173513 (hereinafter referred to as "comparative example").

As previously described, the hydraulic system of the apparatus as disclosed in the comparative example, includes a main fluid flow passage that interconnects an oil pump and a main oil gallery for feeding oil to each of lubricated engine parts and a branch passage branched from the main flow passage for feeding oil to a hydraulic actuator (e.g., a hydraulically-operated variable valve timing control device).

In the case of the comparative example, a working oil pressure, required for driving the hydraulic actuator, is delivered from the branch passage. Thus, when there is a demand of the more enhanced responsiveness of the hydraulic actuator, a capacity (a discharge) of an oil pump has to be increased.

Thus, in the hydraulic system of the comparative example, a control valve apparatus, whose valve can be automatically opened when a hydraulic pressure exceeding a predetermined pressure level acts thereon, is disposed in the main flow passage downstream of a branched point of the branch passage from the main flow passage, for controlling a flow rate of oil flowing through the main flow passage downstream of the branched point. More concretely, when the discharge pressure of the oil pump is low, the valve is closed and as a result oil can be preferentially fed into the hydraulic actuator via the branch passage. Conversely when the discharge pressure of the oil pump is high, the valve is opened with the result that a flow rate of oil flowing through the main flow passage into the main oil gallery can be increased.

However, in the case of the hydraulic system configuration of the comparative example, during an engine startup period that the discharge pressure of the oil pump is low, most of oil cannot be fed into a portion of the main flow passage downstream of the branched point of the branch passage. That is, there might be a lack of oil to be supplied to moving (rotating/sliding) parts of an internal combustion engine requiring lubrication.

In more detail, in the case of the vehicle (the engine) was left for a long time after the engine has been stopped, the engine is in a state where oil has already fell from engine sliding parts and engine rotating parts requiring lubrication, for example, journals and bearings for a crankshaft, a connecting rod, a piston pin, a camshaft and the like, into an oil pan. That is, oil does not stay sufficiently in these lubricated engine parts anymore. Under these conditions, when the engine is started by turning the ignition key ON, there is a time difference between a point of time of the engine startup and a point of time when the pressurized oil, discharged from the oil pump, is fed into each of lubricated engine parts sufficiently. Thus, for such a time difference, the lubricated engine parts cannot be smoothly operated due to an increased friction, arising from a lack of lubrication (or non-lubrication).

In contrast, in the case of control valve apparatus 1 of the first embodiment, a flow path, through which supply passages 53*a*-53*b* are communicated with each other, is controlled to a fully-open state (i.e., a large flow-rate side of a variable flow-rate range), until the predetermined time delay T has expired (in other words, until the hydraulic pressure in supply passage 53*b* becomes greater than or equal to the predetermined pressure value P0) after the engine has been started from its stopped state. Hereby, most of oil, discharged and force-fed from pump P to supply passage 53*a*, can be preferentially fed into supply passage 53*b* (i.e., toward lubricated engine parts) rather than branch passage 54 (i.e., toward the VTC device). Thus, an appropriate amount of oil, needed for a smooth operation of each of lubricated engine parts, can be preferentially fed into supply passage 53*b*. Therefore, even under a state where the vehicle (the engine) was left for a long time after the engine has been stopped, it is possible to rapidly feed oil to each of lubricated engine parts after a startup of the engine. Thus, it is possible to shorten a time length during which each of lubricated engine parts is operating (rotating/sliding) with a lack of lubrication. In particular, according to the control valve apparatus of the first embodiment, the opening degree of the flow path, through which supply passages 53*a*-53*b* are communicated with each other, can be controlled to a maximum value and hence the flow rate of oil flowing through supply passage 53*b* can be controlled to a maximum possible flow rate, within the predetermined time delay T. Thus, it is possible to more greatly enhance the operation and effect of the control valve apparatus, especially, a lubrication performance during an engine startup.

(Enhancement of Startability of VTC)

On the other hand, the VTC device is operated by a hydraulic pressure in branch passage 54. Suppose that the flow path between supply passages 53*a*-53*b* remains kept open. In such a case, oil supply to branch passage 54 (i.e., oil supply to the VTC device) becomes insufficient. Hence, the control valve apparatus of the first embodiment switches the axial position of spool 20 from the position "A" to the opposite position "B" upon expiration of the predetermined time delay T after the engine has been started from its stopped state. Thus, the flow path between supply passages 53*a*-53*b* becomes shifted from a full fluid-communication state to a maximum flow-constriction state. Hereby, most of oil, discharged and force-fed from pump P to supply passage 53*a*, can be preferentially fed into branch passage 54 (i.e., toward the VTC device) rather than supply passage 53*b* (i.e., toward lubricated engine parts). Therefore, it is possible to enhance the responsiveness (the startability) of the VTC device after the engine has been started. In particular, according to the control valve apparatus of the first embodiment, the opening degree of the flow path, through which supply passages 53*a*-53*b* are communicated with each other, can be controlled to a minimum value and hence the flow rate of oil flowing through supply passage 53*b* can be controlled to a minimum possible flow rate, in other words, the flow rate of oil flowing through the branch passage 54 can be controlled to a maximum value, upon expiration of the predetermined time delay T. Thus, it is possible to more remarkably enhance the operation and effect of the control valve apparatus, especially, the startability (the responsiveness) of the VTC device after the engine has been started.

At this time, even with the flow path kept in the maximum flow-constriction state, oil can be fed via only the through hole 227 formed in spool 20 to supply passage 53*b*. The flow rate of oil, flowing via only the through hole 227 to supply passage 53*b*, is a flow rate equal to or slightly greater than a minimum flow rate needed to lubricate moving engine parts.

(Stability of Operation of VTC)

Oil, discharged from pump P immediately after an engine startup, tends to include air (a lot of air bubbles). Suppose that oil, including a lot of air bubbles, is fed to the VTC device. Owing to air bubbles included in the discharged oil, there is a possibility that the operation of the VTC device becomes unstable.

First, when this kind of oil (including a lot of air bubbles) is utilized as the working oil for the VTC device, a change in volume of working oil occurs easily. Thus, it is difficult to accurately control a relative phase of vane member 6 (the camshaft side) to housing HSG (the crankshaft side). For instance, when alternating torque (in other words, positive and negative torque fluctuations) acts on camshaft 65 (vane member 6), air bubbles included in oil in each of working oil chambers are expanded and contracted. Owing to such expansion and contraction of air bubbles, an unintended volume change of each of working oil chambers occurs. This leads to the task that it is difficult to accurately control a relative phase of vane member 6 to housing HSG to a desired phase. The task is hereinafter referred to as "a first task".

Secondly, in the case of the VTC device employing a hydraulically-operated lock mechanism (see lock mechanism 7 shown in FIG. 1), there is a possibility that the lock mechanism is erroneously released (unlocked) by a hydraulic pressure of oil, including a lot of air bubbles immediately after an engine startup, and thus the engine valve timing cannot be held at the desired timing value (i.e., the maximum phase-retard position of vane member 6 shown in FIG. 2) during the engine startup period. Especially, in the lock mechanism further employing disengaging (unlocking) oil passages (see communication hole 75 and communication groove 76 shown in FIGS. 2-3) through which hydraulic pressure can be supplied to the lock mechanism before the VTC device comes into operation, there is an increased tendency for the lock mechanism to be erroneously released (unlocked). The task is hereinafter referred to as "a second task".

[Regarding the First Task]

For instance, suppose that a control current, corresponding to a phase-advance command, has been outputted from controller CU to the solenoid SOL of directional control valve 59 for phase-shifting vane member 6 to the phase-advance side at an early stage after the engine has been started. In such a case, there is a possibility that a lot of air bubbles are included in oil discharged from pump P and thus fed to phase-advance chambers A1-A4. It is possible to shift the lock mechanism to its unlocked state by oil (including air bubbles) delivered from the first phase-advance chamber A1 via the communication groove 76 of lock mechanism 7 to the second pressure-receiving chamber 78 (the engaging concavity 730). However, it is difficult to intendedly change or maintain the volume of each of phase-advance chambers A1-A4 without being affected by alternating torque, utilizing the oil including a lot of air bubbles. That is, there is a possibility that an intended increase in volume of each of phase-advance chambers A1-A4 does not occur due to contraction of air bubbles included in the oil.

In contrast to the above, in the case of control valve apparatus 1 of the first embodiment, a flow path, through which supply passages 53*a*-53*b* are communicated with each other, is controlled to a fully-open state (i.e., a large flow-rate side of a variable flow-rate range), until the predetermined time delay T has expired (in other words, until the hydraulic pressure in supply passage 53*b* becomes greater than or equal to the predetermined pressure value P0) after the engine has been started. Hereby, most of oil, discharged and force-fed from pump P, can be preferentially fed into supply passage 53*b* (i.e., toward lubricated engine parts) rather than branch passage 54 (i.e., toward the VTC device).

Thus, first of all, oil including a lot of air bubbles during the engine starting period can be delivered toward lubricated engine parts. Many apertures and/or clearance spaces exist in the side of lubricated engine parts. Hence, air included in the recirculating oil can be exhausted through the apertures and/or clearance spaces of the side of lubricated engine parts. The amount of air bubbles included in the recirculating oil tends to reduce, until the predetermined time delay T has expired (in other words, until the hydraulic pressure in supply passage 53*b* becomes greater than or equal to the predetermined pressure value P0) after the engine has been started.

Hence, after the predetermined time delay T has expired, the oil, which hardly includes air bubbles, can be preferentially fed into the working oil chambers of the VTC device. Even when a phase-advance command has been generated from controller CU at an early stage after the engine has been started, the amount of air included in working oil fed into each of phase-advance chambers A1-A4 is less and thus it is possible to more accurately control a relative phase of vane member 6 to housing HSG to a desired phase. This ensures a stable phase-shifting action of the VTC device.

In particular, according to the control valve apparatus of the first embodiment, the opening degree of the flow path, through which supply passages 53*a*-53*b* are communicated with each other, can be controlled to a maximum value and hence the flow rate of oil flowing through supply passage 53*b* can be controlled to a maximum possible flow rate, within the predetermined time delay T. Thus, it is possible to more remarkably enhance the operation and effect of the control valve apparatus, especially, the accuracy of rotational position control of vane member 6 relative to housing HSG.

The above-mentioned first task that the operation of a hydraulic actuator (e.g., a hydraulically-operated rotary vane type VTC device) becomes unstable due to oil including a lot of air bubbles immediately after an engine startup, is not limited to such a rotary vane type VTC device. The first task fits another type of hydraulic actuator. It will be appreciated that control valve apparatus 1 of the first embodiment can be applied to another type of hydraulic actuator, so as to solve the first task.

[Regarding the Second Task]

First, the second task is hereunder explained in the VTC device of the first embodiment.

Lock mechanism 7 of the VTC device of the first embodiment has a dual disengaging (unlocking) oil passage structure, namely, a phase-retard side unlock oil passage (i.e., communication hole 75) and a phase-advance side unlock oil passage (i.e., communication groove 76). Of these unlock oil passages, communication hole 75 always gets a supply of unlocking hydraulic pressure before a startup of the VTC device (that is, before a control current output to the solenoid SOL of directional control valve 59).

In more detail, communication hole 75 is formed in the first blade 61. When the engine has been started (that is, when oil has begun to be supplied to phase-retard chambers R1-R4 by rotation of pump P) but the VTC device has not yet been started with the lock mechanism still held at its locked state, oil in the first phase-retard chamber R1 can be fed through the communication hole 75 to the first pressure-receiving chamber 77.

On the other hand, a spring characteristic (e.g., a spring stiffness) of coil spring 74, functioning as a locked-state holding mechanism, is set or determined so that coil spring 74 begins to be compressed so as to move the head portion 714 of lock piston 71 out of engagement with the engaging concavity 730 of rear plate 9, when a hydraulic pressure (≈ a hydraulic pressure in branch passage 54) of oil, which is fed from the branch passage 54 into the first phase-retard chamber R1 and with which the first pressure-receiving chamber 77 as well as the first phase-retard chamber R1 is filled, becomes greater than or equal to the specified pressure value P1. Also, the spring stiffness (i.e., the spring force) of coil spring 74 is set or designed to such an extent that there is a less compressed deformation of coil spring 74 and thus lock piston 71 cannot be disengaged from the engaging concavity 730 even when air, prevailing in each of phase-retard chambers R1-R4, is compressed by oil, force-fed from pump P to the first phase-retard chamber R1, and then the large-diameter portion 712 of sliding portion 710 is pushed by the compressed air in the first pressure-receiving surface 77.

Thus, in the case of the oil, which hardly includes air bubbles, the locked (engaged) state of lock mechanism 7 remains unchanged and the relative angular phase of vane member 6 of the VTC device is held at an initial phase (i.e., the maximum phase-retard position), until the hydraulic pressure delivered to the lock mechanism 7 for unlocking, that is, until the hydraulic pressure in branch passage 54 becomes greater than or equal to the specified pressure value P1.

Suppose that the flow path between supply passages 53*a*-53*b* is throttled (constricted) immediately after an engine startup (in other words, before a hydraulic pressure in supply passage 53*b* becomes greater than or equal to the predetermined pressure value P0). In such a case, the flow rate of oil fed to the branch passage 54 tends to increase, and thus oil, including a lot of air bubbles immediately after the engine startup, is undesirably fed to the working oil chambers of the VTC device. At this time, as a matter of course, oil, with which the first pressure-receiving chamber 77 as well as the first phase-retard chamber R1 is filled, includes a lot of air bubbles. Thus, there is a possibility that lock piston 71 is undesirably pushed in the unlocking direction owing to expansion of air bubbles included in the first pressure-receiving chamber 77 and thus lock mechanism 7 is erroneously released (unlocked). Especially, when a time interval between the previous engine stopping action and the current engine startup is short, for instance, when the engine is restarted after an idle-stop action, oil of a comparatively low oil temperature, delivered from oil pan O/P by pump P, is supplied into the first pressure-receiving chamber 77 as well as the first phase-retard chamber R1 of the VTC device of a comparatively high temperature, and thus the supplied oil is warmed. As a result, there is a possibility that the lock mechanism is erroneously released due to expansion of air bubbles included in the supplied oil.

In contrast, in the case of control valve apparatus 1 of the first embodiment, a flow path, through which supply passages 53*a*-53*b* are communicated with each other, is controlled to a fully-open state (i.e., a large flow-rate side of a variable flow-rate range), for the predetermined time delay T after the engine has been started. Hereby, a hydraulic pressure rise in the side of the VTC device becomes moderate. Thereafter, that is, upon expiration of the predetermined time delay T, the oil, which hardly includes air bubbles, can be preferentially fed into the working oil chambers of the VTC device by throttling or constricting the oil flow path by a flow-constricting orifice action of control valve apparatus 1 (in particular, by a maximum flow-constricting orifice action of through hole (orifice) 227).

Therefore, even when the VTC device employing a hydraulically-operated lock mechanism is adopted as a hydraulic actuator, it is possible to suppress an erroneous release of the lock mechanism.

It is preferable to set the specified pressure value P1 to a value greater than the predetermined pressure value P0, that is, P1>P0, from a viewpoint that lubricating action for each of lubricated engine parts has to be more certainly achieved before the VTC device comes into operation, and also from a viewpoint that an erroneous release of the hydraulically-operated lock mechanism has to be more certainly suppressed.

Conversely, the specified hydraulic pressure value P1 may be set to a value less than the predetermined pressure value P0, that is, P1<P0. In this case, the lock mechanism can be released at an earlier time rather than setting of P1>P0. The setting of P1<P0 is advantageous to enhance the responsiveness of the VTC device after an engine startup. Also, in the case of the setting of P1<P0, the erroneous release of the lock mechanism can be suppressed to a certain extent. That is, under a state where the flow path, through which supply passages 53*a*-53*b* are communicated with each other, is kept fully open, most of oil, discharged and force-fed from pump P to supply passage 53*a* and including a lot of air bubbles, preferentially flows into supply passage 53*b* rather than branch passage 54. At a point of time when the lock mechanism is released by the hydraulic pressure in branch passage 54, most of oil, including a lot of air bubbles, has already been fed to supply passage 53*b* and thus most of air bubbles included in the recirculating oil have been already exhausted through the apertures and/or clearance spaces of the side of lubricated engine parts. Thus, at this point of time, air bubbles included in oil fed to the lock mechanism have already been reduced to a certain extent.

Furthermore, the specified pressure value P1 and the predetermined pressure value P0 may be set to the same value. In such a case, several effects, in other words, contradictory requirements, namely, an enhanced lubrication performance during an engine starting period, an enhanced startability of the VTC device, a stable operation of the VTC device, and a suppression of an erroneous release of the lock mechanism, can be balanced to each other.

As a modified lock mechanism, a hydraulically-operated lock mechanism having a single disengaging (unlocking) oil passage structure, which structure does not include an unlock oil passage (e.g., communication hole 75) always getting a supply of unlocking hydraulic pressure before a startup of the VTC device, may be used. In such a case, there is a less supply of unlocking hydraulic pressure to the lock mechanism before a startup of the VTC device, but there is a possibility that the lock mechanism is erroneously released, for the reasons discussed below.

As an example of the modified lock mechanism having a single disengaging oil passage structure, suppose that the phase-retard side unlock oil passage (i.e., communication hole 75) communicating phase-retard chamber R1 is eliminated and only the phase-advance side unlock oil passage (i.e., communication groove 76) communicating phase-advance chamber A1 is provided. In this modified hydraulically-operated lock mechanism, oil, including a lot of air bubbles, is fed to the first phase-retard chamber R1, under a state where the engine has been started (that is, when oil has begun to be supplied to phase-retard chambers R1-R4 by rotation of pump P) but the VTC device has not yet been started with the lock mechanism still held at its locked state. Thereafter, air, included in the oil fed to the first phase-retard chamber R1, is expanded, and then flows toward both ends of lock piston 71, facing in the two opposite X-axis directions, through the apertures defined by the inner peripheries of front and rear plates 8-9, and the first blade 61 not formed with communication hole 75. As a result of this, there is a possibility that lock piston 71 is forced in the X-axis direction by the introduced and expanded air. In more detail, the air, introduced into the side of the basal portion (i.e., the positive X-axis direction) of look piston 71, can be exhausted through the air-bleed groove (i.e., radial groove 605). However, no air bleeder is formed on the side of the top of lock piston 71 (i.e., the head portion 714 of the negative X-axis direction of lock piston 71). The air, introduced into the side of the head portion 714 (i.e., the negative X-axis direction) of look piston 71, acts on the head portion 714 in a manner so as to force lock piston 71 in the positive X-axis direction. There is a possibility that, due to the expanded air, included in the oil and introduced into the lock mechanism, a retraction stroke of lock piston 71 apart from the concavity 730 of rear plate 9 occurs and thus the lock mechanism is erroneously released.

As discussed above, even if the modified lock mechanism having a single unlocking oil passage structure, which structure does not include an unlock oil passage (e.g., communication hole 75) always getting a supply of unlocking hydraulic pressure before a startup of the VTC device, is adopted, there is a possibility of an erroneous release of the lock mechanism.

In contrast, in the case of control valve apparatus 1 of the first embodiment, a flow path, through which supply passages 53*a*-53*b* are communicated with each other, is controlled to a fully-open state (i.e., a large flow-rate side of a variable flow-rate range), for the predetermined time delay T after the engine has been started. After air bubbles included in oil, discharged from pump P, become reduced sufficiently, (that is, upon expiration of the predetermined time delay T), working oil can be preferentially fed into the VTC device. Therefore, it is possible to suppress an erroneous release of the lock mechanism.

As previously described, as a time length during which the signal "A" is continuously outputted from controller CU to pilot valve 3 after the engine has been started, the system of the first embodiment uses the predetermined time delay T, which is a parameter that is required to estimate whether a hydraulic pressure in supply passage 53*b*, communicating each of lubricated engine parts, becomes higher than or equal to the predetermined pressure value P0 after the engine has been started. The predetermined time delay T may be replaced with a predetermined time delay U, which is a parameter that is required to estimate or determine whether air bubbles included in oil, discharged from pump P and then fed into branch passage 54, become reduced sufficiently after the engine has been started.

The predetermined time delay U can be experimentally determined in advance, as follows.

For instance, the opening degree of the flow path, through which supply passages 53*a*-53*b* are communicated with each other, is switched from a maximum value (corresponding to the position "A") to a minimum value (corresponding to the position "B") at a point of time when a given time delay has elapsed (for example, with the engine at an idle rpm) after the engine has been restarted. At this point of time, a check is made to determine whether lock mechanism 7 becomes released before a hydraulic pressure of oil delivered from supply passage 53*a* to branch passage 54 reaches the specified pressure value P1 above which lock mechanism 7 of the VTC device can be released (unlocked). In the event that lock mechanism 7 becomes released before the specified pressure value P1 has been reached, it is determined that air bubbles included in oil, discharged from pump P and then fed into branch passage 54, have not yet been reduced sufficiently, and thus the given time delay is still short. In such a case, the given time delay is incremented and the experiment is repeated. As a result of the repeatedly executed experiments, it is possible to determine an optimal shortest time delay that lock mechanism 7 remains locked (engaged) before the specified pressure value P1 has been reached, The experimentally-determined optimal shortest time delay can be used as the predetermined time delay U.

In order to enhance the accuracy of estimation on whether air bubbles included in oil, discharged from pump P and then fed into branch passage 54, become reduced sufficiently after the engine has been started, it is preferable to compensate for the predetermined time delay U in accordance with a change in temperature of working/lubricating oil.

When the predetermined time delay U is used instead of the predetermined time delay T, it is possible to more certainly suppress an erroneous release of the lock mechanism. Also, at a point of time when the predetermined time delay U has expired, it is determined that air bubbles included in oil, discharged from pump P and then fed into branch passage 54, have already been reduced sufficiently and that a minimum amount of oil, needed for lubricating action, has been distributed to each of lubricated engine parts so as to ensure a minimum smooth operation (rotary motion and/or sliding motion) of each of the moving engine parts. For the reasons discussed above, by using the predetermined time delay U, it is possible to enhance a lubricating action for each of lubricated engine parts.

(Optimization of Engine Lubricating Action and VTC Operability)

In the first embodiment, after the VTC device has been started up, switching between the signal "A" and the signal "B" is made depending on the engine operating condition (e.g., the current engine load and the current valve-timing control state). As a result of this, shifting of the axial position of spool 20 between the position "A" and the opposite position "B", in other words, switching of the flow path between supply passages 53*a*-53*b* from one of a full fluid-communication state and a maximum flow-constriction state to the other is controlled. Thus, two requirements, namely, a superior engine lubricating action and a superior VTC operability can be optimally balanced to each other at a high level.

Controller CU is configured to output the signal "A" during high engine load operation that requires a high lubricating-oil flow rate and a high hydraulic pressure for engine lubrication, so that spool 20 is controlled to the position "A". For instance, to determine whether the engine load is high or low, the processor of controller CU can use information from the crank angle sensor. With control valve apparatus 1 controlled to the position "A", the flow path between supply passages 53*a*-53*b* is kept fully open but not throttled. Thus, lubricating oil of a large flow rate and a high hydraulic pressure can be fed into supply passage 53*b* (toward each of lubricated engine parts). Each of lubricated engine parts can be smoothly operated depending on engine load.

Under a high engine-load state, the engine speed often becomes high, and thus the hydraulic pressure, supplied from pump P to supply passage 53*a*, also becomes high. Hence, even with the flow path controlled to the fully-open state, a sufficient amount of oil can be also supplied to the branch passage 54.

Controller CU is further configured to output the signal "B" when a rapid operation of the VTC device (i.e., a high responsiveness of valve timing control) is required for a superior operability of the VTC device, so that spool 20 is controlled to the opposite position "B". With control valve apparatus 1 controlled to the opposite position "B", the flow path between supply passages 53*a*-53*b* is throttled. The flow rate of lubricating oil fed to supply passage 53*b* (toward each of lubricated engine parts) is limited, and therefore most of the oil, discharged and force-fed from pump P to supply passage 53*a*, is fed into branch passage 54 (toward the VTC device). Thus, high-pressure working oil can be preferentially fed into the VTC device.

Even under the above-mentioned fully-throttled state (i.e., the maximum flow-constriction state), oil can be fed via only the through hole 227 formed in spool 20 to supply passage 53*b* (toward lubricated engine parts). The flow rate of oil, flowing via only the through hole 227 to supply passage 53*b*, is set to a flow rate equal to or slightly greater than a minimum flow rate needed to lubricate moving engine parts.

(Standby Control Executed Before Shifting to Engine Stopped State)

In the first embodiment, spool 20 is controlled to the position "A" preferably before the engine has been stopped. The position control of spool 20 is hereinafter referred to as "standby control". By virtue of the standby control, it is possible to enhance the probability that spool 20 has already been positioned at the position "A" (i.e., on the large flow-rate side of the variable flow-rate range) during the next engine startup.

That is, in the case of the hydraulic system configuration of the first embodiment, in which supply passage 53*b* (the lubricating oil passage) and spool valve 2 are aligned substantially coaxially with each other with respect to the axis "Q", usually, a direction of sliding motion of spool 20, that is, the x-axis direction, is set to be approximately parallel to the ground surface. Thus, when the engine has been stopped after the vehicle has stopped on the flat way, there is a high possibility that spool 20, which has already been controlled to the position "A" immediately before the engine has been stopped, remains kept at the position "A" during the next engine startup.

As compared to another position control in which spool 20 can be hydraulically shifted to the position "A" by pump discharge pressure after the engine has been restarted, the standby control has the further advantage of rapid oil supply to the supply passage 53*b*. That is, the standby control according to which spool 20 can be positioned at the position "A" as much as possible during the next engine startup, enables a more rapid oil supply to supply passage 53*b* (toward lubricated engine parts) during the engine starting period, thereby more certainly enhancing the lubrication performance during the engine starting period.

In other words, in the control valve system having a standby control function as discussed above, it is possible to shorten the predetermined time delay T within which the flow path between supply passages 53*a*-53*b* is kept fully open, in other words, oil supply to branch passage 54 (toward the VTC device) can be suppressed. Hereby, it is possible to enhance the responsiveness of the VTC device during an engine startup.

On the other hand, in the case of another position control in which spool 20 can be hydraulically shifted to the position "A" by pump discharge pressure after the engine has been restarted, a required hydraulic pressure in supply passage 53*a* must be created in order to shift spool 20 to the position "A". There is a risk that oil, including a lot of air bubbles immediately after an engine startup, may be undesirably fed from supply passage 53*a* to branch passage 54 (toward the VTC device) for a time period during which the required hydraulic pressure in supply passage 53*a* satisfactorily develops. In contrast, in the case of the control valve apparatus having the standby control function, spool 20 can be positioned at the position "A" (that is, a standby position of spool 20) by the standby control. Thus, it is possible to avoid or suppress the aforementioned risk, thereby effectively suppressing an erroneous release of the lock mechanism of the VTC device. In the shown embodiment, the standby control is executed during an engine stopping period (i.e., before the engine has been stopped). Such standby control may be executed during an engine stopping period or during an engine startup period.

Figure 7:
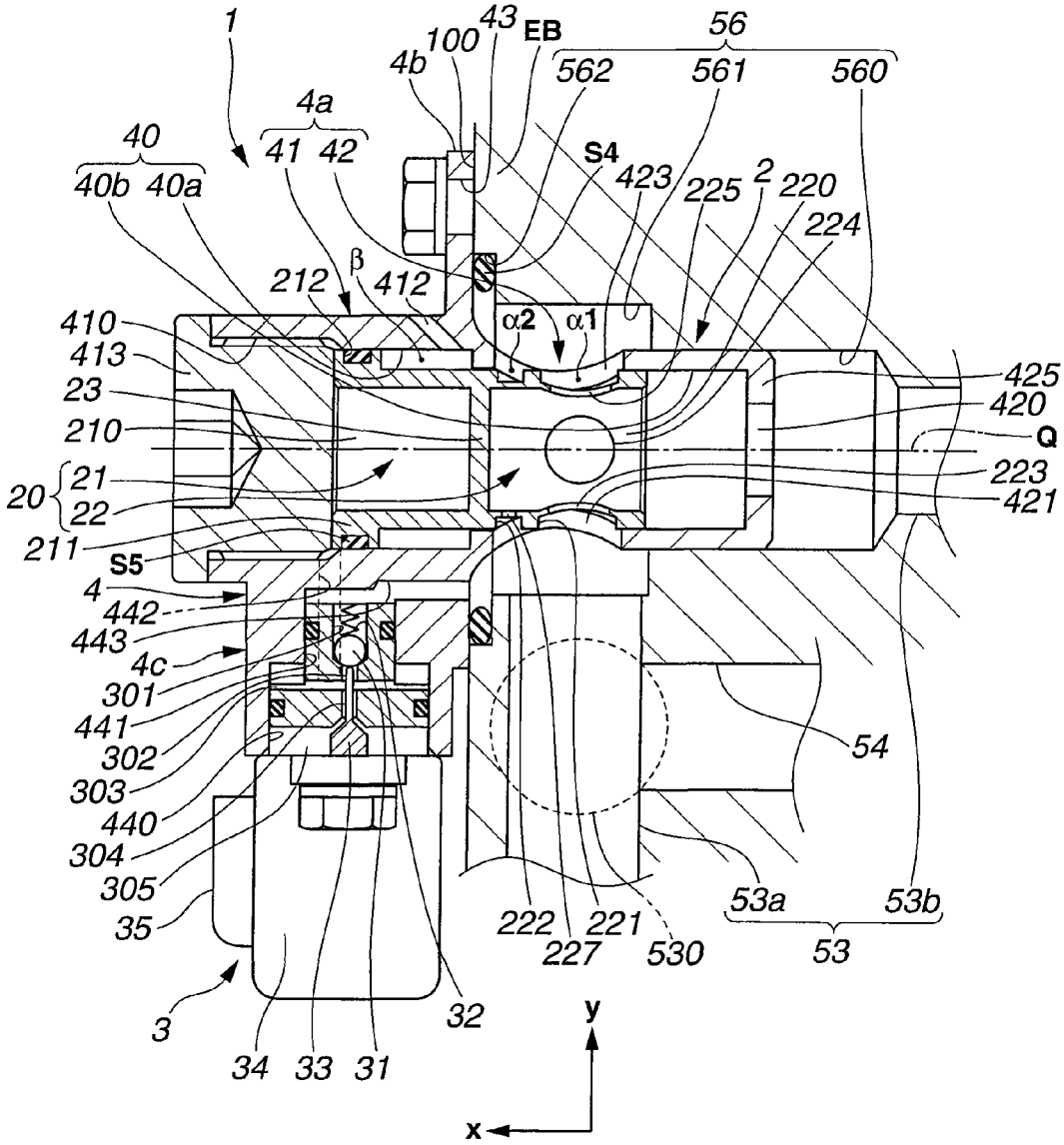
FIG. 7 is a partial cross-section of the control valve apparatus of the fourth embodiment, whose spool is controlled to a large flow-rate side.

In order to more certainly achieve a standby control function, a sliding-contact member (e.g., a seal ring) may be provided between spool 20 and housing 4, such that spool 20, which has already been controlled to the position "A" (i.e., the standby position) by the standby control before the engine has been stopped, can be more certainly held at the position "A" by a sliding frictional resistance created by the sliding-contact member (related to the fourth embodiment described later in reference to FIG. 7).

In contrast to the above, in the first embodiment, such a sliding-contact member is eliminated, and thus it is possible to somewhat reduce the number of component parts of control valve apparatus 1. Also, there is no sliding frictional resistance created by the sliding-contact member during sliding motion of spool 20. This eliminates the necessity of an additional hydraulic pressure overcoming the sliding frictional resistance created by the sliding-contact member. Thus, it is possible to minimize the area difference (D2–D1) between the second pressure-receiving surface of the area D2 and the first pressure-receiving surface of the area D1 as much as possible. As a result, spool 20 can be downsized, thereby reducing the overall size of control valve apparatus 1.

Conversely, the previously-discussed standby control function may be eliminated. In lieu thereof, a biasing means (e.g., a biasing member such as a coiled compression spring) may be provided to permanently bias (force) the spool 20 toward the position "A" (that is, in the positive x-axis direction). For instance, suppose that a coiled compression spring is installed in the first pressure chamber to permanently force the spool 20 in the positive x-axis direction with respect to housing 4. By the spring force of the biasing member, spool 20 can be positioned and held at the position "A" every engine startup operations with no standby control (related to the third embodiment described later in reference to FIG. 6).

In contrast to the above, in the first embodiment, such a biasing member (e.g., a return spring) is eliminated, and thus it is possible to somewhat reduce the number of component parts of control valve apparatus 1. Also, there is no spring force created by the biasing member during sliding motion of spool 20. The apparatus of the first embodiment does not require the addition of hydraulic pressure overcoming the spring force created by the biasing member. Thus, the overall size of control valve apparatus 1 can be downsized.

(Elimination of Hydraulic Pressure Sensor)

In the first embodiment, the predetermined time delay T is used as a parameter that is required to estimate whether a hydraulic pressure $P_{53b}$ in supply passage 53*b* becomes higher than or equal to the predetermined pressure value P0 after the engine has been started. In lieu thereof, such a check ($P_{53b}$>P0) may be made, based on a result of comparison between the predetermined pressure value P0 and the hydraulic pressure $P_{53b}$, directly detected by means of a pressure detection means. such as an oil pressure sensor PS (see a pressure-gauge symbol indicated by the broken line in FIG. 1) attached to the supply passage 53*b* (related to the second embodiment described later). The second embodiment, utilizing actually-detected hydraulic pressure $P_{53b}$, is advantageous with respect to the enhanced accuracy of flow control of the flow control valve system. In contrast, the first embodiment, not having an oil pressure sensor, is advantageous with respect to reduced number of component parts and lower hydraulic system installation time and costs. Furthermore, in the first embodiment, to enhance the accuracy of estimation on whether the predetermined pressure value P0 has been reached after the engine has been started, the predetermined time delay T is temperature-compensated, but the existing oil temperature sensor and/or the existing engine coolant temperature sensor can be utilized. The system of the first embodiment does not require the addition of a new temperature sensor on the engine.

(Effects Obtained by Electronic Control)

In the first embodiment, control valve apparatus 1 is electronically controlled in response to an electric signal (an electronic signal). That is, by outputting a selected one of signals "A" and "B" from controller CU to pilot valve 3, the axial position of spool 20 (a valve element) of control valve apparatus 1 can be electronically controlled from one of the position "A" (i.e., a full fluid-communication state) and the opposite position "B" (i.e., a maximum flow-constriction state) to the other with a high responsiveness.

As a modification, as the control valve apparatus 1, a spring-offset, external-pilot-pressure operated type may be adopted. For instance, one axial end of the spool is permanently biased by a biasing member (e.g., a coiled spring) in the positive x-axis direction, whereas the opposite end of the spool is forced in the negative x-axis direction by a feed-back pressure, in other words, an external pilot pressure (e.g., a hydraulic pressure in the downstream supply passage). In such a spring-offset, external-pilot-pressure operated type, during an initial engine startup in which the hydraulic pressure in the downstream supply passage is still low, the spool is positioned at the position "A" (i.e., a full fluid-communication state) by the spring force. Conversely when the hydraulic pressure in the downstream supply passage has risen up sufficiently, the spool is positioned at the opposite position "B" (i.e., a maximum flow-constriction state) by the feedback pressure acting on the spool in the negative x-axis direction, overcoming the spring force. However, the spring-offset, external-pilot-pressure operated type has difficulty in arbitrarily varying a flow rate of lubricating oil flow into the downstream supply passage (toward each of lubricated engine parts) and a flow rate of working oil flow into the upstream supply passage (toward the VTC device). The spring-offset, external-pilot-pressure operated spool valve type is inferior to the electronically-controlled spool valve type, in controllability. In the case of the electronically-controlled type control valve apparatus 1 of the first embodiment, it is possible to optimally control a fluid-communication state of the flow path between supply passages 53*a*-53*b* (in other words, both a supply flow rate of lubricating oil to each of lubricated engine parts and a supply flow rate of working oil to the VTC device) through all engine operating conditions as well as during an engine startup.

By the way, in the first embodiment, control valve apparatus 1 is operated by way of two-position control, in other words, ON/OFF control (i.e., switching between the position "A" and the opposite position "B"). As compared to a continuously variable solenoid-operated control valve system in which the axial position of the spool (in other words, the opening degree of the flow path between supply passages 53*a*-53*b*) can be continuously varied, depending on a duty cycle of a pulse-width modulated signal of energization of the solenoid, control valve apparatus 1 of the first embodiment, which is operated by way of two-position control, is superior with respect to simplified and downsized control valve system configuration.

(Effects Obtained by Flow Path Layout of One Supply Passage Connected to Side Face of Spool and the Other Supply Passage Connected to Axial End of Spool)

In the shown embodiment, a flow rate of the flow path, i.e., a supply flow rate of oil to supply passage 53*b* (the other supply passage) can be throttled by sliding motion of spool 20 in the x-axis direction. Concretely, the oil flow through the flow path between supply passages 53*a*-53*b* is throttled by a degree of overlapping of the first group of through holes 223-226 and the second group of through holes 421-424, which overlapping degree is determined depending on the axial position of spool 20. The upstream side of supply passage 53 (i.e., the upstream supply passage 53*a*) communicates the second group of through holes 421-424, while the flow-passage portion 22, formed with the first group of through holes 223-226, is opened at the side facing in the negative x-axis direction to communicate the downstream side of supply passage 53 (i.e., the downstream supply passage 53*b*). As discussed above, in the first embodiment, regarding inlet and outlet ports of spool valve 2, one of the two ports is provided on the side of the sliding-contact surface of spool 20 in a manner so as to communicate the opening end of upstream supply passage 53*a* (one supply passage), while the other port is provided on the axial end of spool 20 in a manner so as to communicate the opening end of downstream supply passage 53*b* (the other supply passage).

In contrast to the above, suppose that inlet and outlet ports of spool valve 2, are provided on the same side face of spool 20 in a manner so as to communicate the opening end of upstream supply passage 53*a* and the opening end of downstream supply passage 53*b*, respectively, such that the opening degree (i.e., the flow-passage area) of the flow path between supply passages 53*a*-53*b* can be adjusted depending on the axial position (sliding motion) of spool 20. In this case, generally, the opening end of upstream supply passage 53*a* and the opening end of downstream supply passage 53*b* must be laid out to be axially spaced from each other. This results in an increase in overall axial length of the spool valve. Alternatively, inlet and outlet ports of spool valve 2, are provided on the same axial end of spool 20 in a manner so as to communicate the opening end of upstream supply passage 53*a* and the opening end of downstream supply passage 53*b*, respectively, such that the opening degree (i.e., the flow-passage area) of the flow path between supply passages 53*a*-53*b* can be adjusted depending on rotary motion of spool 20. In this case, generally, the opening end of upstream supply passage 53*a* and the opening end of downstream supply passage 53*b* must be laid out to be radially spaced from each other. This results in an increase in outside diameter of the spool valve.

As previously described, in the first embodiment, one of the two ports of spool 20 is provided on the side of the sliding-contact surface of spool 20 in a manner so as to communicate the opening end of upstream supply passage 53*a*, while the other port is provided on the axial end of spool 20 in a manner so as to communicate the opening end of downstream supply passage 53*b*. This contributes to the reduced radial dimension and reduced axial length of spool valve 2. Thus, it is possible to compactify the whole size of control valve apparatus 1.

In the case of supply passage 53 (supply passages 53*a*-53*b*) of the first embodiment, the direction (i.e., the y-axis direction) that the upstream supply passage 53*a* extends and the direction (i.e., the x-axis direction) that the downstream supply passage 53*b* extends, differ from each other and intersect with each other at an approximately right angle. In the shown embodiment, the control valve structure is designed so that spool 20 slides in the x-axis direction. In lieu thereof, the control valve structure may be designed so that spool 20 slides in the y-axis direction, and that the opening degree (i.e., the flow-passage area) of the flow path between supply passages 53*a*-53*b* can be adjusted depending on sliding motion of spool 20 in the y-axis direction.

Even with the above-discussed construction that the directions that the upstream and downstream supply passages 53*a*-53*b* extend, differ from each other and intersect with each other at an approximately right angle, the provision of annular groove 561, formed to surround the entire circumference of the flow-passage portion, is advantageous with respect to smooth oil flow from one port of spool valve 2 (i.e., supply passage 53*a*) to the other port (i.e., supply passage 53*b*).

(Effects Obtained by Pressure-Receiving Surface Area Difference D2–D1)

Generally, a sliding spool type control valve is superior from a viewpoint that its valve element (a spool) can be smoothly operated (moved) by a comparatively small force without being affected by a hydraulic pressure of fluid flowing through the spool valve, rather than control valves of another type. Thus, the spool type control valve is suited to reliable control of flow for a high-pressure hydraulic circuit.

However, in the control valve structure of the first embodiment, a hydraulic pressure acts on each of axial ends of spool 20. For instance, suppose that spool 20 is operated directly by a magnetic force of a solenoid. Such an electromagnetic-solenoid-operated control valve system requires a comparatively large magnetic force, overcoming the hydraulic pressure. This means an enlargement in the whole size of the solenoid-operated control valve system.

For the reasons discussed above, in the first embodiment, pilot valve 3 is further provided and spool 20 is operated by applying a hydraulic pressure (a pilot pressure), concretely, a hydraulic pressure in supply passage 53*a* to the second pressure-receiving surface of spool 20 by way of the pilot valve 3. In comparison with the solenoid-operated control valve system, the control valve apparatus 1 of the first embodiment facilitates switching of a high-pressure hydraulic circuit, concretely, smooth adjustment of flow of oil flowing through the flow path (i.e., supply passage 53*b*) downstream of the branched point 530 without enlarging the control valve system.

Also, in the first embodiment, there is an area difference (D2–D1) between the second pressure-receiving surface of spool 20 and the first pressure-receiving surface of spool 20. The control valve apparatus of the first embodiment is configured to operate (shift) spool 20 by the force difference (F2–F1) of two opposite forces F2 and F1, acting on respective axial ends of spool 20, which force difference is created by the area difference (D2–D1). Hence, it is possible to reduce the size of spool 20, while ensuring a smooth sliding motion (a high responsiveness of operation) of spool 20 laid out at a portion in which supply passages 53*a*-53*b* intersect with each other at an approximately right angle.

Conversely, suppose that there is no area difference between the first and second pressure-receiving surfaces and thus sliding motion of spool 20 is created by the hydraulic pressure difference of hydraulic pressures acting on respective axial ends of spool 20. On the one hand, it is necessary to let the magnitudes of hydraulic pressures acting on respective axial ends of spool 20 be different. Simultaneously, suppose that spool 20 is installed at a portion in which supply passages 53*a*-53*b* intersect with each other at an approximately right angle. On the other hand, a hydraulic pressure in the downstream end of supply passage 53 (i.e., the downstream supply passage 53*b*) always acts on the first axial end of spool 20 (i.e., the first pressure-receiving surface) during operation of the engine. For instance, assuming that spool 20 has to be moved in the negative x-axis direction in which the first axial end of spool 20 faces, the magnitude of hydraulic pressure acting on the second axial end of spool 20 (i.e., the second pressure-receiving surface) has to be increased than the magnitude of hydraulic pressure acting on the first axial end of spool 20 (i.e., the first pressure-receiving surface). In this case, a hydraulic pressure in the upstream end of supply passage 53 (i.e., the upstream supply passage 53*a*) can be just used as a hydraulic pressure acting on the second axial end of spool 20 (i.e., the second pressure-receiving surface). However, a hydraulic pressure in the downstream end of supply passage 53 (i.e., the downstream supply passage 53*b*) to be used as a hydraulic pressure acting on the first axial end of spool 20 (i.e., the first pressure-receiving surface) must be adjusted (dropped) by means of a flow-constriction device or a pressure control valve. This leads to the problem of a pressure loss.

For the reasons discussed above, in order for spool 20 to move without producing any pressure loss, the area difference (D2–D1) between the second pressure-receiving surface of the area D2 and the first pressure-receiving surface of the area D1 is necessary.

Alternatively, suppose that there is no area difference between the first and second pressure-receiving surfaces and thus the force difference between forces acting on respective axial ends of spool 20 is created by the spring force of a biasing means (e.g., a spring-load means). For instance, suppose that, to move the spool 20 in the negative x-axis direction, the spring force, produced by the biasing means, acts on the second axial end of spool 20 (i.e., the second pressure-receiving surface) instead of using the hydraulic pressure difference. In such a case, immediately after an engine startup there is a less development of hydraulic pressure in supply passage 53, spool 20 can be held at the opposite position "B", in which the flow path is conditioned in the maximum flow-constriction state of supply passages 53*a*-53*b*, by the spring force of the biasing means. Under these condition, when shifting spool 20 from the opposite position "B" to the position "A", there is a lag time between (i) the point of time of switching from the signal "B" to the signal "A" and (ii) the point of time of a sufficient development of hydraulic pressure in supply passage 53, overcoming the spring force of the biasing means. Thus, it is necessary to wait, until the hydraulic pressure in supply passage 53 develops sufficiently. However, such a spring-offset type control valve system is opposite to the main object of control valve apparatus 1, that is, an engine-startup period enhanced lubrication performance, with the flow path kept at the full fluid-communication state of supply passages 53*a*-53*b*. Spool 20 has to be moved in the positive x-axis direction by the hydraulic pressure, while overcoming the spring force of the biasing means during the engine startup. There is a possibility that spool 20 cannot be operated with a high responsiveness. Also, by the addition of the biasing means (spring-load means), a working oil pressure range, within which spool 20 can be operated, tends to become narrow, and as a result it is difficult to ensure a smooth sliding motion (a high responsiveness of operation) of spool 20.

Conversely, suppose that, in order for spool 20 to move in the positive x-axis direction, the spring force, produced by the biasing means, acts on the first axial end of spool 20 (i.e., the first pressure-receiving surface) instead of using the hydraulic pressure difference. In such a case, immediately after an engine startup, spool 20 can be held at the position "A", in which the flow path is conditioned in the full fluid-communication state of supply passages 53*a*-53*b*, by the spring force of the biasing means. Under these conditions, when shifting spool 20 from the position "A" to the opposite position "B", in other words, for switching to the maximum flow-constriction state of supply passages 53*a*-53*b*, spool 20 has to be moved in the negative x-axis direction by a sufficient hydraulic pressure acting on the second axial end of spool 20 (i.e., the second pressure-receiving surface), overcoming the spring force of the biasing means. To produce the sufficient hydraulic pressure, which acts on the second pressure-receiving surface, higher than the hydraulic pressure, which acts on the first pressure-receiving surface, the area difference between the second pressure-receiving surface and the first pressure-receiving surface is necessary.

In contrast, in the first embodiment, spool 20 can be operated by the force difference (F2–F1) of two opposite forces F2 and F1, acting on respective axial ends of spool 20, which force difference is created by the pressure-receiving surface area difference (D2–D1), without any biasing means (e.g., without any spring-load means) acting on spool 20.

Thus, it is unnecessary to wait, until the hydraulic pressure in supply passage 53 develops sufficiently. Even when hydraulic pressures acting respective axial ends of spool 20 are still low, it is possible to produce a force needed to axially move the spool 20 by virtue of the area difference (D2–D1). A working oil pressure range, within which spool 20 can be operated, is comparatively wide and also it is unnecessary to move the spool 20 against the spring force, because of no addition of biasing means (spring-load means). Thus, it is possible to ensure a smooth sliding motion (a high responsiveness of operation) of spool 20. Therefore, at an early stage after the engine has been started, switching of the flow path between a full fluid-communication state of supply passages 53*a*-53*b* (i.e., the position "A" of FIG. 4) and a maximum flow-constriction state (i.e., the opposite position "B" of FIG. 5) can be made with a high responsiveness, and thus flow control can be rapidly accurately performed.

Additionally, there is no biasing means (no spring-load means) acting on spool 20, the number of component parts can be reduced. Also, only the hydraulic pressure acts on each of the first and second pressure-receiving surfaces of spool 20, and additionally the magnitude of hydraulic pressure acting on the first pressure-receiving surface and the magnitude of hydraulic pressure acting on the second pressure-receiving surface are approximately equal to each other. Hence, even in the case of a slight pressure-receiving surface area difference (D2–D1), it is possible to operate spool 20. As a result, spool valve 2 (especially, the radial size of spool 20) can be downsized.

Furthermore, the hydraulic pressure in the downstream end of supply passage 53 (i.e., the downstream supply passage 53*b*) is just used as a hydraulic pressure acting on the first axial end of spool 20 (i.e., the first pressure-receiving surface), while the hydraulic pressure in the upstream end of supply passage 53 (i.e., the upstream supply passage 53*a*) is just used as a hydraulic pressure acting on the second axial end of spool 20 (i.e., the second pressure-receiving surface). Thus, there is a less wasteful pressure loss.

In particular, control valve apparatus 1 of the first embodiment is configured to selectively introduce oil of the upstream side of supply passage 53 (i.e., the upstream supply passage 53*a*) into the second pressure chamber (the side of the second pressure-receiving surface) without introducing oil of the downstream side of supply passage 53 (i.e., the downstream supply passage 53*b*) into the second pressure chamber. As compared to another type of control valve system in which oil of the downstream side of supply passage 53 (i.e., the downstream supply passage 53*b*) is introduced into the second pressure chamber, in the control valve apparatus 1 of the first embodiment that selectively introduces oil of the upstream side of supply passage 53 (i.e., the upstream supply passage 53*a*) into the second pressure chamber, there is a less pressure loss of hydraulic pressure introduced into the second pressure chamber (the side of the second pressure-receiving surface). Hence, the pressure difference between hydraulic pressure introduced into the second pressure chamber and hydraulic pressure introduced into the first pressure chamber tends to become less. As a result, spool 20 can be effectively shifted by virtue of the area difference (D2–D1) between the area D2 of the second pressure-receiving surface (the second axial end of spool 20) and the area D1 of the first pressure-receiving surface (the first axial end of spool 20), in other words, by the sliding force (i.e., F2–F1), produced as a result of the force difference between the axial force F2 acting in the negative x-axis direction and created by hydraulic pressure on the second pressure-receiving surface of the area D2 and the axial force F1 acting in the positive x-axis direction and created by hydraulic pressure on the first pressure-receiving surface of the area D1. Thus, it is possible to ensure a smooth sliding motion (a high responsiveness of operation) of spool 20.

(Effects Obtained by Flow Path Layout of Upstream Supply Passage Connected to Side Face of Spool and Downstream Supply Passage Connected to Axial End of Spool)

In the first embodiment, spool 20 is laid out to slide in the direction (i.e., in the x-axis direction) that the downstream supply passage 53*b* extends. In other words, the inlet port of spool 20 is provided on the side of the sliding-contact surface of spool 20 in a manner so as to communicate the opening end of upstream supply passage 53*a*, while the outlet port of spool 20 is provided on the axial end of spool 20 in a manner so as to communicate the opening end of downstream supply passage 53*b*.

Thus, the direction of flow of oil flowing via the inlet port of spool 20 (i.e., the opening end of upstream supply passage 53*a*) into spool valve 2 is substantially perpendicular to the direction of sliding motion of spool 20. The direction of flow of oil flowing via the spool inlet port into spool valve 2 is not the axial direction of spool 20. Thus, it is possible to suppress the operation (the sliding motion) of spool 20 from being affected by dynamic pressure, which may be created by the flow velocity of oil flowing through spool 20. In particular, even when the oil-flow velocity is high, it is possible to suppress unintended sliding motion of spool 20, thus enabling stable operation of spool 20, that is, more accurate flow control.

Furthermore, annular groove 561 is provided to surround the entire circumference of the flow-passage portion of spool valve 2, and thus oil, supplied from supply passage 53*a* to spool valve 2, is necessarily distributed into annular groove 561. This contributes to equalization of the supplied oil pressure, thus more certainly enabling stable operation of spool 20 and more accurate flow control.

Moreover, the inlet port of spool 20 (i.e., the opening end of upstream supply passage 53*a*) is provided on the side of the sliding-contact surface of spool 20 rather than on the axial end of spool 20. The distance between the opening end of upstream supply passage 53*a* and the second axial end of spool 20 (i.e., the second pressure-receiving surface) is shorter than the distance between both axial end faces of spool 20. In the case of the first embodiment in which the flow path is configured to selectively introduce oil of the upstream side of supply passage 53 (i.e., the upstream supply passage 53*a*) into the second pressure chamber (the side of the second pressure-receiving surface), it is possible to simplify the flow-passage structure among the spool inlet port, the opening end of upstream supply passage 53*a*, and the second pressure chamber. Concretely, the system of the first embodiment does not require the addition of a hydraulic line interconnecting the upstream supply passage 53*a* and the oil passage (i.e., radial passage 443) formed in pilot valve body 4*c*. Actually, seal retaining bore 562 of engine block EB also serves as a hydraulic line interconnecting the upstream supply passage 53*a* and the radial passage 443. This contributes to reduced manufacturing costs and simplified control valve apparatus.

(Effects Obtained by Layout of Pilot Valve)

Suppose that the centerline of pilot valve 3 is laid out in the x-axis direction, for example, coaxially with the centerline of spool valve 2 such that these centerlines pass through the axis "Q" of sliding motion of spool 20. In such a case, pilot valve 3 is located to protrude from the side face 100 of engine block EB in the positive x-axis direction, thus deteriorating the layout flexibility of control valve apparatus 1. Also, the distance between supply passage 53 and axial passage 301, which axial passage is formed in pilot valve 3 for intercommunicating the supply passage 53 and the second axial end of spool 20 (i.e., the second pressure-receiving surface), tends to become longer. Such a control valve structure requires the addition of a hydraulic line formed in housing 4 for interconnecting the supply passage 53 and the axial passage 301.

In contrast, in the first embodiment, the axis of pilot valve 3 is laid out in the y-axis direction in such a manner as to extend parallel to the side face 100 of engine block EB. Thus, it is possible to suppress control valve apparatus 1 from protruding from the side face 100, thus enhancing the layout flexibility of control valve apparatus 1. Also, the axis of pilot valve 3 is laid out close to the side face 100 of engine block EB, and thus it is possible to shorten the distance between axial passage 301 and supply passage 53 (concretely, upstream supply passage 53*a*, annular groove 561, and seal retaining bore 562, all formed in engine block EB). Therefore, it is possible to simplify the flow-passage structure interconnecting the axial passage 301 and the supply passage 53. More concretely, as the hydraulic line interconnecting these passages 301 and 53, control valve apparatus 1 of the first embodiment requires only the radial passage 443 formed in pilot valve body 4*c* of housing 4. This contributes to reduced manufacturing costs and simplified, downsized control valve apparatus.

(Effects Obtained by a Valve Unit Formed by Integrating Two Valve Components)

As a valve unit with both the spool valve 2 and the pilot valve 3, control valve apparatus 1 is easily assembled into the unit mounting portion 56 of engine block EB. Such a valve unit contributes to lower hydraulic system installation time and costs, reduced service time, and smaller space requirements of overall system.

(Effects Obtained by Both-Side Support)

In the first embodiment, spool 20 is supported at both sides of through holes 421-424 of spool valve body 4*a* of housing 4 within its entire stroke range from the position "A" to the opposite position "B". Concretely, at the side of the positive x-axis direction of through holes 421-424, spool 20 is supported by the inner periphery of sliding-contact bore 40 (both large-diameter bore 40*a* and small-diameter bore 40*b*). Also, at the side of the negative x-axis direction of through holes 421-424, spool 20 is supported by the inner periphery of sliding-contact bore 40 (small-diameter bore 40*b*). Thus, it is possible to suppress the centerline of spool 20 from being undesirably inclined with respect to the axis "Q" (i.e., the axis of sliding motion of spool 20).

Suppose that spool 20 is supported at one side of through holes 421-424 of spool valve body 4*a* of housing 4 either at the side of the positive x-axis direction of through holes 421-424 or at the side of the negative x-axis direction of through holes 421-424. For instance, suppose that, only at the side of the positive x-axis direction of through holes 421-424, spool 20 is supported by the inner periphery of sliding-contact bore 40 (see spool 20 of the fifth embodiment described later in reference to FIG. 8 and having back-pressure portion 21 but not having flow-passage portion 22). In such a one-side support (see FIG. 8), the first axial end of spool 20, facing in the negative x-axis direction, tends to be somewhat inclined toward the inside of each of through holes 421-424, in other words, in the radial direction. In contrast, in the both-side support of the first embodiment shown in FIGS. 4-5, it is possible to suppress each axial end of spool 20 from being inclined in the radial direction. This contributes to a smooth operation (a smooth sliding motion) of spool 20.

(Effects Obtained by Flow-Constriction Orifice Structure)

In the first embodiment, through hole 227 is further formed in the grooved portion of flow-passage portion 22 of spool 20 at which the second groove 222 is formed. Especially, at the opposite position "B" (see FIG. 5), through hole 227, bored in spool 20, serves as a flow-constriction orifice (a fixed orifice) that throttles or constricts the flow-passage area of the flow path between supply passages 53*a*-53*b* with a maximum flow-constricting orifice action. Suppose that, especially at the opposite position "B", such a flow-constriction device is constructed in the form of a variable orifice, utilizing the relative-position relationship between the axially sliding spool 20 and the stationary spool valve body 4*a* of housing 4. For instance, suppose that a variable orifice (related to the fifth embodiment described later in reference to FIG. 8) is constructed by the apertures defined between the inner peripheral surfaces of through holes 421-424 of housing 4 and the first axial end of spool 20, facing in the negative x-axis direction. In such a case, spool 20 (having back-pressure portion 21 but not having flow-passage portion 22) and spool valve body 4*a* (especially, through holes 421-424 formed in housing 4) both have to be more accurately machined and produced. In contrast, the first embodiment requires accurate machining of only the through hole 227 (especially, an orifice bore of through hole 227 formed in spool 20), but not require very accurate machining of two different components, namely, spool 20 and spool valve body 4*a* of housing 4. That is, by accurate machining of only the orifice bore of through hole 227, it is possible to easily realize an accurate flow-passage area (i.e., an accurate orifice area), thus largely suppressing individual differences of flow-constriction orifices machined and manufactured. In other words, with spool 20 shifted to the opposite position "B", the flow rate of oil flowing into the downstream supply passage 53*b* can be more accurately controlled or throttled by virtue of only the accurately-machined orifice bore of through hole 227. Thus, upon expiration of the predetermined time delay T after the engine has been started, it is possible to intendedly realize preferential feed of most of oil, discharged from pump P to supply passage 53*a*, into branch passage 54 (i.e., toward the VTC device) and distribution of a minimum amount of oil, needed for lubricating action, to each of lubricated engine parts.

Additionally, in the first embodiment, through hole 227 (the flow-constriction orifice) is formed in spool 20. Suppose that such an orifice is formed in engine block EB. For instance, suppose that, as a flow-constriction orifice, a small-diameter communication hole (related to the sixth embodiment described later in reference to FIG. 9), intercommunicating annular groove 561 and housing retaining bore 560 (supply passage 53*b*), is formed in engine block EB. Generally, the machining process of the small-diameter communication hole, serving as a flow-constriction orifice and formed in engine block EB, is not easy. For instance, suppose that the small-diameter communication hole is comprised of a radial bore and an axial bore, and the radial bore is drilled from the outer peripheral surface of engine block EB. The opening end of the radial bore, opening into the exterior space of engine block EB, must be plugged by means of a plug, a ball or the like. That is, machining the small-diameter communication hole in engine block EB requires the addition of component parts, such as a plug or a ball. In contrast, as previously discussed, in the first embodiment, the flow-constriction orifice is formed in spool 20 in the form of a through hole (hole 227). The machining process of the through hole 227 (serving as a flow-constriction orifice and formed in spool 20) is very easy. Machining the through hole 227 in spool 20 does not require the addition of component parts, such as a plug or a ball. Also, the orifice length of through hole 227 is short and thus the flow resistance of through hole 227 is small. Therefore, it is possible to suppress a flow-rate change of oil flowing through the hole 227 (the orifice), even in the presence of a change in viscosity of oil due to oil temperature changes or a change in the sort of oil.

In the first embodiment, through hole 227 (the flow-constriction orifice) is formed in spool 20. In lieu thereof, such a flow-constriction orifice may be formed in housing 4. For instance, instead of machining both the second groove 222 and the through hole 227, a through hole (for example, a radial through hole or an oblique through hole) may be formed in the flow-passage portion 42 of housing 4 in close proximity to the side of the negative x-axis direction of through holes 421-424 in a manner so as to always communicate the annular groove 561 on the outer peripheral side of flow-passage portion 42. Additionally, on the inner peripheral side of flow-passage portion 42, this through hole (e.g., a radial or oblique through hole) may be formed in the flow-passage portion 42 in close proximity to the side of the negative x-axis direction of through holes 421-424 in a manner so as to communicate the first groove 221 of spool 20 at the opposite position "B", and also communicate the small-diameter bore 40*b* of sliding-contact bore 40 of housing 4 at the position "A". The through hole (e.g., a radial or oblique through hole), formed in housing 4 as discussed above, may be used instead of the through hole 227 (the flow-constriction orifice), formed in spool 20. This flow-constriction orifice structure requires accurate machining of only the radial or oblique through hole (especially, an orifice bore of the through hole formed in housing 4), but not require very accurate machining of two different components, namely, spool 20 and housing 4 (especially, through holes 421-424). Also, this flow-constriction orifice structure eliminates the necessity of forming a small-diameter communication hole in engine block EB. As appreciated, this modification, in which a flow-constriction orifice is bored in housing 4 in the form of a radial or oblique through hole, can provide the same effects as the first embodiment having a flow-constriction orifice structure bored in spool 20 in the form of a radial through hole (i.e., hole 227).

(Effects Obtained by Stopper)

The inside diameter of the opening (i.e., through hole 420) of the negative x-axis direction of flow-passage portion 42 of housing 4 is dimensioned to be less than that of small-diameter bore 40*b* (a small-diameter portion of sliding-contact bore 40 for spool 20), in such a manner as to form the bottom 425 of the negative x-axis direction of flow-passage portion 42. The inside face of bottom 425 of flow-passage portion 42 of housing 4 cooperates with the end face of the negative x-axis direction of spool 20 (flow-passage portion 22) to provide a second stopper (a sliding-motion stopper for spool 20 in the negative x-axis direction). This eliminates the necessity of providing or forming an additional stopper structure, thus ensuring reduced number of component parts and compact control valve apparatus.

(Effects Obtained by Cylindrical Bore and Radial Groove)

In the first embodiment, cylindrical bore (recessed portion) 210 is formed in the back-pressure portion 21 of spool 20. This contributes to lightening of spool 20 (that is, reduced inertial mass of the valve element), and a smooth sliding motion (a high responsiveness of operation) of spool 20, in other words, a rapid switching action between the position "A" and the opposite position "B". This also contributes to minimizing the area difference (D2−D1) between the area D2 of the second pressure-receiving surface (the second axial end of spool 20) and the area D1 of the first pressure-receiving surface (the first axial end of spool 20), in other words, the sliding force (i.e., F2−F1), produced as a result of the force difference between the axial force F2 acting in the negative x-axis direction and created by hydraulic pressure on the second pressure-receiving surface of the area D2 and the axial force F1 acting in the positive x-axis direction and created by hydraulic pressure on the first pressure-receiving surface of the area D1, as much as possible.

Furthermore, it is possible to install a biasing member (e.g., a spring) within the internal space (i.e., the second pressure chamber) defined by cylindrical bore 210 of the back-pressure portion 21. For instance, suppose that an extension spring is installed in the cylindrical bore 210 (in other words, the second pressure chamber) to permanently force the spool 20 in the positive x-axis direction with respect to housing 4. The modification can provide the same operation and effects as the third embodiment of FIG. 6 (described later) in which a coiled compression spring is installed in the first pressure chamber to permanently force the spool 20 in the positive x-axis direction with respect to housing 4.

Conversely, suppose that the end face of spool 20, facing in the positive x-axis direction, is not formed with cylindrical bore (recessed portion) 210, but formed as a flat end face (a closed flat face). When, with spool 20 held at the position "A", spool 20 is further forced in the positive x-axis direction by the hydraulic pressure in the first pressure chamber (supply passage 53), the flat end face of spool 20 and the inside end face of threaded plug 413 may adhere to each other with a less aperture between them. In such a case, it is difficult to deliver oil via pilot valve 3 through the flat end face of spool 20, facing in the positive x-axis direction to the second pressure-receiving surface (i.e., the second pressure chamber).

In contrast, in the first embodiment, the end face of spool 20, facing in the positive x-axis direction, is formed with the cylindrical bore (recessed portion) 210. Thus, it is possible to suppress the end face of the positive x-axis direction of spool 20 and the inside end face of threaded plug 413 from adhering to each other. Even with the flanged portion 211 of spool 20 kept in wall-contact with the inside end face of threaded plug 413, cylindrical bore (recessed portion) 210 facilitates axial movement of the flanged portion 211 apart from the threaded plug 413 when delivering oil to the wall-contact portion. That is, when oil is fed via pilot valve 3 to the second axial end of spool 20 held at the position "A", it is possible to easily catch or receive oil introduced via pilot valve 3 to the side of the second pressure-receiving surface by the cylindrical bore (recessed portion) 210. This enables a rapid sliding motion of spool 20 in the negative x-axis direction.

By the way, when oil is fed via pilot valve 3 to the second pressure chamber of spool 20 held at the position "A", first of all, oil introduced from axial passage 442 of, pilot valve body 4*c* is fed into annular groove 411 formed in the inner periphery of sliding-contact bore 40 (large-diameter bore 40*a*). Hence, oil can be fed into the cylindrical bore (recessed portion) 210, while being distributed around the entire circumference of spool 20, thus ensuring smooth introduction of oil into the second pressure chamber. This contributes to a rapid sliding motion of spool 20 from the position "A" to the opposite position "B" (i.e., in the negative x-axis direction).

Additionally, in the first embodiment, the end face of the positive x-axis direction of flanged portion 211 is formed with the radial groove 214. When spool 20 is positioned at the position "A", oil can be delivered from annular groove 411 via radial groove 214 to the cylindrical bore (recessed portion) 210. This ensures smooth oil supply to the second pressure-receiving surface (the second pressure chamber), thereby further enhancing the above-mentioned effects obtained by the formation of cylindrical bore (recessed portion) 210.

Even when the angular position of radial groove 214 is arbitrarily changed owing to rotary motion of spool 20 (back-pressure portion 21) about the axis "Q" with respect to the sliding-contact bore 40, oil can be delivered by way of annular groove 411 via radial groove 214 to the cylindrical bore (recessed portion) 210. In the first embodiment, although the flanged portion 211 has one radial groove 214, it will be appreciated that the number of a radial groove is not limited to "1". The shape and the number of a radial groove formed in the flanged portion may be modified.

Instead of forming the radial groove 214 in the flanged portion 211 of spool 20, a communication groove, intercommunicating the annular groove 411 and the cylindrical bore (recessed portion) 210, may be formed in the threaded plug 413.

Instead of forming a communication groove (i.e., radial groove 214), intercommunicating the annular groove 411 and the cylindrical bore (recessed portion) 210, a ridged portion may be formed on either the flanged portion 211 or the threaded plug 413. When the flanged portion 211 is brought into abutted-engagement with the threaded plug 413 at the position "A", an aperture (a communication passage) can be defined between them by the ridged portion.

Second Embodiment

Returning to FIG. 1, there is shown a hydraulic system configuration of the second embodiment, in which a hydraulic pressure detection means, such as oil pressure sensor PS, (see a pressure-gauge symbol indicated by the broken line in FIG. 1), is further added. As previously described, in control valve apparatus 1 of the first embodiment, the predetermined time delay T (the time elapsed from the point of time when the engine has been started from its stopped state) is used to estimate or determine whether a hydraulic pressure in supply passage 53*b*, communicating each of lubricated engine parts, becomes higher than or equal to the predetermined pressure value P0. In the control valve apparatus 1 of the second embodiment, instead of using the predetermined time delay T, a pressure signal (corresponding to the directly-measured pressure value) from the hydraulic pressure detection means (oil pressure sensor PS) is used to determine whether a hydraulic pressure in supply passage 53*b*, communicating each of lubricated engine parts, becomes higher than or equal to the predetermined pressure value P0.

Concretely, as indicated by the broken line in FIG. 1, oil pressure sensor PS is connected to (screwed into) the supply passage 53*b* to measure or detect a hydraulic pressure in supply passage 53*b*. The input/output interface (I/O) of controller CU receives input information from oil pressure sensor PS. The processor of controller CU determines, based on input information from the hydraulic pressure detection means (oil pressure sensor PS), whether the hydraulic pressure in supply passage 53*b* becomes higher than or equal to the predetermined pressure value P0.

The other construction of the second embodiment is exactly the same as the first embodiment.

Thus, according to the second embodiment, it is possible to directly detect or monitor, based on information from the hydraulic pressure detection means (oil pressure sensor PS), whether a hydraulic pressure of oil in the main flow passage (supply passage 53*b*) becomes higher than or equal to the predetermined pressure value P0. By only the addition of the hydraulic pressure detection means (oil pressure sensor PS), it is possible to easily enhance the accuracy of flow control of the flow control valve system.

Third Embodiment

Figure 6:
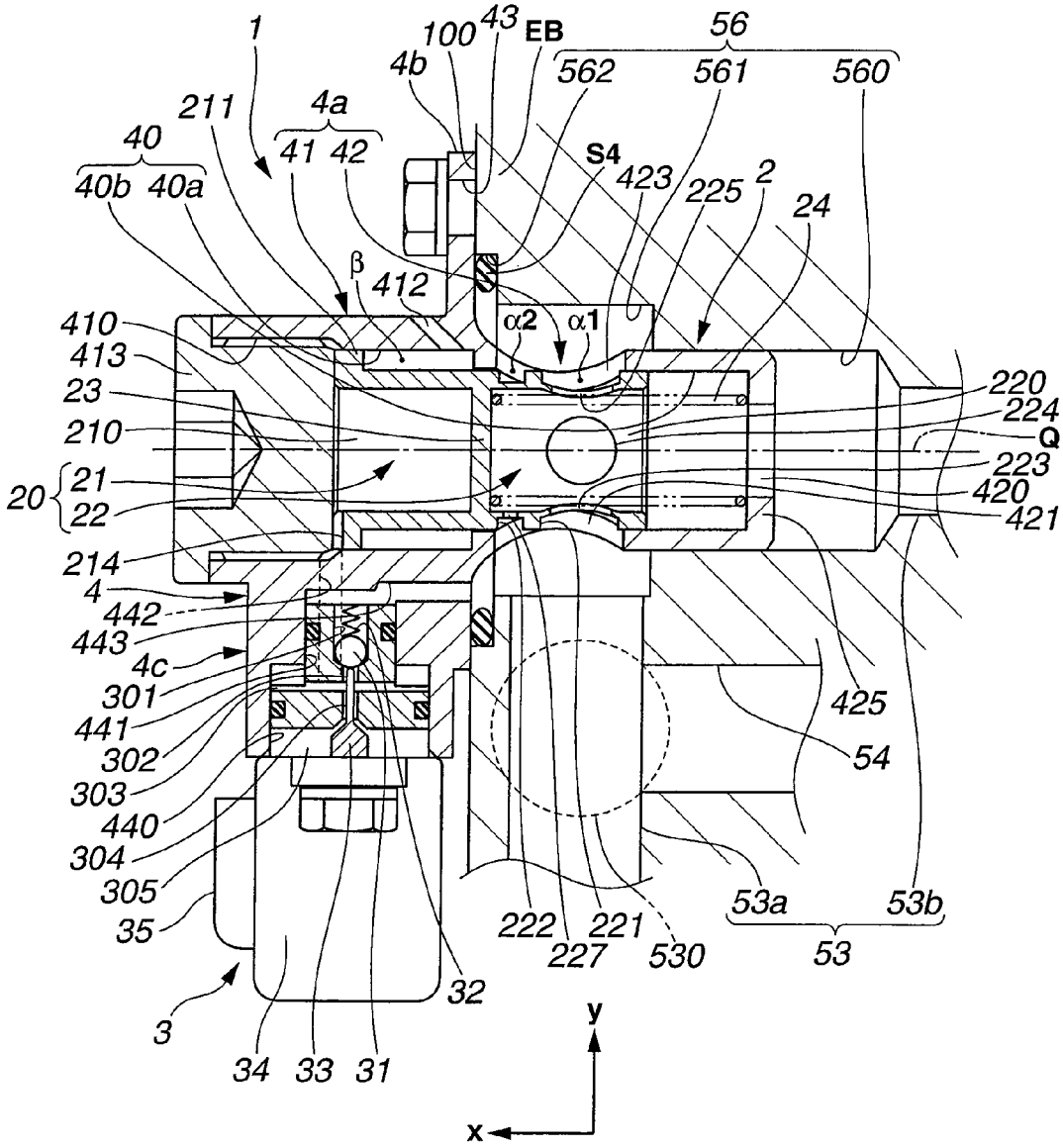
FIG. 6 is a partial cross-section of the control valve apparatus of the third embodiment, whose spool is controlled to a large flow-rate side.

Referring now to FIG. 6, there is shown a partial cross-section of control valve apparatus 1 of the third embodiment, in which a biasing means, such as a coiled compression spring (i.e., a return spring) 24 indicated by the two-dotted line in FIG. 6, is added instead of using the standby control as previously discussed. As clearly shown in FIG. 6, the biasing means (coiled compression spring 24) is disposed in the first pressure chamber of spool 20 so as to permanently force the spool 20 toward the position "A" (i.e., toward the maximum flow-rate side of the variable flow-rate range of supply passage 53*b*).

The cross-section of FIG. 6 shows the partial cross-section passing through the centerline "Q" of control valve apparatus 1 of the third embodiment (that is, the axis of sliding motion of spool 20).

As clearly shown in FIG. 6, coil spring 24 is disposed in the first pressure chamber under preload (in its compressed state) in such a manner as to permanently bias the spool 20 in the positive x-axis direction with respect to housing 4. The end of the positive x-axis direction of coil spring 24 is in abutted-engagement with the side face of partition wall portion 23 of spool 20, facing in the negative x-axis direction, whereas the end of the negative x-axis direction of coil spring 24 is in abutted-engagement with the inside face of the bottom 425 of flow-passage portion 42 of housing 4.

In the third embodiment having the spring-loaded spool valve structure, controller CU is configured so as not to execute the previously-described standby control.

The other construction of the third embodiment is exactly the same as the first embodiment.

In the third embodiment having the spring-loaded spool valve structure, even when spool valve 20 is assembled or installed so that the direction (i.e., the x-axis direction) of sliding motion of spool 20 is inclined with respect to the ground surface (the horizontal plane), or even when the engine has been stopped after the vehicle has stopped on an uphill or a downhill, spool 20 can be shifted to and held at the position "A" (i.e., the maximum flow-rate side of the variable flow-rate range) by the spring force of coil spring 24 in the engine stopped state. During the next engine startup, spool 20 remains kept at the position "A" (the spring-loaded position) by the spring force of the return spring (coil spring 24) and thus the flow path between supply passages 53*a*-53*b* has already been conditioned in the maximum flow-rate state. Therefore, it is possible to more certainly enhance a lubrication performance during an engine startup, while enhancing the degree of freedom of layout (installation) of control valve apparatus 1.

Under these conditions, when spool 20 has to be shifted to the opposite position "B" (i.e., a small flow-rate side), in other words, in the negative x-axis direction, the summed value (Fs+F1) of the spring load (the spring force Fs) of coil spring 24 and the first force F1 acting in the positive x-axis direction and created by hydraulic pressure on the first pressure-receiving surface of the area D1 has to be overcome by the second force F2 acting in the negative x-axis direction and created by hydraulic pressure on the second pressure-receiving surface of the area D2, that is, (Fs+F1)<F2.

Also, even during an engine startup in which hydraulic pressures in the first and second pressure chambers do not yet develop sufficiently and hydraulic pressures in supply passages 53*a*-53*b* become still low (e.g., a minimum pressure value Pmin), and thus the second force F2 as well as the first force F1 begins to develop, it is necessary to satisfy the previously-noted condition (Fs+F1)<F2. For the reasons discussed above, the area D1 of the first pressure-receiving surface and the area D2 of the second pressure-receiving surface (in other words, the pressure-receiving surface area difference (D2−D1)) is set or adjusted to satisfy a specified inequality (Fs+Pmin×D1<Pmin×D2). Hereby, even when hydraulic pressures in supply passages 53*a*-53*b*, supplied from pump P during an engine startup, become still low (e.g., a minimum pressure value Pmin), spool valve 2 can be reliably operated.

By the way, suppose that control valve apparatus 1 is receiving engine vibration inputs under a state where oil, mixed with a lot of air bubbles during an engine startup, has been supplied into the supply passage 53. In such a situation, there is an increased tendency for high-pitch rapping noise to occur due to undesirable vibrations of the spring-loaded spool 20, arising from air-filled cavities within the supplied oil. Hence, the spring load Fs (in particular, an initial set load (a preload) produced by coil spring 24 at the spring-loaded position "A" of spool 20) has to be preferably set to a value that there is no occurrence of rapping noise as discussed above.

In the third embodiment, coiled compression spring 24 is used as the biasing means. In lieu thereof, an extension spring may be installed in the second pressure chamber and disposed between threaded plug 413 and partition wall portion 23, to permanently force the spool 20 in the positive x-axis direction with respect to housing 4. Another type of spring or an elastic member may be used as a biasing means by which spool 20 is returned to its initial position (the position "A").

Thus, according to the third embodiment (see FIG. 6), spool 20 of spool valve 2 is permanently biased in the direction (i.e., the positive x-axis direction) that a flow rate of a portion of the main flow passage (supply passage 53) downstream of the branched point 530 becomes maximum. By only the addition of the biasing means (coil spring 24), it is possible to more certainly enhance a lubrication performance during an engine startup and also to suppress undesirable occurrence of rapping noise resulting from engine vibration inputs, while enhancing the degree of freedom of layout (installation) of control valve apparatus 1.

Fourth Embodiment

Referring now to FIG. 7, there is shown a partial cross-section of control valve apparatus 1 of the fourth embodiment, in which spool 20 is equipped with a sliding-contact member, such as a seal ring S5, such that spool 20, which has already been controlled to the position "A" by the standby control, can be more certainly held at the position "A" by a sliding frictional resistance created by the sliding-contact member.

The cross-section of FIG. 7 shows the partial cross-section passing through the centerline "Q" of control valve apparatus 1 of the fourth embodiment (that is, the axis of sliding motion of the sliding-contact member equipped spool 20).

As clearly shown in FIG. 7, in the fourth embodiment, the axial length of the flanged portion 211 (serving as a sliding-contact portion of spool 20), measured in the x-axis direction, is dimensioned to be larger than that of the flanged portion 211 of the first embodiment shown in FIGS. 4-5. An annular recessed groove 212 is formed in the outer periphery of flanged portion 211, utilizing the larger axial length of the flanged portion 211. The sliding-contact member (concretely, seal ring S5 serving as a fluid-tight sealing member) is installed into the annular groove 212. Seal ring S5 is an elastic ring having a substantially circular cross-section and made of special rubber-like material. The inner peripheral side of seal ring S5 is kept in wall-contact with the bottom of annular groove 212, whereas the outer peripheral side of seal ring S5 is kept in wall-contact with the large-diameter bore 40*a* of back-pressure portion 41 of housing 4. Seal ring S5 is compressed into the annular recessed groove 212 of flanged portion 211, to provide a sealing fit (a good seal).

The other construction of the fourth embodiment is exactly the same as the first embodiment.

In a similar manner to the first embodiment, also in the fourth embodiment having the seal-ring equipped spool valve structure, spool 20 can be controlled to the position "A" (i.e., the standby position) by the standby control. During the engine stopped state, by a sliding frictional resistance created between two sliding-contact surfaces, namely, the outer peripheral surface of seal ring S5 and the inner peripheral surface of large-diameter bore 40*a* of housing 4, spool 20 can be more certainly held or maintained at the position "A".

Thus, during the next engine startup, spool 20 remains kept at the position "A" (the standby position of spool 20) by the sliding frictional resistance created between two sliding-contact surfaces, namely, seal ring S5 of flanged portion 211 and large-diameter bore 40*a* of housing 4. Therefore, in a similar manner to the third embodiment, in the fourth embodiment having the seal-ring equipped spool valve structure, it is possible to more certainly enhance a lubrication performance during an engine startup, while enhancing the degree of freedom of layout (installation) of control valve apparatus 1.

When oil is delivered into the second pressure chamber and thus spool 20 moves in the negative x-axis direction, seal ring S5, together with spool 20, slides in the same direction, while being kept in sliding-contact and in sealing-fit with the inner peripheral surface of large-diameter bore 40*a*. Thus, even when hydraulic pressure acts on the end face of spool 20, facing in the positive x-axis direction, it is possible to keep a high fluid-tightness between the second pressure chamber and the annular space p, thus suppressing oil leakage from the oblique hole 412.

Even when engine vibration inputs are applied to control valve apparatus 1 with spool 20 held at either the position "A" or the opposite position "B", it is possible to suppress unintended axial sliding motion of spool 20 by the sliding frictional resistance created between two sliding-contact surfaces, namely, seal ring S5 of flanged portion 211 and large-diameter bore 40*a* of housing 4, thus suppressing undesirable occurrence of rapping noise. Fully taking into account the sliding frictional resistance of seal ring S5, in the fourth embodiment, the area D1 of the first pressure-receiving surface and the area D2 of the second pressure-receiving surface (in other words, the pressure-receiving surface area difference (D2−D1)) is set or adjusted, spool valve 2 can be reliably operated (moved), even when hydraulic pressures in supply passages 53*a*-53*b*, supplied from pump P during an engine startup, become still low (e.g., a minimum pressure value Pmin).

Thus, according to the fourth embodiment, the standby position (that is, the position "A" of spool 20), achieved by "standby control" can be more certainly held or maintained by a sliding frictional resistance created between two sliding-contact surfaces, namely, seal ring S5 of flanged portion 211 of spool 20 and sliding-contact bore 40 (large-diameter bore 40*a* of housing 4). As discussed above, the standby position (the position "A") can be maintained by the sliding frictional resistance rather than by the spring force. Hereby, it is possible to appropriately suppress the pressure level of hydraulic pressure (in other words, the magnitude of the second force F2) acting on the second pressure-receiving surface so as to move the spool 20 toward the opposite position "B" (i.e., toward the minimum flow-rate side of the variable flow-rate range of supply passage 53*b*), thus suppressing an enlargement in the size of spool valve 2.

In the fourth embodiment, seal ring S5 is used as the sliding-contact member that creates a sliding frictional resistance. In lieu thereof, another type of sliding-contact member, such as a leather ring having a substantially square cross-section, may be used. Also, the sliding-contact member (e.g., seal ring S5) may be installed on the inner periphery of sliding-contact bore 40 (large-diameter bore 40*a*) rather than installing on spool 20. Two sliding-contact surfaces, which create a sliding frictional resistance, are not limited to the outer peripheral side of flanged portion 211 (back-pressure portion 21 of spool 20) and the inner peripheral side of large-diameter bore 40*a* (back-pressure portion 41 of housing 4). For instance, the outer peripheral side of the right-hand axial end of the sliding-contact portion of flow-passage portion 22 of spool 20 and the inner peripheral side of the right-hand half of the sliding-contact portion of flow-passage portion 42 of housing 4 may be utilized or designed as two sliding-contact surfaces, which create a sliding frictional resistance. Furthermore, without using such a sliding-contact member (e.g., seal ring S5), either the outer peripheral surface of flanged portion 211 or the inner peripheral surface of sliding-contact bore 40 may be machined so as to provide an appropriate sliding frictional resistance.

Fifth Embodiment

Figure 8:
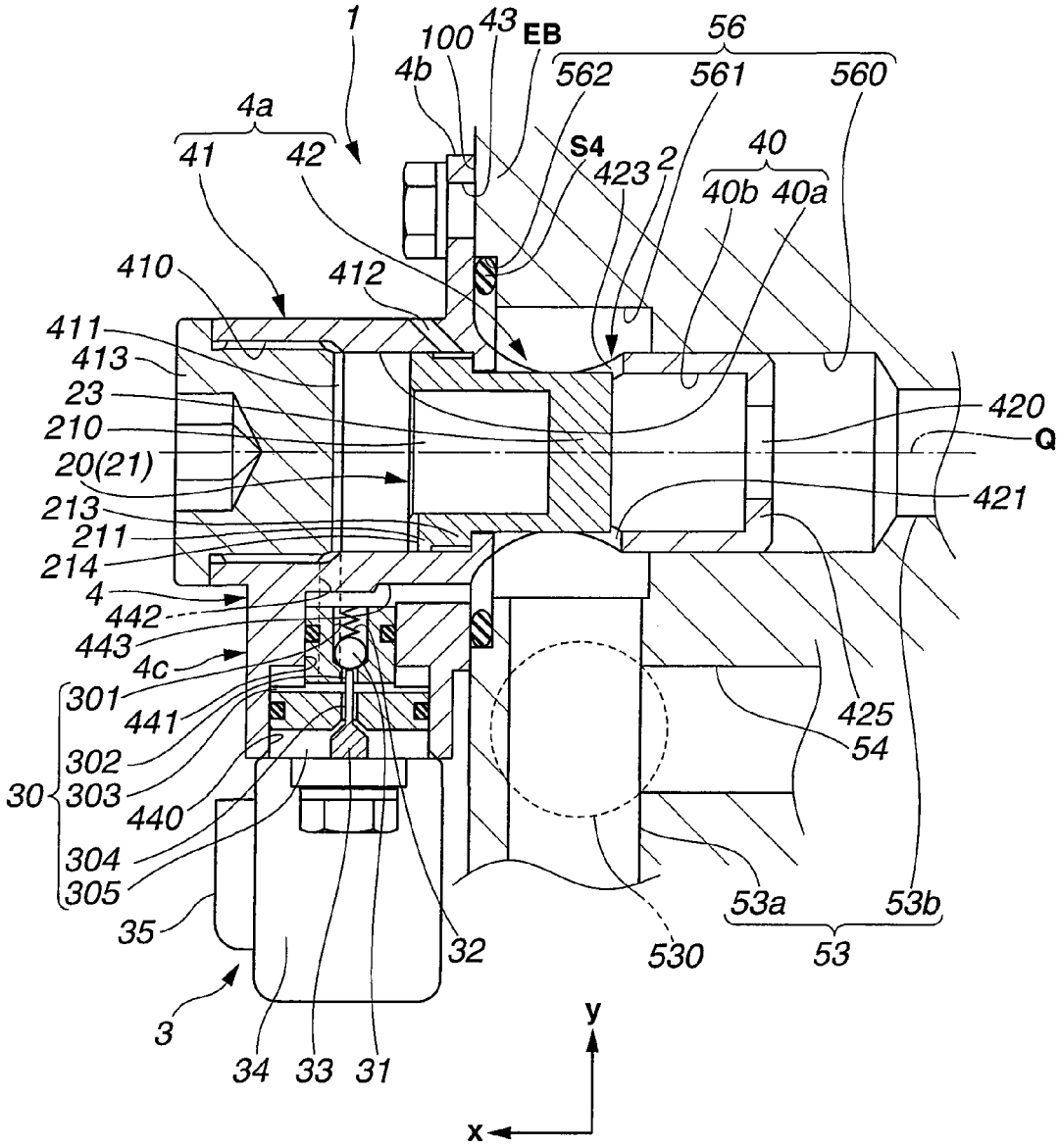
FIG. 8 is a partial cross-section of the control valve apparatus of the fifth embodiment, whose spool is controlled to a small flow-rate side.

Referring now to FIG. 8, there is shown a partial cross-section of control valve apparatus 1 of the fifth embodiment, in which a flow-constriction device, which is provided for throttling or constricting the flow-passage area of the flow path between supply passages 53*a*-53*b*, is constructed by the apertures defined between the inner peripheral surfaces of through holes 421-424 of housing 4 and one axial end of spool 20, instead of forming a through hole (radial through hole 227) in the spool 20.

The cross-section of FIG. 8 shows the partial cross-section passing through the centerline "Q" of control valve apparatus 1 of the fifth embodiment (that is, the axis of sliding motion of spool 20), under a state of the maximum displacement of spool 20 in the negative x-axis direction.

As clearly shown in FIG. 8; in the fifth embodiment, spool 20 does not have flow-passage portion 22. Spool 20 is formed into a substantially cylindrical hollow shape, but closed at one axial end such that partition wall portion 23 constructs the bottom of spool 20. The axial length of spool 20 of the fifth embodiment is dimensioned to be shorter than that of the first embodiment. Notice that spool 20 of the fifth embodiment does not have through holes 223-227.

Spool 20 has an intermediate stepped portion 213 formed integral with the flanged portion 211 in such a manner as to extend from the side face of flanged portion 211 in the negative x-axis direction by a predetermined axial length. Intermediate stepped portion 213 is formed into an annular shape. The outside diameter of intermediate stepped portion 213 is dimensioned to be slightly less than that of flanged portion 211 and also dimensioned to be slightly greater than the inside diameter of small-diameter bore 40*b*.

In a similar manner to the first embodiment (see FIGS. 4-5), in the fifth embodiment (see FIG. 8), sliding motion of spool 20 in the positive x-axis direction is restricted by abutment between the end face of the positive x-axis direction of flanged portion 211 and the end face of the negative x-axis direction of threaded plug 413. On the other hand, sliding motion of spool 20 in the negative x-axis direction is restricted by abutment between the end face of the negative x-axis direction of intermediate stepped portion 213 and the leftmost end face (viewing FIG. 8) of flow-passage portion 42 of housing 4, facing in the positive x-axis direction. That is, the end face of the negative x-axis direction of intermediate stepped portion 213 and the leftmost end face of flow-passage portion 42 of housing 4, facing in the positive x-axis direction, cooperate with each other to provide a second stopper (a sliding-motion stopper for spool 20 in the negative x-axis direction) by which the opposite restricted position "B" shown in FIG. 8 is realized.

Intermediate stepped portion 213 is formed to have its outside diameter slightly less than that of flanged portion 211. Even with the spool 20 held at the position "B", an annular space can be defined between the outer peripheral surface of intermediate stepped portion 213 and the inner peripheral surface of large-diameter bore 40*a* (a large-diameter portion of sliding-contact bore 40). Thus, the inward opening of oblique hole 412, which opens into the interior space of sliding-contact bore 40 through the inner peripheral surface of large-diameter bore 40*a*, is not closed but always open. This enables the smooth movement of air in and out of the annular space through the oblique hole 412 during sliding motion of spool 20, thus ensuring a smooth operation (a smooth sliding motion) of spool 20.

With spool 20 held at the position "A", the end face of spool 20, facing in the negative x-axis direction, that is, the right-hand side face of the bottom 23 is positioned to close approximately one-half (the left-hand half) of each of through holes 421-424 by the outside cylindrical surface of spool 20. In other words, at the position "A", each of through holes 421-424 is approximately half-opened. At this restricted position "A", the opening degree of through holes 421-424 becomes maximum, and thus the flow-passage area of the oil flow path, directed from the supply passage 53*a* through the annular groove 561 and through holes 421-424 to the inner peripheral side of flow-passage portion 42 (supply passage 53*b*), becomes a maximum value.

The opening area (the flow-passage area) of the through holes 421-424 tends to gradually reduce (because of gradual overlapping of the outside cylindrical surface of spool 20 and the through holes 421-424), as spool 20 moves from the position "A" to the opposite position "B" in the negative x-axis direction and thus the axial displacement of spool 20 in the negative x-axis direction increases.

With spool 20 held at the opposite position "B" (see FIG. 8), the end face of spool 20, facing in the negative x-axis direction, that is, the right-hand side face of the bottom 23 is positioned to be slightly offset from the end of the negative x-axis direction of each of through holes 421-424 toward the positive x-axis direction. In other words, at the opposite position "B", spool 20 and the through holes 421-424 of flow-passage portion 42 of housing 4 largely overlap each other. At this restricted position "B" (i.e., the largely overlapping position of FIG. 8), the opening degree of through holes 421-424 becomes minimum, and thus the flow-passage area of the oil flow path, directed from the supply passage 53*a* through the annular groove 561 and through holes 421-424 to the inner peripheral side of flow-passage portion 42 (supply passage 53*b*), becomes a minimum value.

As discussed above, the apertures defined between the inner peripheral surfaces of through holes 421-424 of housing 4 and the first axial end of spool 20, facing in the negative x-axis direction, serve as a flow-constriction device (a variable orifice). When spool 20 is positioned at the opposite position "B" (see FIG. 8), the apertures (the variable orifice) provide a maximum flow-constricting orifice action.

The other construction of the fifth embodiment is exactly the same as the first embodiment.

In contrast to the flow-path configuration of the first embodiment (see FIGS. 4-5) in which oil can be fed from annular groove 561 through the second group of through holes 421-424 and the first group of through holes 223-226 to the inner peripheral side of flow-passage portion 42 (supply passage 53*b*), according to the flow-path configuration of the fifth embodiment (see FIG. 8), oil is fed into the inner peripheral side of flow-passage portion 42 directly through the through holes 421-424. Thus, it is easy to enlarge the flow-passage area of the oil flow path, directed from the supply passage 53*a* through the annular groove 561 and through holes 421-424 to the inner peripheral side of flow-passage portion 42 (supply passage 53*b*), as compared to the flow-path configuration of the first embodiment. Hence, a pressure loss of oil flowing through the control valve apparatus 1 can be easily suppressed, thus enabling oil to be more rapidly fed to each of lubricated engine parts, after the engine has been started.

Sixth Embodiment

Figure 9:
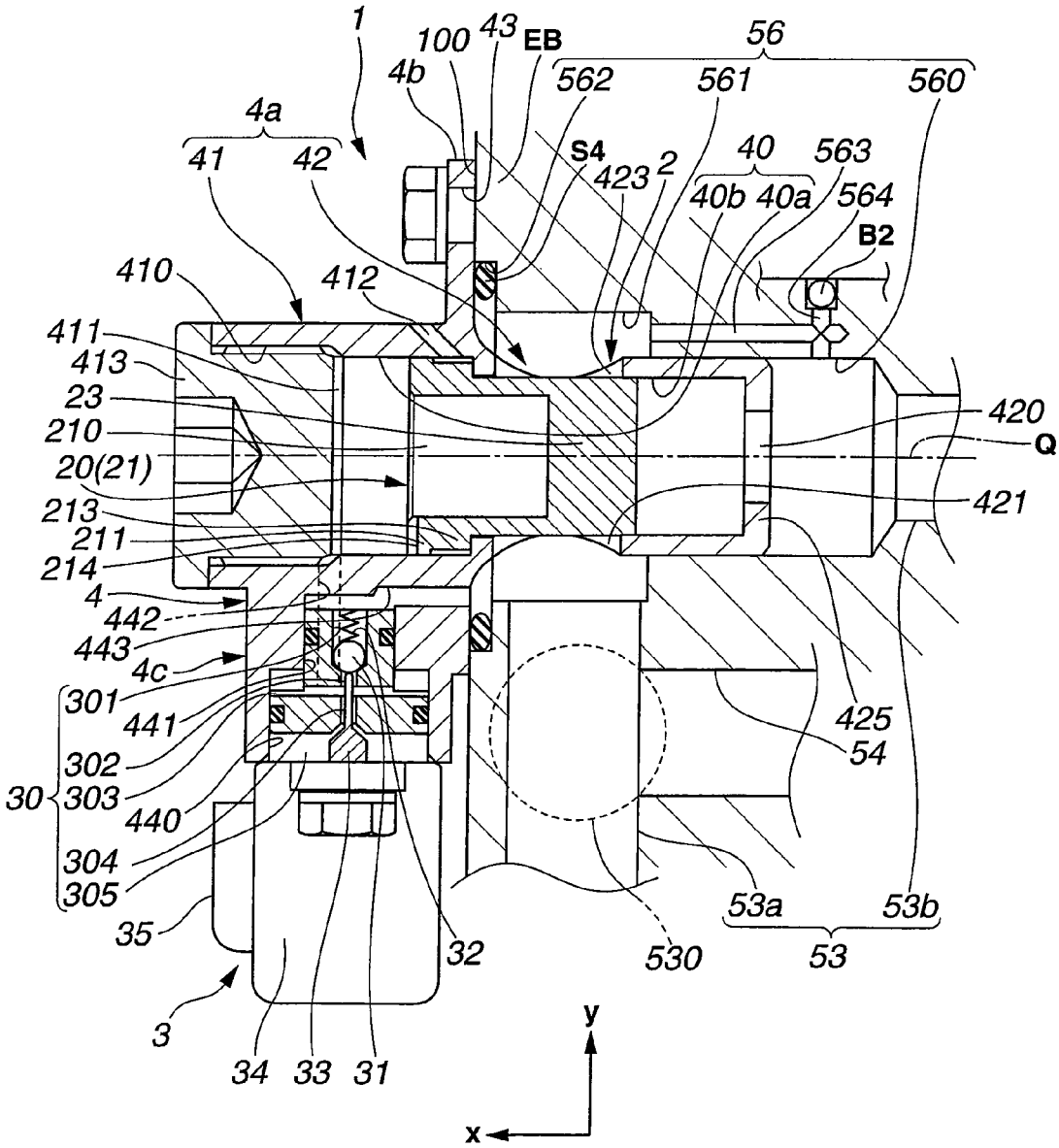
FIG. 9 is a partial cross-section of the control valve apparatus of the sixth embodiment, whose spool is controlled to a small flow-rate side.

Referring now to FIG. 9, there is shown a partial cross-section of control valve apparatus 1 of the sixth embodiment, in which a flow-constriction device (an orifice) that throttles or constricts the flow path between supply passages 53*a*-53*b* is constructed by a small-diameter communication hole formed in engine block EB.

The cross-section of FIG. 9 shows the partial cross-section passing through the centerline "Q" of control valve apparatus 1 of the sixth embodiment (that is, the axis of sliding motion of spool 20), under a state of the maximum displacement of spool 20 in the negative x-axis direction.

As can be appreciated from comparison between the longitudinal cross-section of spool 20 of the fifth embodiment of FIG. 8 and the longitudinal cross-section of spool 20 of the sixth embodiment of FIG. 9, the shape of spool 20 of the sixth embodiment is similar to that of the fifth embodiment, except that the axial length of spool 20 of the sixth embodiment is dimensioned to be slightly greater than that of the fifth embodiment.

With spool 20 held at the opposite position "B", the end face of spool 20, facing in the negative x-axis direction, that is, the right-hand side face of the bottom 23 is positioned to fully close the entire range of opening of each of through holes 421-424 by the outside cylindrical surface of spool 20. Instead of using spool 20 having the cross section as shown in FIG. 9, a modified spool in which the second groove 222 and through hole 227 are both eliminated from spool 20 of the first embodiment of FIGS. 4-5 may be used. Thus, the modified spool has not the second groove 222 and through hole 227 but has through holes 223-226.

As clearly shown in FIG. 9, in the sixth embodiment, as a small-diameter communication hole intercommunicating annular groove 561 and housing retaining bore 560 (supply passage 53*b*), two bores 563 and 564 are formed in engine block EB. The inside diameters of two bores 563-564 are dimensioned to be small in the same manner as the through hole 227 of spool 20 of the first embodiment.

Bore 563 is formed as a substantially straight small-diameter axial bore extending in the x-axis direction. Bore 563 is formed, on the side of the positive x-axis direction, to open into the inner peripheral side of annular groove 561. Bore 563 is drilled to extend from the right-hand side face of annular groove 561 to a predetermined depth in the negative x-axis direction.

Bore 564 is formed as a substantially straight small-diameter radial bore extending in the y-axis direction. Bore 564 is formed, on the side of the positive y-axis direction, to open from the outer peripheral surface of engine block EB to the exterior space. Bore 564 is formed, on the side of the negative y-axis direction, to open into the interior space of housing retaining bore 560 from a section of the inner peripheral surface of housing retaining bore 560 whose section is out of fitted-engagement with the right-hand side cylindrical end of flow-passage portion 42 of housing 4. The outside opening end of radial bore 564, opened into the exterior space of engine block EB, is plugged by press-fitting a ball B2 into the outside opening end.

Axial bore 563 and radial bore 564 are connected to each other at their cross-point, so as to intercommunicate annular groove 561 and housing retaining bore 560 via these bores 563-564.

The other construction of the sixth embodiment is exactly the same as the first embodiment.

In the sixth embodiment, regardless of the axial position of spool 20, supply passages 53*a*-53*b* can be always communicated each other via the bores 563-564.

With spool 20 held at the opposite position "B" shown in FIG. 9, the oil flow path, directed from the supply passage 53*a* through the annular groove 561 and through holes 421-424 to the inner peripheral side of flow-passage portion 42 (supply passage 53*b*), is blocked (fully closed) by the outside cylindrical surface of spool 20. Thus, oil can be fed into the supply passage 53*b* by way of only the small-diameter bores 563-564. Hence, at the opposite position "B", the flow path between supply passages 53*a*-53*b* can be throttled or constricted by a maximum flow-constricting orifice action of small-diameter bores 563-564 (serving as a fixed orifice configuration).

As discussed above, at the opposite position "B", the sixth embodiment (with a fixed orifice configuration comprised of bores 563-564 formed in engine block EB) can provide the same flow-constricting orifice action as the fifth embodiment (with a variable orifice configuration comprised of the short-length sliding spool and the through hole group 421-424 of housing 4). As previously discussed, in the fifth embodiment of FIG. 8, the flow-constriction device is constructed in the form of a variable orifice (comprised of the short-length sliding spool and the through hole group 421-424 of housing 4), utilizing the relative-position relationship between the axially sliding spool 20 and the stationary spool valve body 4*a* of housing 4, and thus spool 20 and spool valve body 4*a* of housing 4 have to be more accurately machined and produced. As compared to the fifth embodiment of FIG. 8, in order to provide a high-accuracy flow-constriction orifice, the sixth embodiment of FIG. 9 requires accurate machining of only the orifice bores 563-564, but not require very accurate machining of both spool 20 and spool valve body 4*a* of housing 4. This contributes to reduced manufacturing costs and high-precision flow-rate control after the engine has been started.

In the first to sixth embodiments, control valve apparatus 1 is constructed by the pilot-operated type two-way spool valve. It will be appreciated that control valve apparatus 1 is not limited to such a pilot-operated type two-way spool valve. In lieu thereof, a control valve of another type may be used. That is, the spool valve may be replaced with another type, such as a rotary valve, a needle valve, or a slide valve.

In the first to sixth embodiments, control valve apparatus 1 is disposed in the main flow passage (supply passage 53) downstream of the branched point 530, for controlling or adjusting a flow rate of oil flowing through the main flow passage (supply passage 53) downstream of the branched point 530, in other words, a flow rate of oil distributed to each of lubricated engine parts and a flow rate of oil distributed to the hydraulic actuator. In lieu thereof, control valve apparatus 1 may be disposed either in the branched point 530 or in the branch passage 54, for flow-rate distribution between oil distributed to each of lubricated engine parts and oil distributed to the hydraulic actuator.

For instance, suppose that control valve apparatus 1 of a three-way type is disposed in the branched point 530, the downstream end of passage 54 is connected to each of lubricated engine parts such that passage 54 serves as a main flow passage, and the downstream end of passage 53*b* is connected to the VTC device such that passage 53*b* serves as a branch passage. In such a case, by throttling the opening degree of the three-way valve, a flow rate of oil flowing through the branch passage (passage 53*b*) can be controlled to a small flow-rate side of a variable flow-rate range. Conversely, by enlarging the opening degree of the three-way valve, a flow rate of oil flowing through the branch passage (passage 53*b*) can be controlled to a large flow-rate side of a variable flow-rate range. However, from the following viewpoints, the first to sixth embodiments are superior to this modification.

In the first to sixth embodiments, as previously described, control valve apparatus 1 is disposed in the main flow passage (supply passage 53*b*) downstream of the branched point 530. Thus, during an engine startup in which lubricating action for the moving engine parts is largely rapidly required, the flow rate of oil distributed to each of lubricated engine parts can be effectively increased. In other situations, a minimum amount of oil, needed for lubricating action, can be distributed to each of lubricated engine parts. Thus, it is possible to suppress oil, discharged from the oil pump, from being wastefully exhausted, thus minimizing energy loss. Additionally, by throttling or controlling the flow rate of oil distributed to each of lubricated engine parts (to supply passage 53*b*) to a minimum value, needed for lubricating action, it is possible to distribute most of oil, discharged and force-fed from the oil pump, toward the hydraulic actuator (the VTC device) as much as possible. The responsiveness of the hydraulic actuator can be effectively enhanced. Control valve apparatus 1 of each of the first to sixth embodiments uses a two-way valve. Thus, as compared to the use of a three-way valve having a more complicated structure, the two-way valve is simple, thus ensuring the increased design flexibility.

In the first to sixth embodiments, sliding motion of the spool can be controlled by a control pressure (a pilot pressure) created by the pilot valve and applied to the back-pressure chamber (i.e., the second pressure-receiving surface) of the spool valve. In lieu thereof, the spool may be operated directly by a magnetic force of a solenoid, that is, the pilot-operated spool valve may be replaced by a solenoid-operated spool valve. The solenoid-operated spool valve is superior with respect to a higher responsiveness, but inferior with respect to reduced whole size of the spool valve system.

Also, in the first to sixth embodiments, switching between the position "A" and the opposite position "B" of the spool valve is performed by ON-OFF control (energization/de-energization control) for the solenoid 34 of pilot valve 3. In this manner, the opening degree of pilot valve 3 (i.e., the position of armature 33) can be varied directly by solenoid 34. In lieu thereof, the ON/OFF controlled spool valve system may be replaced by a continuously variable solenoid-operated control valve system in which the axial position of the spool (in other words, the opening degree of the flow path between supply passages 53*a*-53*b*) can be continuously varied, depending on a duty cycle of a pulse-width modulated signal of energization of the solenoid. The duty-ratio-controlled continuously variable solenoid-operated control valve system is superior with respect to reduced whole size of the spool valve system, but inferior with respect to simplified control valve system configuration.

The entire contents of Japanese Patent Application No. 2009-290236 (filed Dec. 22, 2009) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A control valve apparatus for a vehicle having a hydraulic system equipped with a main flow passage for feeding oil, discharged from an oil pump driven by an internal combustion engine, to each of lubricated engine parts, a branch passage branched from the main flow passage at a branched point, and a hydraulically-operated variable valve timing control device operated by a hydraulic pressure in the branch passage and having a lock mechanism configured to hold engine valve timing until the hydraulic pressure in the branch passage becomes greater than or equal to a specified pressure value, the control valve apparatus comprising:

a spool valve configured to throttle the flow rate of the oil flowing through the portion of the main flow passage downstream of the branched point depending on an axial position of its spool, the axial position of the spool being obtained as a result of a sliding motion of the spool relative to a spool valve body, wherein the control valve apparatus is configured to adjust a flow rate of the oil flowing through a portion of the main flow passage downstream of the branched point, the control valve apparatus is configured to control the flow rate of the oil flowing through the portion of the main flow passage downstream of the branched point to a large flow-rate side of a variable flow-rate range, until a hydraulic pressure of the oil flowing through the main flow passage becomes greater than or equal to a predetermined pressure value after the engine has been started from its stopped state, the control valve apparatus is further configured to control the flow rate of the oil flowing through the portion of the main flow passage downstream of the branched point to a small flow-rate side of the variable flow-rate range, when the hydraulic pressure of the oil flowing through the main flow passage becomes greater than or equal to the predetermined pressure value after the engine has been started from its stopped state, the spool of the spool valve is slidably accommodated in a sliding-contact bore of a substantially cylindrical flow-passage portion of the spool valve body, the flow-passage portion of the spool valve body having at least one through hole formed to penetrate inner and outer peripheries of the flow-passage portion of the spool valve body, the spool has a substantially cylindrical flow-passage portion closed at one axial end and opening at the opposite axial end, the flow-passage portion of the spool having at least one through hole formed to penetrate inner and outer peripheries of the flow-passage portion of the spool and configured to be able to communicate the through hole of the flow-passage portion of the spool valve body depending on the axial position of the spool, and an upstream side of the main flow passage communicates the through hole of the flow-passage portion of the spool valve body, while a downstream side of the main flow passage communicates the opening end of the flow-passage portion of the spool, for throttling a flow of the oil flowing via a flow path between the through hole of the flow-passage portion of the spool valve body and the through hole of the flow-passage portion of the spool depending on the axial position of the spool.

2. The control valve apparatus as claimed in claim 1, wherein:

the flow rate of the oil flowing through the portion of the main flow passage downstream of the branched point is controlled to a maximum flow rate, at least until the hydraulic pressure of the oil flowing through the main flow passage becomes greater than or equal to the predetermined pressure value after the engine has been started from its stopped state.

3. The control valve apparatus as claimed in claim 1, wherein:

the flow rate of the oil flowing through the portion of the main flow passage downstream of the branched point is controlled to a minimum flow rate, when the hydraulic pressure of the oil flowing through the main flow passage becomes greater than or equal to the predetermined pressure value after the engine has been started from its stopped state.

4. The control valve apparatus as claimed in claim 1, wherein:

the flow rate of the oil flowing through the portion of the main flow passage downstream of the branched point is controlled responsively to an electrical signal.

5. The control valve apparatus as claimed in claim 4, further comprising:

an oil pressure sensor disposed in the main flow passage for directly detecting the hydraulic pressure of the oil flowing through the main flow passage, wherein it is determined, based on information from the oil pressure sensor, whether the hydraulic pressure of the oil flowing through the main flow passage becomes greater than or equal to the predetermined pressure value.

6. The control valve apparatus as claimed in claim 4, wherein:

a time elapsed from a point of time when the engine has been started from its stopped state is timed, and it is estimated, based on a result of comparison between the elapsed time and a predetermined time delay, whether the hydraulic pressure of the oil flowing through the main flow passage becomes greater than or equal to the predetermined pressure value.

7. The control valve apparatus as claimed in claim 6, further comprising:

a temperature sensor attached to the engine for detecting a temperature of the engine during a startup of the engine, and the predetermined time delay is changed based on information from the temperature sensor.

8. The control valve apparatus as claimed in claim 7, wherein:

the predetermined time delay used when the detected temperature is low, is lengthened, in comparison with the predetermined time delay used when the detected temperature is high.

9. The control valve apparatus as claimed in claim 1, wherein:

the hydraulically-operated variable valve timing control device has an oil passage formed therein for introducing a hydraulic pressure into the lock mechanism before a startup of the engine.

10. The control valve apparatus as claimed in claim 1, wherein:

the spool of the spool valve is permanently biased in one axial direction that the flow rate of the oil flowing through the portion of the main flow passage downstream of the branched point becomes maximum.

11. The control valve apparatus as claimed in claim 1, wherein:

the spool valve is controlled responsively to an electrical signal, the spool valve is further configured to hold the axial position of the spool at a stopped position that the spool has been positioned when the engine has been stopped, and the spool valve is controlled to bring the spool to the stopped position that the flow rate of the oil flowing through the portion of the main flow passage downstream of the branched point becomes maximum, during either one of an engine stopping period and an engine startup period.

12. The control valve apparatus as claimed in claim 1, wherein:

the spool valve is further configured to hold the axial position of the spool, which spool is in a stopped state, by a sliding frictional resistance created between a sliding-contact surface of the spool and a sliding-contact surface of the spool valve body.

13. The control valve apparatus as claimed in claim 1, wherein:

an annular groove is provided to surround the entire circumference of a portion of the flow-passage portion of the spool valve body having the through hole, and the main flow passage communicates the annular groove.

14. The control valve apparatus as claimed in claim 1, wherein:

fluid-communication between the through hole of the flow-passage portion of the spool valve body and the through hole of the flow-passage portion of the spool is blocked when the flow rate of the oil flowing through the portion of the main flow passage downstream of the branched point has been throttled to the minimum flow rate, and the opening end of the flow-passage portion of the spool is communicated with the through hole of the flow-passage portion of the spool valve body by way of a fixed orifice formed to penetrate the inner and outer peripheries of the flow-passage portion of the spool under a state where the fluid-communication between the through hole of the flow-passage portion of the spool valve body and the through hole of the flow-passage portion of the spool is blocked.

15. The control valve apparatus as claimed in claim 1, wherein:

an area of a first pressure-receiving surface of the spool, facing in the opposite axial direction, is formed to be less than an area of a second pressure-receiving surface of the spool, facing in the one axial direction, and switching between a state where the hydraulic pressure in the main flow passage acts on only the first pressure-receiving surface and a state where the hydraulic pressure in the main flow passage acts on both the first pressure-receiving surface and the second pressure-receiving surface is performed by means of an electromagnetic valve.

16. A control valve apparatus for a vehicle having a hydraulic system equipped with a main flow passage for feeding oil, discharged from an oil pump driven by an internal combustion engine, to each of lubricated engine parts, a branch passage branched from the main flow passage at a branched point, and a hydraulically-operated variable valve timing control device operated by a hydraulic pressure in the branch passage and having a lock mechanism configured to hold engine valve timing until the hydraulic pressure in the branch passage becomes greater than or equal to a specified pressure valve, the control valve apparatus comprising:

a spool valve, wherein the control valve apparatus is configured to adjust a flow rate of the oil flowing through a portion of the main flow passage downstream of the branched point, the control valve apparatus is configured to control the flow rate of the oil flowing through the portion of the main flow passage downstream of the branched point to a large flow-rate side of a variable flow-rate range, until a hydraulic pressure of the oil flowing through the main flow passage becomes greater than or equal to a predetermined pressure valve after the engine has been started from its stopped state, the control valve apparatus is further configured to control the flow rate of the oil flowing through the portion of the main flow passage downstream of the branched point to a small flow-rate side of the variable flow-rate range, when the hydraulic pressure of the oil flowing through the main flow passage becomes greater than or equal to the predetermined pressure value after the engine has been started from its stopped state, a spool of the spool valve is slidably accommodated in a sliding-contact bore of a substantially cylindrical flow-passage portion of a spool valve body, the flow-passage portion of the spool valve body having at least one through hole formed to penetrate inner and outer peripheries of the flow-passage portion of the spool valve body, an upstream side of the main flow passage communicates the through hole of the flow-passage portion of the spool valve body, while a downstream side of the main flow passage communicates a flow-constriction orifice passage defined between the spool and the through hole of the flow-passage portion of the spool valve body, and the flow rate of the oil, flowing through the portion of the main flow passage downstream of the branched point, is throttled with a change in opening area of the flow-constriction orifice passage, which opening area is determined depending on an axial position of the spool obtained as a result of a sliding motion of the spool relative to the spool valve body.

* * * * *